US006899638B2

(12) United States Patent
Iwata et al.

(10) Patent No.: US 6,899,638 B2
(45) Date of Patent: May 31, 2005

(54) GOLF CLUB

(75) Inventors: Mototaka Iwata, Osaka (JP); Kenji Onoda, Osaka (JP); Koji Sakai, Osaka (JP); Yukihiro Teranishi, Osaka (JP); Takeshi Naruo, Osaka (JP); Kazuhiro Ohmori, Osaka (JP); Yoshihiro Fujikawa, Osaka (JP)

(73) Assignee: Mizuno Corporation, Osaka (JP)

( * ) Notice: Subject to any disclaimer, the term of this patent is extended or adjusted under 35 U.S.C. 154(b) by 395 days.

(21) Appl. No.: 09/845,661

(22) Filed: Apr. 30, 2001

(65) Prior Publication Data

US 2001/0051548 A1 Dec. 13, 2001

(30) Foreign Application Priority Data

May 2, 2000 (JP) ..... 2000-133314
Dec. 27, 2000 (JP) ..... 2000-397739

(51) Int. Cl.[7] ..... A63B 53/04
(52) U.S. Cl. ..... 473/329; 473/349
(58) Field of Search ..... 473/324, 329, 473/330, 342, 345, 349, 350

(56) References Cited

U.S. PATENT DOCUMENTS

| | | | | |
|---|---|---|---|---|
| 5,048,835 A | | 9/1991 | Gorman | |
| 5,261,663 A | * | 11/1993 | Anderson | 473/342 |
| 5,318,300 A | * | 6/1994 | Schmidt et al. | 473/305 |
| 5,362,047 A | | 11/1994 | Shaw et al. | |
| 5,423,535 A | | 6/1995 | Shaw et al. | |
| 5,792,005 A | | 8/1998 | Sieleman et al. | |
| 5,807,190 A | | 9/1998 | Krumme et al. | |
| 5,823,887 A | | 10/1998 | Mikame et al. | |
| 5,830,084 A | | 11/1998 | Kosmatka | 473/349 |
| 5,836,830 A | * | 11/1998 | Onuki et al. | 473/349 |
| 5,954,596 A | * | 9/1999 | Noble et al. | 473/346 |
| 5,971,868 A | * | 10/1999 | Kosmatka | 473/349 |
| 6,007,432 A | | 12/1999 | Kosmatka | |
| 6,120,388 A | * | 9/2000 | Blough et al. | 473/291 |
| 6,319,150 B1 | * | 11/2001 | Werner et al. | 473/349 |
| 6,338,683 B1 | * | 1/2002 | Kosmatka | 473/329 |
| 6,354,962 B1 | * | 3/2002 | Galloway et al. | 473/342 |
| 6,368,234 B1 | * | 4/2002 | Galloway | 473/349 |
| 6,471,603 B1 | * | 10/2002 | Kosmatka | 473/324 |

FOREIGN PATENT DOCUMENTS

| | | | |
|---|---|---|---|
| CA | 2283878 | 7/1999 | |
| EP | 0 982 052 A1 | 3/2000 | |
| GB | 2 259 863 | 3/1993 | |
| JP | 09-168613 | 6/1997 | |
| JP | 9-168613 | 6/1997 | |
| JP | 09-192273 | 7/1997 | |
| JP | 9-192273 | 7/1997 | |
| JP | 9-299519 | 11/1997 | |
| JP | 10-071219 | 3/1998 | A63B/53/04 |
| JP | 10-244025 | 9/1998 | A63B/53/04 |
| JP | 10258142 | 9/1998 | |
| JP | 10-258142 | 9/1998 | |
| JP | 2880109 | 1/1999 | A63B/53/04 |
| JP | 2599509 | 7/1999 | A63B/53/04 |
| JP | 2000005354 | 1/2000 | |
| JP | 2000-005354 | 1/2000 | |
| JP | 2001-087428 | 4/2001 | A63B/53/04 |

OTHER PUBLICATIONS

Canadian Office Action dated Apr. 30, 2004.

* cited by examiner

*Primary Examiner*—Glenn Caldarola
*Assistant Examiner*—Tom P Duong
(74) *Attorney, Agent, or Firm*—Troutman Sanders LLP; Ryan A. Schneider; Gerald R. Boss

(57) ABSTRACT

The inventive golf club comprises a head of a metal having a face and a flexural range, defined in the face, where the quantity of flexure in a direction perpendicular to the face is at least 45% of the maximum quantity of vertical flexure of the face. The flexural range is arranged in coincidence with a hitting spot distribution range of a player in the face. Alternatively, a flexural range having a spring constant of at least 2 kN/mm and not more than 4 kN/mm is present in the face of the inventive golf club.

75 Claims, 51 Drawing Sheets

GOLF CLUB

This application claims priority from Japanese patent application No. 2000-133314 (P) filed May 2, 2000, and Japanese patent application No. 2000-397739 (P) filed Dec. 27, 2000, both entitled "Golf Club."

BACKGROUND OF THE INVENTION

1. Field of the Invention

The present invention relates to a golf club, and more particularly, it relates to a golf club comprising a golf club head, having a hardly breakable face, hardly reducing the carry of a golf ball also when making an off-centered shot.

2. Description of the Prior Art

Japanese Patent Laying-Open No. 9-168613 (1997) describes a golf club head according to first prior art. This gazette discloses a golf club head of a hollow structure provided with a hitting portion having sufficient strength for withstanding impact located at the center of a face and a portion having a small spring constant located around the same.

Japanese Patent Laying-Open No. 9-192273 (1997) discloses a golf club head of a metal according to second prior art, which is provided with a face center part in a thickness having sufficient strength for withstanding impact applied by collision with a golf ball and a peripheral part having a smaller thickness than the face center part.

Japanese Patent Laying-Open No. 9-299519 (1997) discloses a wood golf club head according to third prior art, which is provided with an annular groove on the inner surface of a face wall part to enclose the central portion of the inner surface.

An important factor required to a golf club is the ability of increasing the carry of a golf ball. When the carry is remarkably increased, the player can readily make the next shot to gain a good score. The carry remarkably depends on the position of the golf club hitting the golf ball. Dissimilarly to a professional golf player or a skilled nonprofessional player, a general player hits the golf ball at various portions such as upper, lower, right and left portions of the face of the golf club head. Therefore, while the golf ball carries enough when colliding with a sweet spot (SS) of the golf club head, the carry is extremely reduced when the golf ball collides with another portion of the face out of the sweet spot.

Bounce of the face of the golf club head is a factor remarkably concerned in the carry of the golf ball.

In order to improve the bounce of the golf club head, rigidity of the face must be reduced, i.e., the face must have a large quantity of vertical flexure. This point is now described.

FIG. 20 illustrates the relation between restitution coefficients and spring constants of golf club heads. Some wood golf club heads were selected for colliding golf balls with sweet spots (SS) of the golf club heads and measuring speeds of the golf balls before and after the collision, in order to obtain the restitution coefficient of each golf club head through the following numerical formula (1):

$$Vout/Vin=(eM-m)/(M+m) \quad (1)$$

where Vout and Vin represent the speeds of the golf ball after and before the collision respectively, M represents the weight of the golf club head, m represents the weight of the golf ball and e represents the restitution coefficient.

The spring constant of each golf club head was obtained by applying a vertical load (5 kN) to the sweet spot of the face and dividing the vertical load by the quantity of vertical flexure of the face.

It is understood from FIG. 20 that the spring constant and the restitution coefficient are extremely correlated with each other and the restitution coefficient is increased as the quantity of vertical flexure of the face is increased.

In order to increase the restitution coefficient, therefore, it is important to increase the quantity of vertical flexure of the face.

As described above, however, a general golf player hits the golf ball at various portions such as the upper, lower, right and left portions of the face of the golf club head. Therefore, it is insufficient to merely render the face center of the golf club head flexible but bounce in an offset shot at a position displaced from the sweet spot must be sufficiently increased.

In the first prior art (Japanese Patent Laying-Open No. 9-168613), the portion having a small spring constant is not arranged in response to the hitting point distribution of the player, and hence the carry of a golf ball is remarkably reduced by an offset shot although the ball carries enough when hit at the face center of this golf club head.

In the golf club head according to the first prior art provided with the portion having a smaller spring constant around the central hitting portion, further, metal materials having different spring constants must be connected with each other for forming the central portion and the peripheral portion of the face respectively with much labor at a high cost.

When the thickness of the portion around the hitting portion is reduced as compared with the hitting portion as in the prior art or an annular groove enclosing the hitting portion is formed on the inner surface of the face as in the third prior art, stress concentration is readily caused on the boundary between the portions having different thicknesses or the portion provided with the annular groove, to readily break the face by impact resulting from an offset shot.

In the golf club head according to the second prior art (Japanese Patent Laying-Open No. 9-192273), the peripheral portion is not arranged in response to the hitting point distribution of the player either and hence the carry of a golf ball is remarkably reduced by an offset shot although the ball carries enough when hit at the face center of this golf club head. Further, stress concentration is readily caused on the boundary between the portions having different thicknesses, to readily break the face by impact resulting from an offset shot.

In the golf club head according to the third prior art (Japanese Patent Laying-Open No. 9-299519), the carry of a golf ball is remarkably reduced by an offset shot similarly to the first prior art and the second prior art. Further, the annular groove and the central portion have remarkably different thicknesses, and hence stress concentration is readily caused on the boundary therebetween. Thus, the golf club head is readily cracked due to impact resulting from an offset or a flaw or a depression caused by a shot.

SUMMARY OF THE INVENTION

Accordingly, a principal object of the present invention is to provide a golf club having a hardly breakable face, which can minimize reduction of the carry of a golf ball not only with a shot at the center of the face but also in an offset shot.

According to a first aspect of the present invention, the golf club comprises a head of a metal having a face and a flexural range, defined in the face, where the quantity of flexure in a direction perpendicular to the face is at least 45% and not more than 95% of the maximum quantity of vertical flexure of the face. This flexural range is arranged in coincidence with a hitting point distribution range of a player in the face. The term "flexural range" stands for a partial region of the face flexed in excess of a prescribed quantity when a vertical load exceeding a prescribed value is applied to the face.

When the flexural range is arranged in coincidence with the hitting point distribution range of the player in the face as described above, the player can reliably hit a golf ball within the aforementioned range in an offset shot. The quantity of flexure of the flexural range is at least 45% of the maximum quantity of vertical flexure of the face at this time, whereby reduction of the carry of the golf ball can be effectively suppressed.

The quantity of flexure in the aforementioned flexural range in the direction perpendicular to the face is preferably at least 70% of the maximum quantity of vertical flexure, and more preferably, at least 90% of the maximum quantity of vertical flexure. Thus, reduction of the carry of the golf ball can be more effectively suppressed.

A sweet spot is located within the aforementioned hitting point distribution range. The flexural range may be a partial region within the hitting point distribution range located around the sweet spot. Alternatively, the flexural range may be matched with the hitting point distribution range. The area of the flexural range is preferably in the range of 150 to 1500 $mm^2$.

According to a second aspect of the present invention, the golf club comprises a head of a metal having a face, while a flexural range having a spring constant of at least 2 kN/mm and not more than 4 kN/mm is present in the vicinity of a sweet spot of the face. The term "spring constant" stands for a value obtained by applying a vertical load to the face and dividing the vertical load by the quantity of flexure of the face.

When the flexural range having a small spring constant (at least 2 kN/mm and not more than 4 kN/mm) is provided in the vicinity of the sweet spot, the player can hit a golf ball with this flexural range in an offset shot, thereby effectively suppressing reduction of the carry of the ball in the offset shot.

The spring constant is more preferably at least 2 kN/mm and not more than 3.5 kN/mm, and further preferably at least 2 kN/mm and not more than 3.5 kN/mm.

The area of the flexural range is at least 75 $mm^2$ and not more than 1260 $mm^2$, more preferably at least 75 $mm^2$ and not more than 707 $mm^2$, and further preferably at least 75 $mm^2$ and not more than 314 $mm^2$.

Thus, the player can hit a golf ball with the flexural range in an offset shot due to the wide area of the flexural range, for effectively suppressing reduction of the carry of the golf ball in an offset shot.

The area of the aforementioned flexural range is preferably at least 3% and not more than 50% of the area of the face, and more preferably at least 5% and not more than 30% of the area of the face.

The golf club according to either one of the aforementioned aspects of the present invention preferably has at least one of the following structures:

The aforementioned flexural range may have an elliptic shape, and inclination of a major axis of the flexural range is preferably in the range of 0° to 40° with respect to the ground in this case. The aforementioned major axis preferably extends toward an upper portion of a toe of the head. The aspect ratio of the flexural range is preferably 1 to 4. The center of the flexural range is preferably present within 0 to 5 mm from a sweet spot.

The flexural range may have a quadrilateral shape or a polygonal shape. The flexural range may have any other arbitrary shape.

The flexural range may have a substantially uniform thickness, and the thickness of the face may be gradually reduced from the outer periphery of the flexural range toward the periphery of the face. The thickness of the flexural range may be largest at the central portion and gradually reduced from the central portion toward the periphery of the flexural range while the ratio of reduction of the thickness of the face may be increased from the outer periphery of the flexural range toward the periphery of the face beyond the periphery of the flexural range.

The ratio of reduction of the thickness of the face is reduced as the distance between the center of the flexural range and the outer periphery of the face is increased. The ratio of reduction of the thickness of the face is reduced as the distance between the center of the flexural range and the outer periphery of the face is increased through the outer periphery of the flexural range. Further, the ratio of reduction of the thickness of the flexural range is reduced as the distance between the center of the flexural range and the outer periphery of the flexural range is increased and the ratio of reduction of the thickness of the face is reduced as the distance between the outer periphery of the flexural range and the outer periphery of the face is increased.

The region between the outer periphery of the flexural range and the outer periphery of the face may be divided into a plurality of peripheral regions. In this case, the thickness of the flexural range is rendered larger than the thicknesses of the peripheral regions. Further, the thickness of the peripheral region having a relatively long distance between the outer periphery of the flexural range and the outer periphery of the face is rendered larger than the thickness of the peripheral region having a relatively short distance between the outer periphery of the flexural range and the outer periphery of the face.

When a portion of the face having the maximum height from a sole is located on the side of a toe, the thickness of the peripheral region located on the side of the toe is rendered larger than the thickness of the peripheral region located on the side of a heel. When a portion of the face having the maximum height from a sole is located on the side of a heel, on the other hand, the thickness of the peripheral region located on the side of the heel is rendered larger than the thickness of the peripheral region located on the side of a toe.

The peripheral regions may include first and second peripheral regions. In this case, the first and second peripheral regions may be arranged on and under the flexural range. Further, the flexural range may be arranged in the vicinity of a sole, and the first and second peripheral regions may be arranged on the side of a toe and on the side of a heel respectively.

The peripheral regions may include first, second and third peripheral regions. In this case, the flexural range extends up to a portion close to a sole, and the first, second and third peripheral regions are arranged side by side on a toe from the side of a heel.

The peripheral regions may include first, second, third and fourth peripheral regions. In this case, the first, second, third and fourth peripheral regions are arranged to enclose the flexural range.

When the region between the outer periphery of the flexural range and the outer periphery of the face is divided into a plurality of peripheral regions, the thickness of the peripheral region located on the side of a sole may be rendered larger than the thickness of the peripheral region located on the side of a crown.

Also in this case, the thickness of the peripheral region located on the side of a toe is rendered larger than the thickness of the peripheral region located on the side of a heel when a portion of the face having the maximum height from a sole is located on the side of the toe. When a portion of the face having the maximum height from a sole is located on the side of a heel, on the other hand, the thickness of the peripheral region located on the side of the heel is rendered larger than the thickness of the peripheral region located on the side of a toe.

The peripheral regions may include first, second, third and fourth regions. The first and fourth peripheral regions are located on the side of a sole, and the second and third peripheral regions are located on the side of a crown. When the length of the first peripheral region between the outer periphery of the flexural range and the outer periphery of the face is larger than the length of the fourth peripheral region between the outer periphery of the flexural range and the outer periphery of the face, the thickness of the first peripheral region is rendered larger than the thickness of the fourth peripheral region. When the length of the third peripheral region between the outer periphery of the flexural range and the outer periphery of the face is larger than the length of the second peripheral region between the outer periphery of the flexural range and the outer periphery of the face, the thickness of the third peripheral region is rendered larger than the thickness of the second peripheral region .

A first tapered part having a thickness reduced toward the outer periphery of the face may be provided on the boundary between the aforementioned flexural range and the peripheral regions, and a second tapered part having a thickness reduced toward the outer periphery of the face may be provided in the peripheral portion of the peripheral regions.

The thickness of the flexural range may be reduced from the central portion of the flexural range toward the outer periphery of the flexural range.

The average thickness of a first portion located closer to the face in at least either a crown or a sole of the head is preferably smaller than the average thickness of a second portion located closer to a back part of the head than the first portion in at least either the crown or the sole.

The thickness of the thinnest portion of the aforementioned first portion is preferably at least 0.3 mm and not more than 1.5 mm. Further, the first portion is preferably located in the range of at least 9 mm and not more than 15 mm in a direction from the peripheral portion of the face toward the back part.

The length of the first portion in a direction from a toe toward a heel of the head is preferably at least 10 mm and not more than 80 mm (hitting point distribution range), and more preferably at least 30 mm and not more than 60 mm.

The first portion includes an extension part continuously extending from at least a part of the peripheral portion of the face toward the back part of the head. The length of the aforementioned extension part in a direction from a toe toward a heel of the head is at least 10 mm and not more than 80 mm, and more preferably at least 30 mm and not more than 60 mm. In this case, the central portion of the face and the peripheral portion of the face may be formed by different members.

The present invention is applicable to a golf club having a hollow golf club head (a hollow wood head or a hollow iron head) or a solid golf club head (a solid wood head, a blade iron head or a cavity iron head).

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1A:
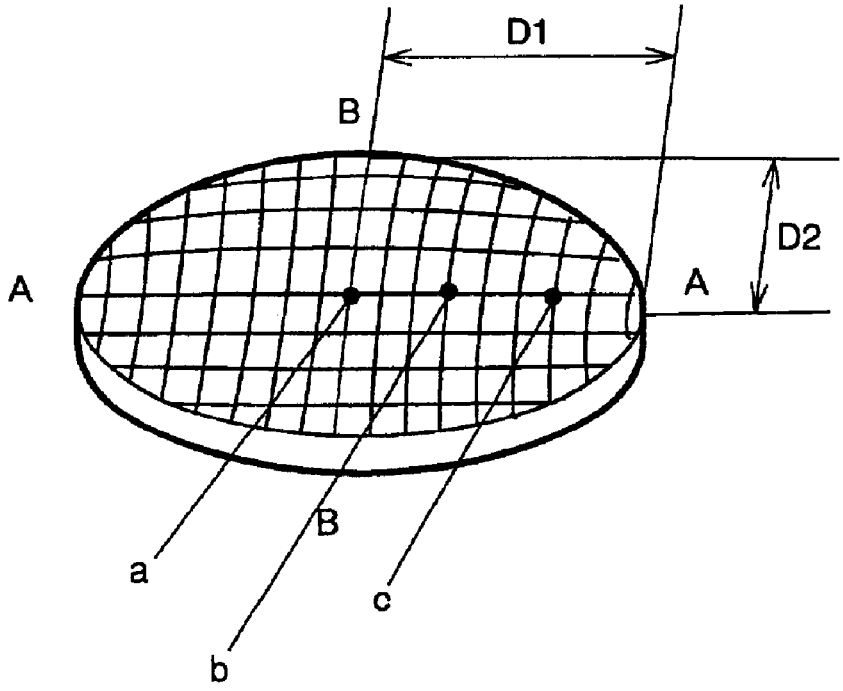
FIG. 1A schematically illustrates part of a face of a golf club head according to comparative example.
Figure 1B:
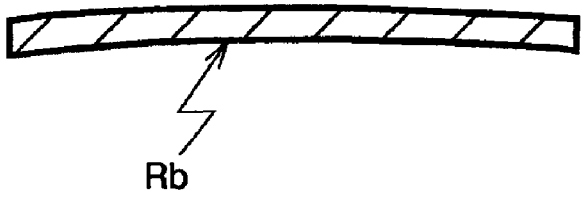
FIG. 1B is a sectional view taken along the line A—A in FIG. 1A.
Figure 1C:
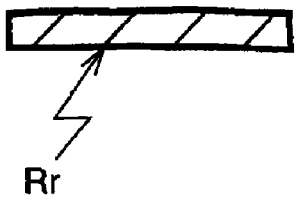
FIG. 1C is a sectional view taken along the line B—B in FIG. 1A.
Figure 2A:
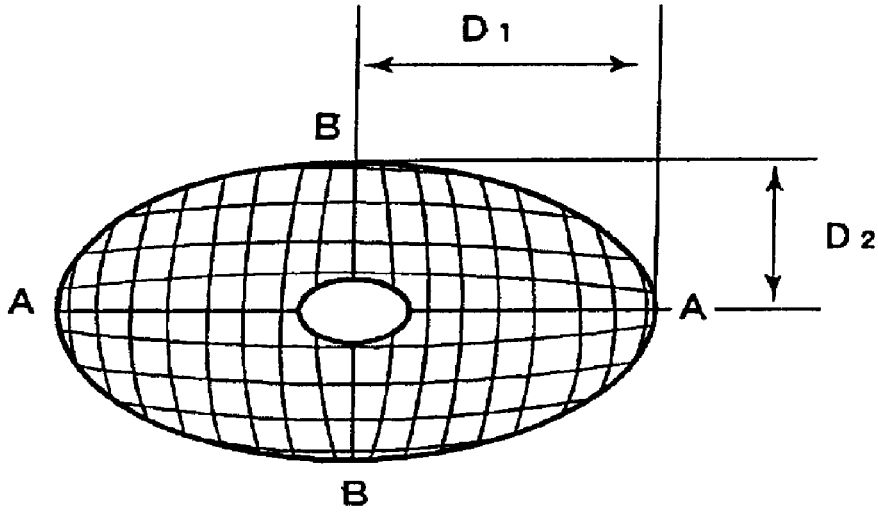
FIG. 2A schematically illustrates part of a face of a golf club head according to the present invention.
Figure 2B:
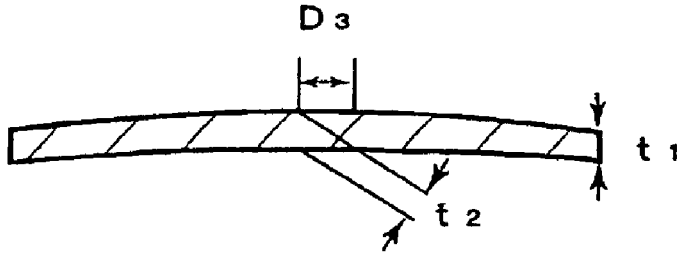
FIG. 2B is a sectional view taken along the line A—A in FIG. 2A.
Figure 2C:
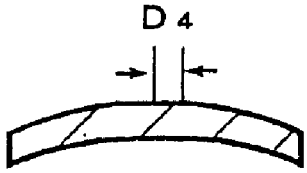
FIG. 2C is a sectional view taken along the line B—B in FIG. 2A.

FIGS. 1A to 1C are diagrams for illustrating the present invention. These figures show a computer simulation model of an elliptic golf club head of titanium having specific gravity of 4.5, an elastic modulus of 103 GPa, a Poisson's ratio of 0.3, major axis (D1) of 40 mm and minor axis (D2) of 20 mm with a radius of curvature of 254 mm (it is assumed that both of a bulge radius of curvature Rb and a roll radius of curvature Rr are 254 mm).

Table 1 shows quantities of flexure and von Mises stress values computed with software "Pro/MECHANICA 2000i" by Parametric Technology Corporation by applying a vertical load of 9800 N to points a (center: 0 mm), b (offset by 10 mm) and c (offset by 20 mm) of three types of models having thicknesses shown in Table 1 along the major axis.

TABLE 1

| Thickness of Face (mm) | Quantity of Displacement (mm) | von Mises Stress ($\times 10^7$Pa) |
|---|---|---|
| 3.0 | 0.385 | 201.0 |
| 2.8 | 0.451 | 174.7 |
| 2.6 | 0.538 | 149.6 |

When a load is applied to the point a of a golf club head having a uniform thickness, the quantity of flexure is increased as the thickness is reduced, as shown in Table 1. As the thickness is reduced, therefore, the possibility for breakage is increased due to large von Mises stress although bounce at the face center is increased.

FIGS. 2A to 2C, 3A to 3C and 4A to 4C show models 1 to 3 of golf club heads having different thickness distributions respectively. The model 1 shown in FIGS. 2A to 2C has a major axis (D3) of 10 mm, a minor axis (D4) of 5 mm and an area of 157 $mm^2$ in a hitting portion for a center shot. The thickness t2 of the face center is 3 mm (the portion having this thickness is 10 mm in major axis, 5 mm in minor axis and 157 $mm^2$ in area), and the thickness of this model is gradually reduced from the periphery of this ellipse.

Figure 3A:
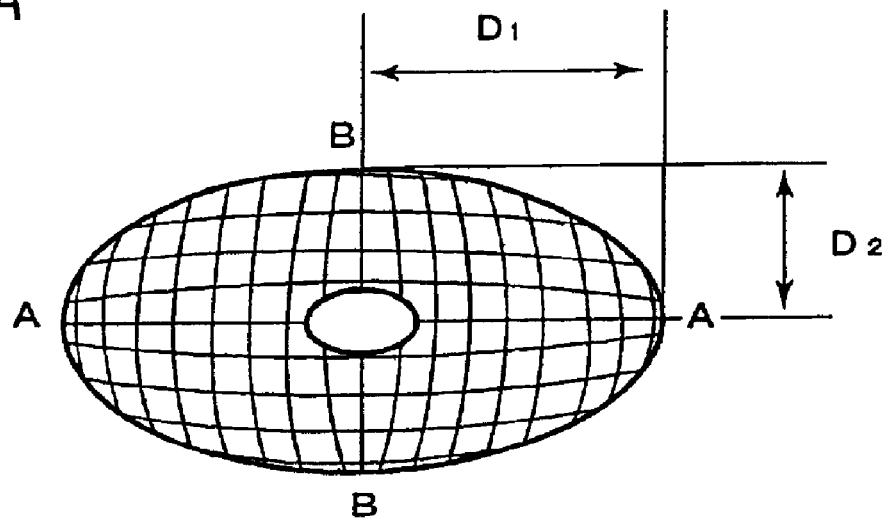
FIG. 3A schematically illustrates part of a face of another golf club head according to the present invention.
Figure 3B:
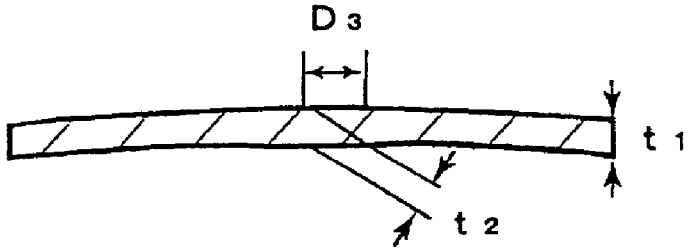
FIG. 3B is a sectional view taken along the line A—A in FIG. 3A.
Figure 3C:
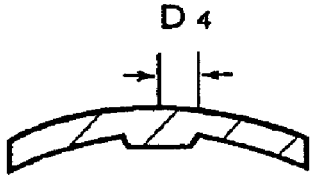
FIG. 3C is a sectional view taken along the line B—B in FIG. 3A.

The model 2 shown in FIGS. 3A to 3C has a major axis (D3) of 10 mm, a minor axis (D4) of 5 mm and an area of 157 $mm^2$ in a hitting portion for a center shot. The thickness t2 of the face center is 3 mm (the portion having this thickness is 10 mm in major axis, 5 mm in minor axis and 157 $mm^2$ in area), and the thickness of this model is immediately reduced around the face center.

Figure 4A:
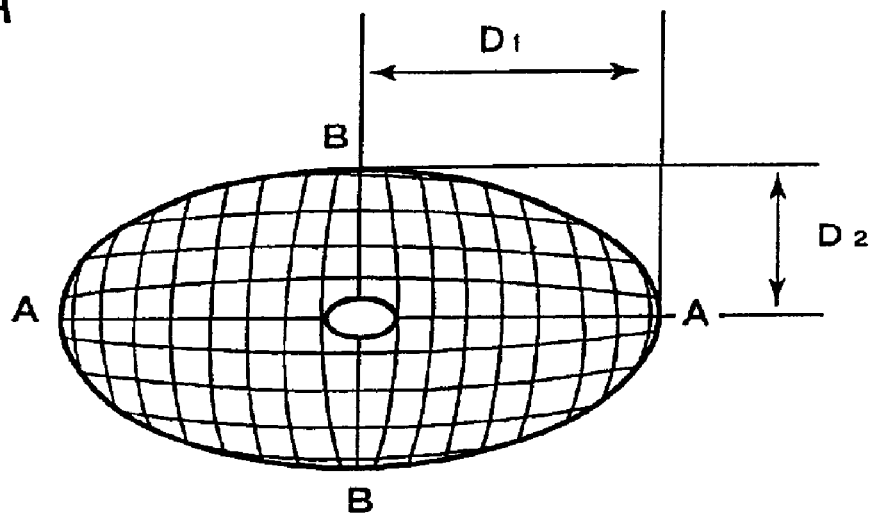
FIG. 4A schematically illustrates part of a face of still another golf club head according to the present invention.
Figure 4B:
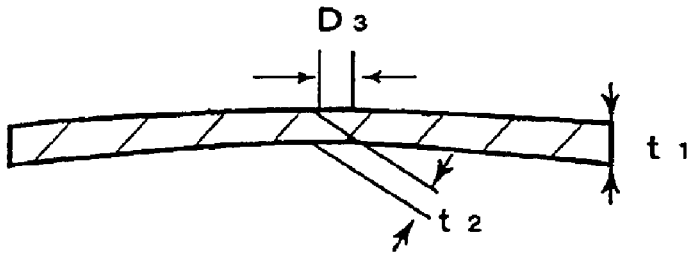
FIG. 4B is a sectional view taken along the line A—A in FIG. 4A.
Figure 4C:
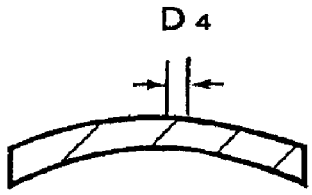
FIG. 4C is a sectional view taken along the line B—B in FIG. 4A.

In the model 3 shown in FIGS. 4A to 4C, the thickness t2 of the face center is set to 2.6 mm, and the thickness is gradually increased so that the thickness t1 of the periphery is 3 mm. Tables 2 to 4 show the thickness distributons of the models 1 to 3 respectively.

TABLE 2

| Major axis (mm) | Minor axis (mm) | Thickness (mm) |
|---|---|---|
| 10 | 5 | 3.0 |
| 15 | 7.5 | 2.9 |
| 20 | 10 | 2.8 |
| 25 | 12.5 | 2.7 |
| 40 | 20 | 2.6 |

TABLE 3

| Major axis (mm) | Minor axis (mm) | Thickness (mm) |
|---|---|---|
| 10 | 5 | 3.0 |
| 15 | 7.5 | 2.9 |
| 40 | 20 | 2.6 |

TABLE 4

| Major axis (mm) | Minor axis (mm) | Thickness (mm) |
|---|---|---|
| 5 | 2.5 | 2.6 |
| 7.5 | 5 | 2.7 |
| 10 | 7.5 | 2.8 |
| 12.5 | 10 | 2.9 |
| 40 | 20 | 3.0 |

Table 5 shows quantities of flexure (unit: mm) measured by applying loads to the points a, b and c of the models 1 to 3 along the major axes on positions of 0 mm along the minor axes.

TABLE 5

| Position of Load in Direction of Major axis | Model 1 | Model 2 | Model 3 |
|---|---|---|---|
| | | | unit (mm) |
| 0 mm Point a | 0.428 | 0.443 | 0.478 |
| 10 mm Point b | 0.296 | 0.307 | 0.338 |
| 20 mm Point c | 0.206 | 0.214 | 0.172 |

As shown in Table 5, the model 3 exhibiting a quantity of displacement of 0.478 mm at the face center is displaced only by 0.172 mm, i.e. 37% of the displacement at the face center, at the offset position of 20 mm. Consequently, the model 3 exhibits rather inferior bounce in an offset shot.

On the other hand, the models 1 and 2 having thicknesses reduced from the face centers toward the peripheries exhibit remarkably larger quantities of flexure of 0.428 mm and 0.443 mm at the face centers respectively as compared with a sample of the model 1 having a thickness of 3 mm shown in Table 1 with flexure of about 48%, i.e. about half the quantities of flexure at the face centers, at the offset positions of 20 mm. Therefore, bounce of this type of golf club head in an offset shot can be improved by reducing the thickness of the face from the face center toward the periphery.

Figure 5:
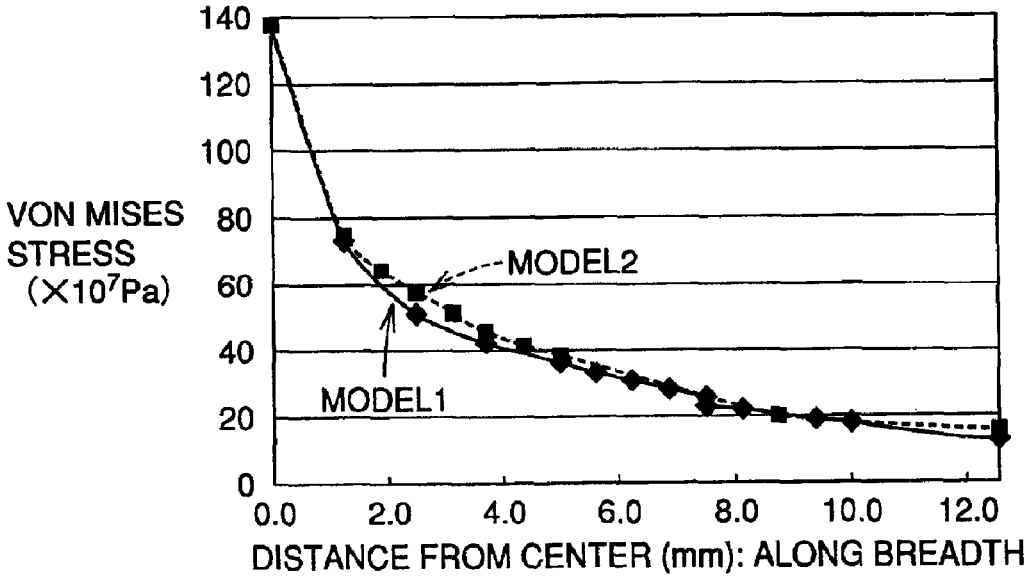
FIG. 5 illustrates the relation between distances from sweet spots and von Mises stress.

In the model 2 having the thickness abruptly changed from 3 mm to 2.6 mm, however, remarkable stress concentration is caused around the boundary between the portions having different thicknesses. FIG. 5 shows values of von Mises stress measured by applying a prescribed load (9800 N) to the positions of 0 mm along the major axes in the directions of the minor axes respectively.

It is understood from FIG. 5 that von Mises stress caused in the model 2 exceeds that caused in the model 1 by about 10% on the position of 3 to 5 mm along the minor axis. In other words, stress concentration is caused on the portion where the thickness is abruptly changed in the model 2.

Thus, it is understood from Table 5 that the models 1 and 2 are similar in bounce to each other while the model 2 is readily broken when hitting a golf ball due to insufficient strength. Therefore, it is also understood that the golf club head is effectively improved in bounce and hardly broken when the thickness thereof is not abruptly but gradually changed. When the thickness of the central portion covering a hitting point distribution is increased, the golf club head is improved in impact strength of the hitting portion and more hardly broken due to a rib effect.

Figure 6:
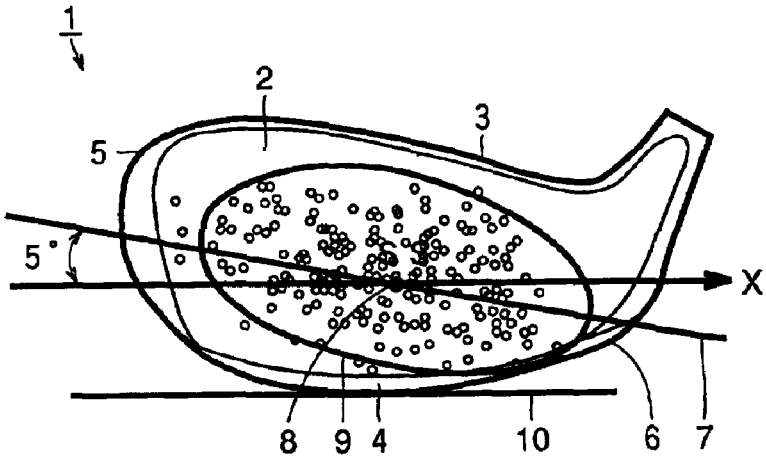
FIG. 6 illustrates a hitting point distribution of a general player in a face.

FIG. 6 illustrates a hitting point distribution of a general player with a driver. It is clearly understood from FIG. 6 that the general player makes a shot at various positions located above, under and on the right and left of the sweet spot SS. The player having acquired the data shown in FIG. 6 generally scores about 100. Referring to FIG. 6, white circles ○ show shot marks on a face 2 of a golf club head and a point • shows the central hitting point 8, while an ellipse 9 (hitting point distribution range) obtained by approximating the size and the shape of the hitting point distribution by obtaining a 95% confidence interval is shown by a solid line.

Further, thick solid lines show an X-axis passing through the central hitting point 8 of the face 2 in parallel with the tangential line between the face 2 and the ground 10 and the major axis 7 of the ellipse 9 obtained by approximating dispersion of the hitting points respectively.

It is understood from the result shown in FIG. 6 that the hitting points are distributed from an upper portion of a toe 5 toward a lower portion of a heel 6. When a position having high bounce is located on a lower portion of the toe 5 or an upper portion of the heel 6, therefore, the player cannot improve the carry of a golf ball.

Thus, a region (hereinafter referred to as "flexural range") of the face 2 flexed in excess of a prescribed quantity in a shot is matched with the hitting point distribution of the player. More specifically, a flexural range where the quantity of flexure in a direction perpendicular to the face 2 is at least 45% and not more than 95% (preferably at least 70% and not more than 95%, more preferably at least 90% and not more than 95%) of the maximum quantity of vertical flexure of the face 2 is provided and arranged in coincidence with the hitting point distribution range 9 of the player in the face 2. Thus, the player can reliably hit a golf ball in the flexural range also in an offset shot, thereby effectively suppressing reduction of the carry of the golf ball.

Alternatively, a flexural range having a spring constant of at least 2 kN/mm and not more than 4 kN/mm may be provided in the vicinity of the sweet spot of the face 2. Also when such a region having a small spring constant is provided in the vicinity of the sweet spot, the player can reliably make a shot with the region having a small spring constant for effectively suppressing reduction of the carry of the golf ball.

The spring constant is obtained by applying a vertical load to the face 2 for flexing the face 2 and dividing the vertical load by the current quantity of flexure.

Figure 81:
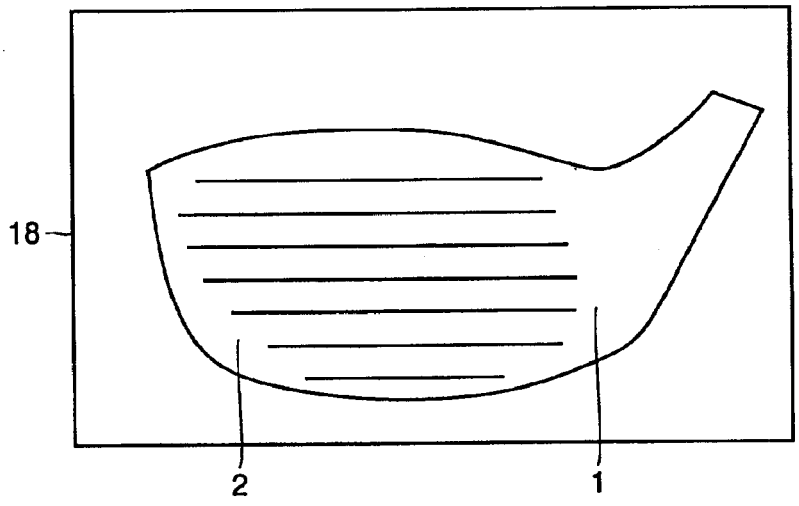
FIGS. 81 and 82 are diagrams for illustrating a method of measuring the quantity of flexure of a face.
Figure 82:
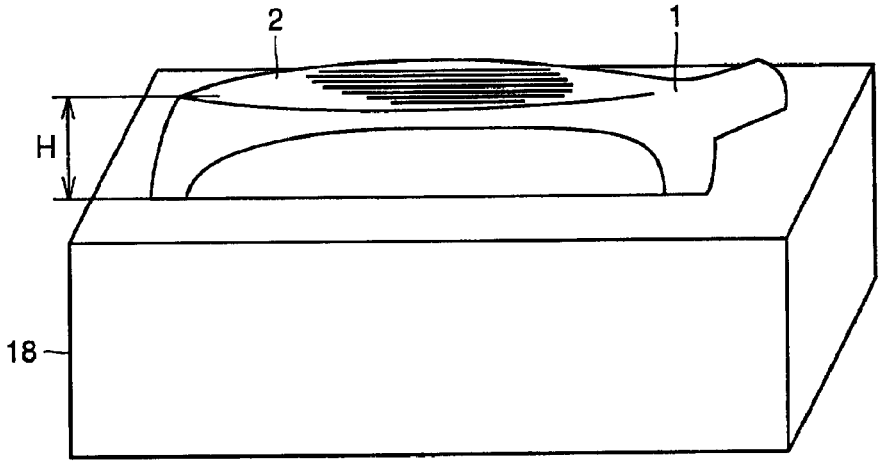

A method of measuring the spring constant is now described with reference to FIGS. 81 to 83. As shown in FIGS. 81 and 82, the face 2 of a golf club head 1 is set in parallel with the ground, and the head 1 is embedded in a base 18 of epoxy resin so that the central portion of the face 2 projects from the upper surface of the base 18 by a height H (5 to 40 mm).

Figure 83:
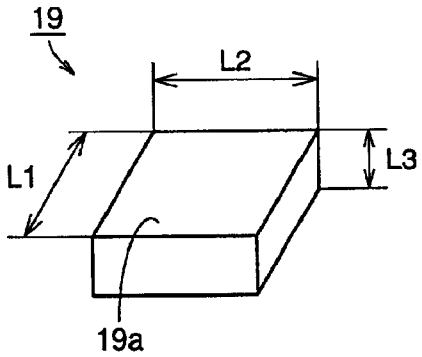
FIG. 83 is a perspective view showing an indenter employed for measuring the quantity of flexure of the face.

Thereafter an indenter 19 of a tungsten alloy in the form of a rectangular parallelepiped shown in FIG. 83 is placed on the central portion of the face 2 and pressed against the face 2 with a vertical load applied by a compression tester for flexing the face 2. The indenter 19 has lengths L1, L2 and L3 of 25 mm, 30 mm and 15 mm respectively. A pressing surface 19*a* of the indenter 19 is pressed against the face 2.

In an actual experiment of this method, a vertical load of 5 kN was applied to the face 2 for calculating the spring constant by measuring the current quantity of vertical flexure and dividing the vertical load by the quantity of vertical flexure. The load point was displaced from the central portion of the face 2 for calculating spring constants in portions located around the central portion. Also as to conventional examples, spring constants were calculated by a similar method. Table 6 shows the results.

TABLE 6

| | SS | Toe Side | Heel Side | Upper Side | Lower Side |
|---|---|---|---|---|---|
| | | | | | unit (kN/mm) |
| Inventive Sample | 3.6 | 2.8 | 3.6 | 4.0 | 3.8 |
| Conventional Sample 1 | 6.9 | 6.0 | 6.5 | 10.0 | 7.1 |
| Conventional Sample 2 | 7.3 | 7.2 | 8.2 | 8.2 | 8.0 |
| Conventional Sample 3 | 5.6 | 4.2 | 5.4 | 5.4 | 5.8 |
| Conventional Sample 4 | 73 | 6.5 | 7.8 | 7.8 | 7.2 |

TABLE 6-continued

| | SS | Toe Side | Heel Side | Upper Side | unit (kN/mm) Lower Side |
|---|---|---|---|---|---|
| Conventional Sample 5 | 6.9 | 5.8 | 7.1 | 7.1 | 6.6 |
| Conventional Sample 6 | 6.7 | 6.3 | 6.3 | 6.3 | 5.7 |
| Conventional Sample 7 | 6.5 | 5.9 | 6.8 | 6.8 | 8.2 |
| Conventional Sample 8 | 8.5 | 6.5 | 8.3 | 8.3 | 9.1 |
| Conventional Sample 9 | 7.5 | 5.1 | 7.6 | 7.6 | 7.0 |

Referring to Table 6, the column "SS" shows values obtained by applying the load to the sweet spot, the column "toe side" shows values obtained by displacing the indenter 19 from the sweet spot toward the toe 5 by 10 mm, the column "heel side" shows values obtained by displacing the indenter 19 from the sweet spot toward the heel 6 by 10 mm, the column "upper side" shows values obtained by displacing the indenter 19 from the sweet spot toward a crown 3 (upper side) by 10 mm, and the column "lower side" shows values obtained by displacing the indenter 19 from the sweet spot toward a sole 4 (lower side) by 10 mm.

It is understood from Table 6 that the spring constants are reduced in the inventive sample as compared with the conventional samples not only in the sweet spot but also in the peripheral regions. More specifically, the spring constants are in the range of at least 2 kN/mm and not more than 4 kN/mm in the inventive sample. Thus, restitution coefficients can be increased in the sweet spot and the peripheral regions (flexural range) in the inventive sample as compared with the comparative samples, so that reduction of the carry of a golf ball can be suppressed also in an offset shot.

It was inferably possible to measure the spring constants in the region within a radius of 10 mm to 20 mm from the sweet spot by displacing the indenter 19 by 10 mm upward, downward, rightward and leftward from the sweet spot since the pressing surface 19*a* of the indenter 19 shown in FIG. 83 was pressed against the face 2 in the aforementioned experiment.

Therefore, the area of the flexural range having the aforementioned spring constant is at least 75 $mm^2$ and not more than 1260 $mm^2$, preferably at least 75 $mm^2$ and not more than 707 $mm^2$, and more preferably at least 75 $mm^2$ and not more than 314 $mm^2$. Further, the area of the flexural range is preferably at least 3% and not more than 50% of the area of the face 2, and more preferably at least 5% and not more than 30% of the area of the face 2.

The aforementioned spring constant is preferably at least 2 kN/mm and not more than 3.5 kN/mm, and more preferably at least 2 kN/mm and not more than 3.0 kN/mm.

Referring again to FIG. 6, the hitting point distribution of the general player has an elliptic shape about the central hitting point 8, and the major axis 7 thereof is inclined toward the upper portion of the toe 5. The angle of the major axis 7 of the ellipse (hitting point distribution range) 9 obtained by approximating dispersion of the hitting points is 5° with respect to the X axis as shown in FIG. 6, and hence inclination of the flexural range with respect to the X-axis is preferably at least 0° and not more than 40°.

The aspect ratio of the ellipse 9 is 1.3, and hence the aspect ratio of the flexural range is preferably 1 to 4. Further, the center of the ellipse 9 separates by 2 mm from the sweet spot, and hence the distance between the center of the flexural range and the sweet spot is preferably 0 to 5 mm.

The area of a hitting point distribution of a low handicapper is about 150 $mm^2$ and that of a hitting point distribution of the general player is 1500 $mm^2$, and hence the area of the flexural range is preferably 150 to 1500 $mm^2$.

The length of the portion (hereinafter referred to as "tapered part") where the thickness is gradually reduced from the central portion of the face 2 having a uniform thickness toward the periphery is preferably at least 3 mm, and more preferably at least 5 mm.

The distance between the center of the aforementioned flexural range and the outer periphery of the face 2 varies with the outline of the face 2. The face 2 is readily deformed, i.e. readily flexed by hitting force when this distance is increased, while the face 2 is hardly deformed, i.e. hardly flexed when the distance is reduced. This is material-dynamically obvious.

In order to substantially uniformalize the quantity of flexure in the flexural range, therefore, the ratio of reduction of the thickness of the face 2 must be reduced as the distance between the center of the flexural range and the outer periphery of the face 2 is increased, and the ratio of reduction of the thickness of the face 2 must be increased as this distance is reduced.

It is costly to vary the overall thickness of the face 2. Therefore, the region between the outer periphery of the flexural range and the outer periphery of the face is divided into a plurality of peripheral regions, which in turn are varied in thickness.

For example, the aforementioned region is divided into four peripheral regions including an upper region, a lower region, a toe-side region and a heel-side region, and the thickness of the upper region is reduced beyond the thickness of the lower region as well as the thickness of the flexural range when the center of the flexural range is located on an upper portion of the face 2. Thus, the quantity of flexure in the flexural range can be substantially uniformalized.

The aforementioned region may not necessarily be divided into four peripheral regions but may be divided into two, three or at least five peripheral regions.

When the maximum height of the face 2 from the sole 4 is present on the side of the toe 5, for example, the thickness of the toe-side region closer to the toe 5 is rendered larger than the thickness of the heel-side region closer to the heel 6 and smaller than the thickness of the flexural range. When the maximum height of the face 2 from the sole 4 is present on the side of the heel 6 to the contrary, the thickness of the heel-side region closer to the heel 6 is rendered larger than the thickness of the toe-side region closer to the toe 5 and smaller than the thickness of the flexural range. Also in this case, the quantity of flexure of the face 2 can be uniformalized within the flexural range.

A tapered part of at least 3 mm and not more than 5 mm in width is formed on the boundary between the region having a larger thickness and the region having a smaller thickness, so that stress concentration can be prevented.

Exemplary modes of the face 2 according to the present invention are now described with reference to FIGS. 7 to 80. In each of the following examples, a center part 12 defines a flexural range.

A case of applying the present invention to a wood golf club head of a metal having a hollow shell structure is described with reference to FIGS. 7 to 50. Each of FIGS. 7 to 50 shows only a head 1 of a golf club, with no illustration of a shaft and a grip.

The body of the head 1 has a face 2, a sole 4 and a crown 3 prepared by forging a β-titanium alloy (Ti-15V-3Cr-3Sn-3Al) and a neck of pure titanium.

Alternatively, the head 1 of the golf club may be prepared from a single material such as an iron- or stainless-based material generally employed for a golf club head such as austenite-based SUS301, SUS303, SUS304, SUS304N1, SUS304N2, SUS305, SUS309S, SUS310S, SUS316, SUS317, SUS321, SUS347 or XM7, martensite-based SUS410, SUS420, SUS431 or SUS440, precipitation-hardened SUS630 or ferrite-based SUS405, SUS430 or SUS444, soft steel such as S15C, S20C, S25C, S30C or S35C, special steel such as high tension steel, very high tension steel, ausforming steel, maraging steel or spring steel, a titanium alloy such as pure titanium I, II, III or IV, an α-alloy 5Al-2.5V, an α-β alloy 3Al-2.5V, 6Al-4V or 4.5Al-3V-2Fe-2Mo or a β-alloy 15V-3Cr-3Sn-3Al, 10V-2Fe-3Al, 13V-11Cr-3Al, 15Mo-5Zr, 15V-6Cr-4Al, 15Mo-5Zr-3Al, 20V-4Al-1Sn, 22V-4Al or 3Al-8V-6Cr-4Mo-3Zr, an aluminum-based material such as pure aluminum, 2017, 2024, 7075, 3003, 5052, 5056, 6151, 6053 or 6061 (Aluminum Association standard), a magnesium-based material such as AZ63A, AZ81A, AZ91A, AZ91C, WE54 or EZ33A, a clad material such as a clad sheet of combination of any of the aforementioned materials, tungsten, copper, nickel, zirconium, cobalt, manganese, zinc, silicon, tin, chromium, FRP, synthetic resin, ceramic or rubber or combination of at least two materials selected from the above materials.

The golf club head can be manufactured by precision casting with high dimensional accuracy at a low cost. Alternatively, the body of the head 1 can be manufactured by die casting, pressing or forging. Further alternatively, the golf club head can be prepared by manufacturing the respective parts by pressing, forging, precision casting, metal injection, die casting, cutting or powder metallurgy and connecting the manufactured parts to each other by welding, bonding, press fitting, engaging, pressure contact, screwing or brazing. The aforementioned materials and manufacturing methods are also applicable to an iron golf club head described later.

Figure 7:
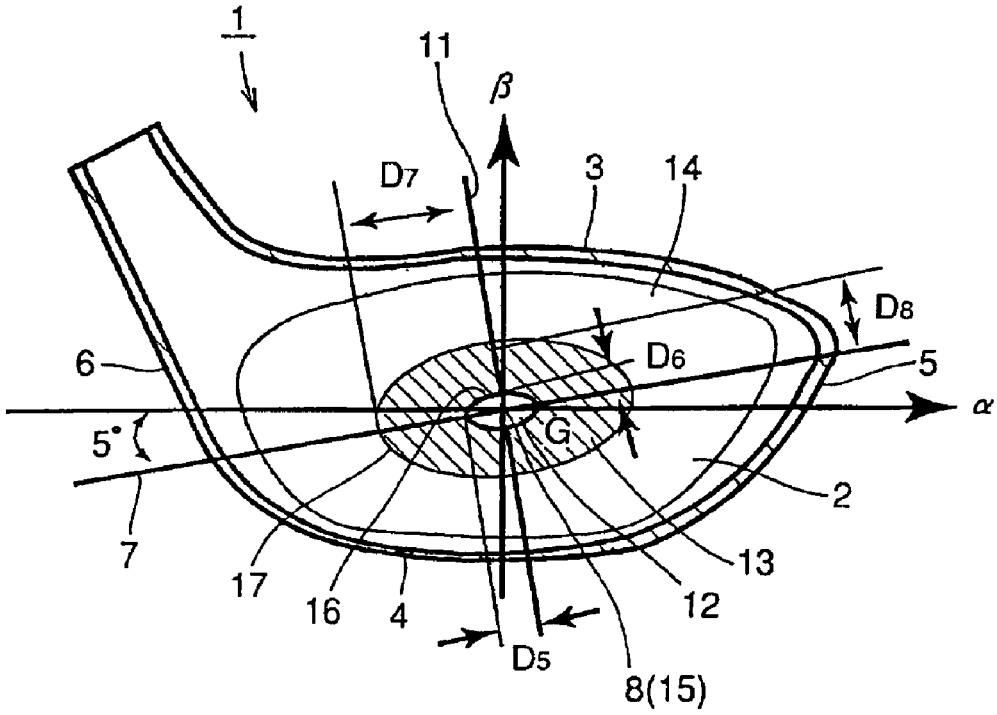
FIG. 7 is a sectional view showing the rear surface of a face of an exemplary wood golf club head of a metal according to the present invention.

Referring to FIG. 7, the head 1 has an elliptic flexural range and a sweet spot 15 matched with the center (central hitting point) 8 of ellipses 16 and 17. The flexural range is the region enclosed with the ellipse 16. The shape and the size of the flexural range are arbitrarily selectable so far as the flexural range includes at least the ellipse 16. This also applies to the remaining examples.

A center part 12 defined by the ellipse 16 has a thickness of 3.0 mm, and the ellipse 16 has a major axis D5 of 10 mm and a minor axis D6 of 5 mm. The major axis of the ellipse 16 extends from a lower portion of a heel 6 toward an upper portion of a toe 5, and is inclined by 5° with respect to the X-axis. The aspect ratio of this ellipse 16 is 2.3.

The thickness of a tapered part 13 defined by the ellipse 17 is gradually reduced toward the periphery thereof. The ellipse 17 has a major axis D7 of 30 mm and a minor axis D8 of 15 mm.

The thickness of a peripheral region 14 located around the ellipse 17 is 2.6 mm. Alternatively, the thickness of the peripheral region 14 may be gradually reduced toward the outer periphery of the face 2. In this case, the ratio of reduction of the thickness of the peripheral region 14 may exceed the ratio of reduction of the thickness of the tapered part 13. Referring to FIG. 7, numeral 11 denotes the minor axes of the ellipses 16 and 17.

Figure 8:
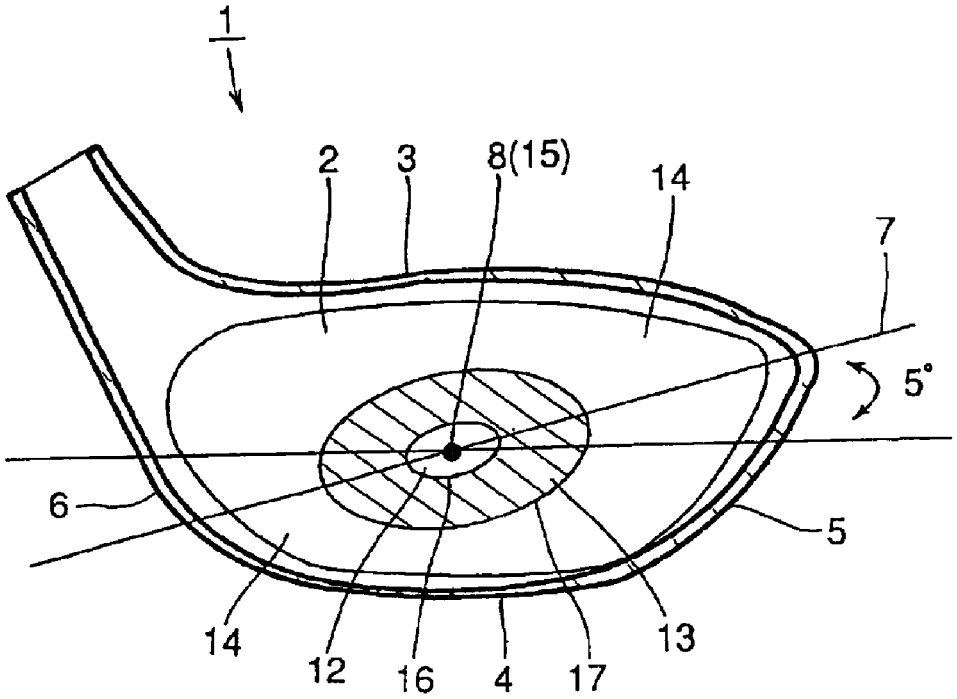
FIG. 8 is a sectional view showing the rear surface of a face of another exemplary wood golf club head of a metal according to the present invention.

FIG. 8 shows the structure of a number 1 wood according to the present invention. Also in this example, a head 1 of the wood has an elliptic flexural range and a sweet spot 15 matched with the center (central hitting point) 8 of ellipses 16 and 17.

The major axes 7 of the ellipses 16 and 17 are inclined by 5° with respect to an X-axis. The ellipse 16 has a major axis of 10 mm and a minor axis of 5 mm (area: 157 $mm^2$), and a center part 12 has a thickness of 2.4 mm.

The ellipse 17 has a major axis of 25 mm and a minor axis of 15 mm. The thickness of a peripheral region 14 located around the ellipse 17 is 2.1 mm. The thickness of a tapered part 13 is gradually reduced toward the peripheral portion thereof. Table 7 shows an exemplary thickness distribution of a face 2 in the example shown in FIG. 8.

TABLE 7

| Position of Major axis of Central Ellipse (mm) | Position of Minor axis of Central Ellipse (mm) | Thickness |
|---|---|---|
| 0–10 | 0–5 | 2.4 mm |
| 10–15 | 5–10 | Tapered 0.3/5 |
| 15–to Periphery | 10–to Periphery | 2.1 mm |

Table 8 shows restitution coefficients of the inventive golf club head and a conventional golf club head.

TABLE 8

| | Restitution Coefficient at Center Shot Position of 0 mm | Restitution Coefficient at Offset Shot Position of 10 mm | Restitution Coefficient at Offset Shot Position of 20 mm |
|---|---|---|---|
| Conventional Golf Club Head | 0.815 | 0.802 | 0.785 |
| Inventive Golf Club Head | 0.815 | 0.809 | 0.801 |

As shown in Table 8, the inventive golf club head has a higher restitution coefficient than the conventional golf club head in an offset shot. In other words, the inventive golf club head can suppress reduction of the carry of a golf ball in an offset shot.

As shown in Table 8, the inventive golf club head has the same restitution coefficient as the conventional golf club head at the face center. Therefore, the inventive golf club head can ensure a carry of a golf ball equivalently to the conventional golf club head also in a face center shot. The thickness of the face 2 is gradually reduced, whereby a wood golf club head having excellent endurance can be obtained with a hardly broken face 2.

Figure 9:
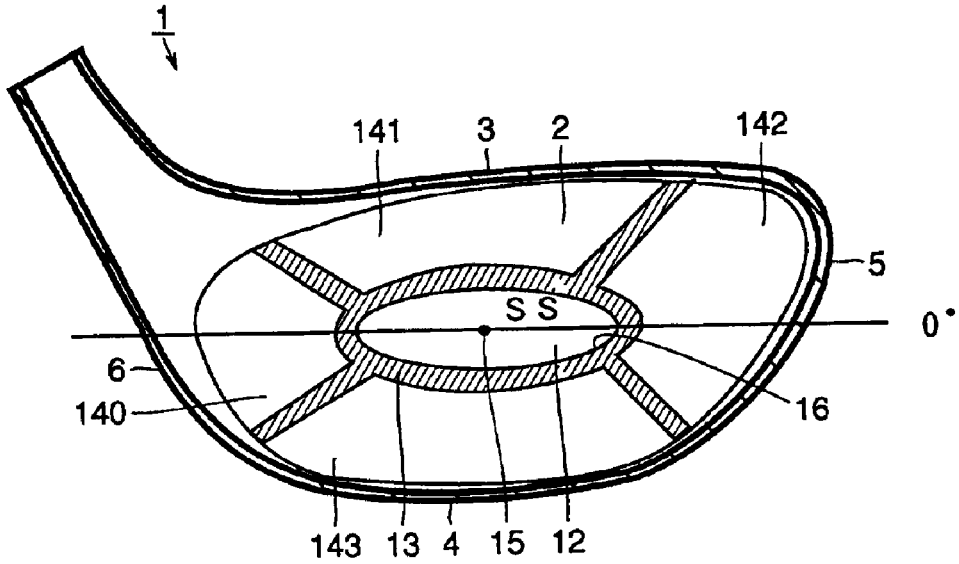
FIGS. 9 to 19 and FIGS. 21 to 50 are sectional views showing the rear surfaces of faces of further exemplary wood golf club heads of metals according to the present invention.

FIG. 9 shows a wood driver having a sweet spot 15 located substantially at the center of a face 2, which has the maximum height from a sole 4 on the side of a toe 5 (the face 2 has the maximum width on the side of the toe 5).

In this case, four peripheral regions 140, 141, 142 and 143 are provided around a center part 12, as shown in FIG. 9. A tapered part 13 separates the peripheral regions 140, 141, 142 and 143 from each other. The center part 12 has a thickness tc larger than the thicknesses t1, t2, t3 and t4 of the peripheral regions 140, 141, 142 and 143.

The thickness t1 of the peripheral region 140 is equal to the thickness t3 of the peripheral region 142, while the thickness t2 of the peripheral region 141 is equal to the thickness t4 of the peripheral region 143. More specifically, the thickness tc of the center part 12 is 2.4 mm, the thicknesses t1 and t3 of the peripheral regions 140 and 142 are 2.2 mm, and the thicknesses t2 and t4 of the peripheral regions 141 and 143 are 2.1 mm, for example.

Figure 10:
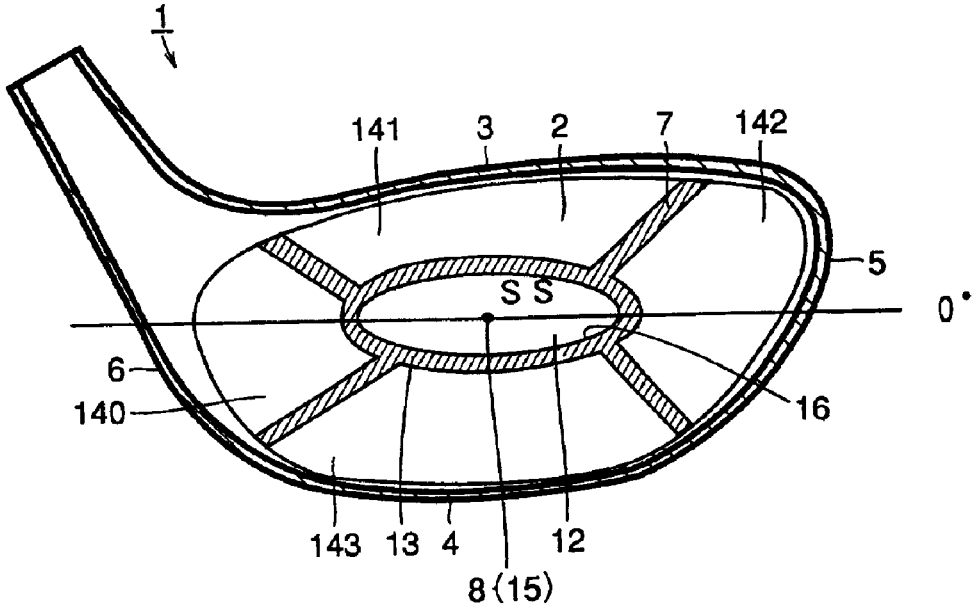

FIG. 10 shows a wood driver having a sweet spot 15 located above the central portion of a face 2, which has the maximum height from a sole 4 on the side of a toe 5.

Also in this case, four peripheral regions 140, 141, 142 and 143 are provided around a center part 12, which has a thickness tc larger than the thicknesses t1, t2, t3 and t4 of the peripheral regions 140, 141, 142 and 143 as shown in FIG. 10.

The thicknesses tc, t1, t2, t3 and t4 are in the relation t1<t3<tc and t2<t4<tc. More specifically, the thicknesses tc, t1, t2, t3 and t4 can be 3.0 mm, 2.7 mm, 2.6 mm, 2.8 mm and 2.8 mm respectively, for example.

Figure 11:
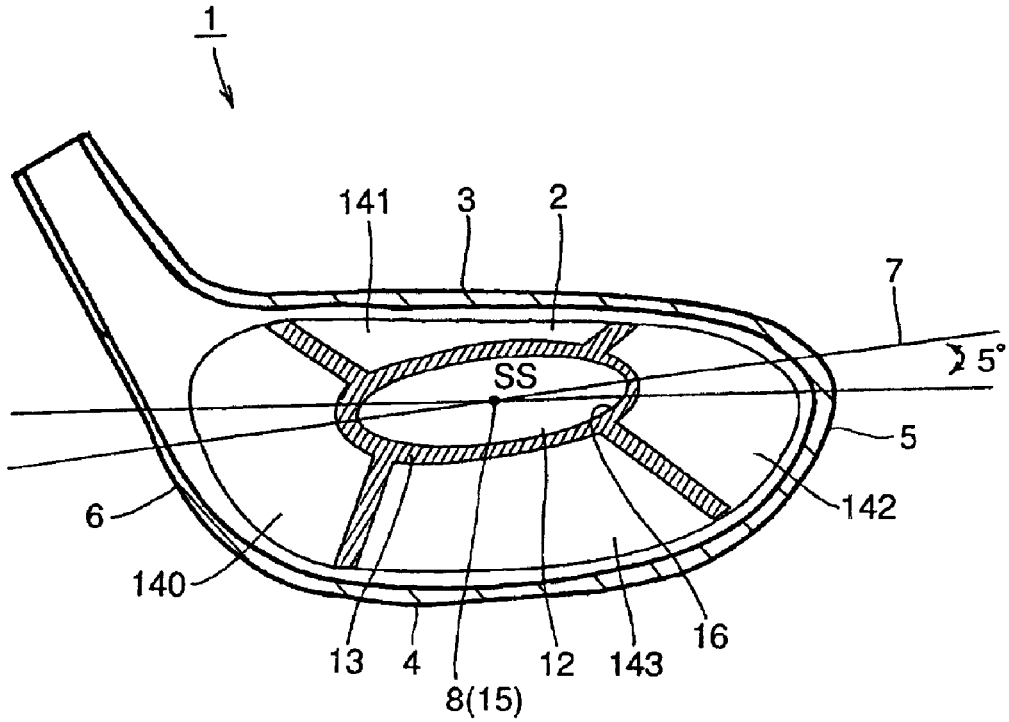

FIG. 11 shows a wood driver having a sweet spot 15 located above the central portion of a face 2, which has a larger height from a sole 4 on the side of a heel 6 than on the side of a toe 5.

Also in this case, four peripheral regions 140, 141, 142 and 143 are provided around a center part 12, which has a thickness tc larger than the thicknesses t1, t2, t3 and t4 of the peripheral regions 140, 141, 142 and 143 as shown in FIG. 11.

The thicknesses tc, t1, t2, t3 and t4 are in the relation t3=t1<tc and t2<t4<tc. More specifically, the thicknesses tc, t1, t2, t3 and t4 can be 3.0 mm, 2.9 mm, 2.6 mm, 2.7 mm and 2.8 mm respectively, for example.

Figure 12:
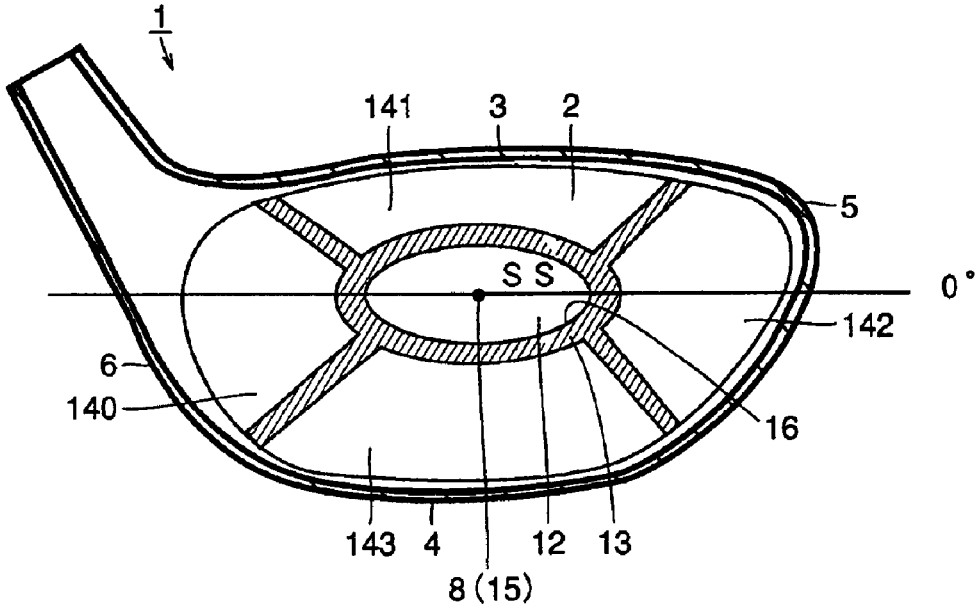

FIG. 12 shows a wood driver having a sweet spot 15 located above the central portion of a face 2, which has the maximum height from a sole 4 around the face center.

Also in this case, four peripheral regions 140, 141, 142 and 143 are provided around a center part 12, which has a thickness tc larger than the thicknesses t1, t2, t3 and t4 of the peripheral regions 140, 141, 142 and 143 as shown in FIG. 12.

The thicknesses tc, t1, t2, t3 and t4 are in the relation t1<t3<tc and t2<t4<tc. More specifically, the thicknesses tc, t1, t2, t3 and t4 can be 2.8 mm, 2.6 mm, 2.5 mm, 2.6 mm and 2.7 mm respectively, for example.

Figure 13:
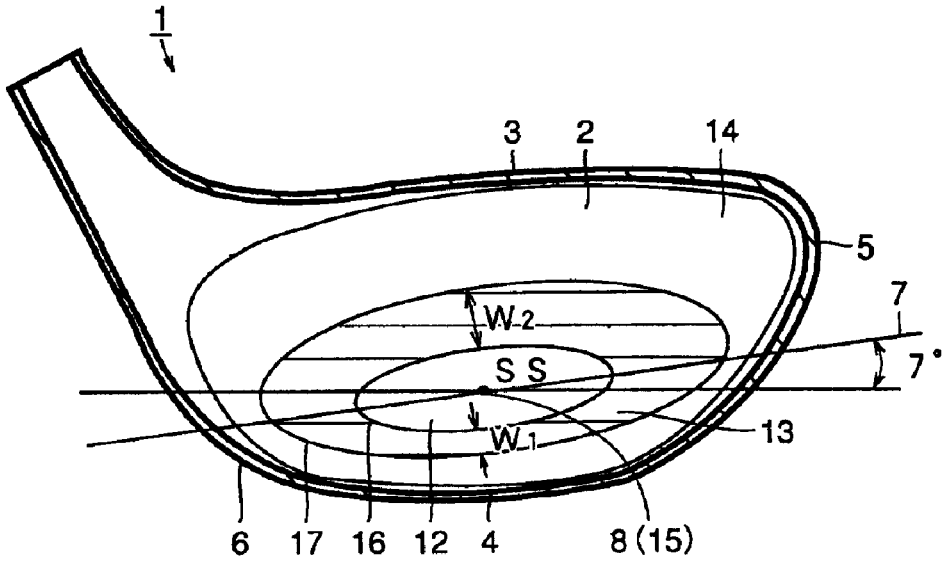

FIG. 13 shows a wood driver having a sweet spot 15 located under the central portion of a face 2.

In this case, a peripheral region 14 is provided around a center part 12, which has a thickness tc larger than the thickness tp of the peripheral region 14 as shown in FIG. 13. The width W2 of a portion of a tapered part 13 located above the center part 12 is larger than the width W1 of a portion located under the center part 12.

The ratio of reduction of the thickness of the tapered part 13 in the portion having the width W2 is smaller than the ratio of reduction of the thickness of the tapered part 13 in the portion having the width W1. In other words, the ratio of reduction of the thickness of the tapered part 13 varies with the distance between the sweet spot (the center of a flexural range) 15 and the outer periphery of the face 2.

More specifically, the aforementioned thicknesses tc and tp can be 3.0 mm and 2.6 mm respectively. The thickness of the tapered part 13 can be reduced in the ratio of 0.1 mm/1.0 mm (reduced by 0.1 mm per 1 mm) in the portion having the width W2 and in the ratio of 0.2 mm/1.0 mm in the portion having the width W1.

Figure 14:
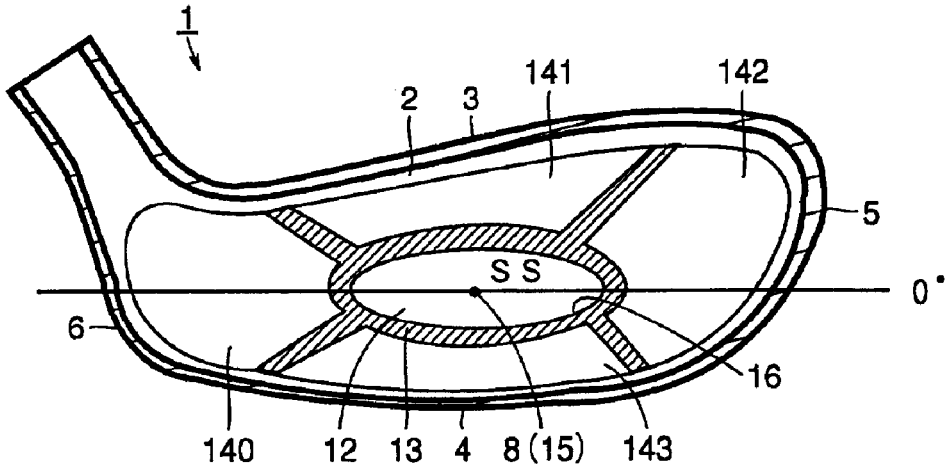

FIG. 14 shows a fairway wood having a sweet spot 15 located on the central portion of a face 2, which has the maximum height from a sole 4 on the side of a toe 5.

In this case, four peripheral regions 140, 141, 142 and 143 are provided around a center part 12, which has a thickness tc larger than the thicknesses t1, t2, t3 and t4 of the peripheral regions 140, 141, 142 and 143 as shown in FIG. 14.

The thicknesses tc, t1, t2, t3 and t4 are in the relation t1<t3<tc and t2=t4<tc. More specifically, the thicknesses tc, t1, t2, t3 and t4 can be 2.4 mm, 2.1 mm, 2.1 mm, 2.2 mm and 2.1 mm respectively, for example.

Figure 15:
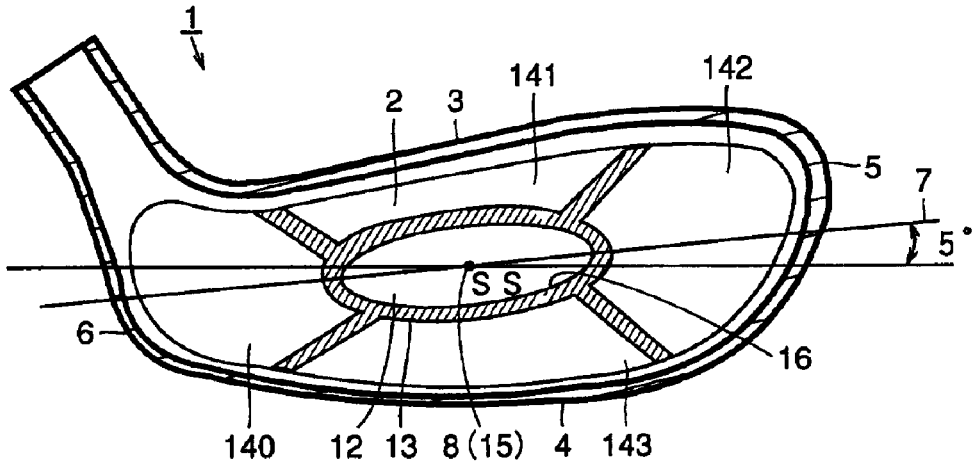

FIG. 15 shows a fairway wood having a sweet spot 15 located above the central portion of a face 2, which has the maximum height from a sole 4 on the side of a toe 5.

Also in this case, four peripheral regions 140, 141, 142 and 143 are provided around a center part 12, which has a thickness tc larger than the thicknesses t1, t2, t3 and t4 of the peripheral regions 140, 141, 142 and 143 as shown in FIG. 15.

The thicknesses tc, t1, t2, t3 and t4 are in the relation t1<t3<tc and t2<t4<tc. More specifically, the thicknesses tc, t1, t2, t3 and t4 can be 3.0 mm, 2.7 mm, 2.6 mm, 2.8 mm and 2.8 mm respectively, for example.

Figure 16:
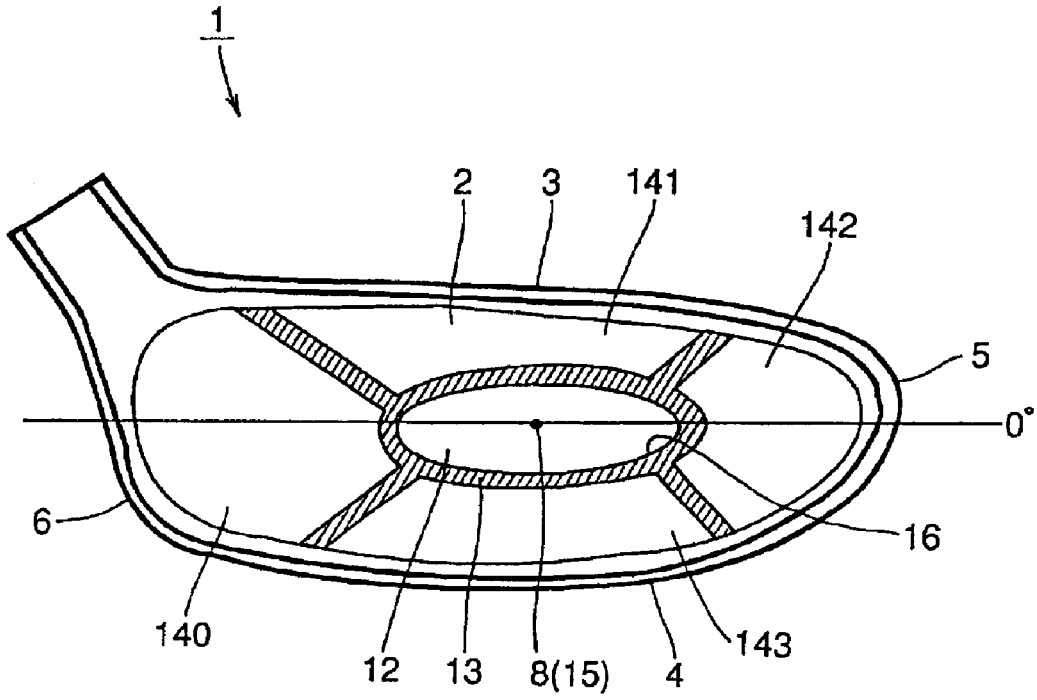

FIG. 16 shows a fairway wood having a sweet spot 15 located above the central portion of a face 2, which has a larger height from a sole 4 on the side of a heel 6 than on the side of a toe 5.

Also in this case, four peripheral regions 140, 141, 142 and 143 are provided around a center part 12, which has a thickness tc larger than the thicknesses t1, t2, t3 and t4 of the peripheral regions 140, 141, 142 and 143 as shown in FIG. 16.

The thicknesses tc, t1, t2, t3 and t4 are in the relation t3<t1<tc and t2<t4<tc. More specifically, the thicknesses tc, t1, t2, t3 and t4 can be 3.0 mm, 2.9 mm, 2.6 mm, 2.7 mm and 2.8 mm respectively, for example.

Figure 17:
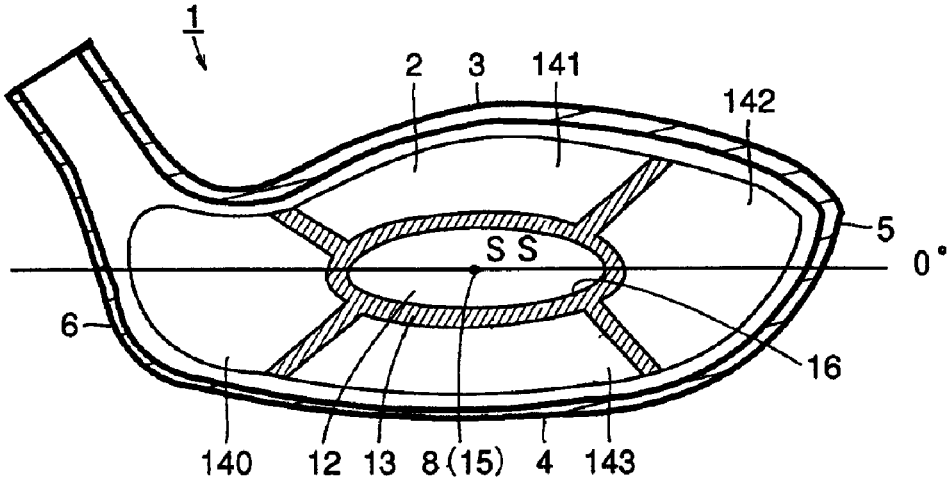

FIG. 17 shows a fairway wood having a sweet spot 15 located above the central portion of a face 2, which has the maximum height from a sole 4 around a face center.

Also in this case, four peripheral regions 140, 141, 142 and 143 are provided around a center part 12, which has a thickness tc larger than the thicknesses t1, t2, t3 and t4 of the peripheral regions 140, 141, 142 and 143 as shown in FIG. 17.

The thicknesses tc, t1, t2, t3 and t4 are in the relation t3=t1<tc and t2<t4<tc. More specifically, the thicknesses tc, t1, t2, t3 and t4 can be 2.8 mm, 2.6 mm, 2.5 mm, 2.6 mm and 2.7 mm respectively, for example.

Figure 18:
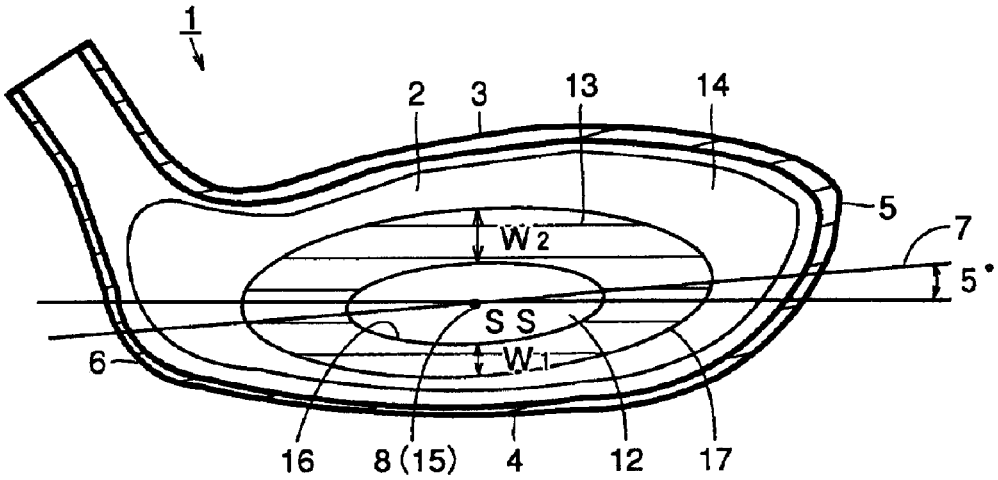

FIG. 18 shows a fairway wood having a sweet spot 15 located under the central portion of a face 2.

In this case, a peripheral region 14 is provided around a center part 12, which has a thickness tc larger than the thickness tp of the peripheral region 14, as shown in FIG. 18. The width W2 of a portion of a tapered part 13 located above the center part 12 is larger than the width W1 of a portion located under the center part 12.

The ratio of reduction of the thickness of the tapered part 13 in the portion having the width W2 is smaller than the ratio of reduction of the thickness of the tapered part 13 in the portion having the width W1.

More specifically, the aforementioned thicknesses tc and tp can be 3.0 mm and 2.6 mm respectively. The thickness of the tapered part 13 can be reduced in the ratio of 0.1 mm/1.0 mm in the portion having the width W2 and in the ratio of 0.2 mm/1.0 mm in the portion having the width W1.

Figure 19:
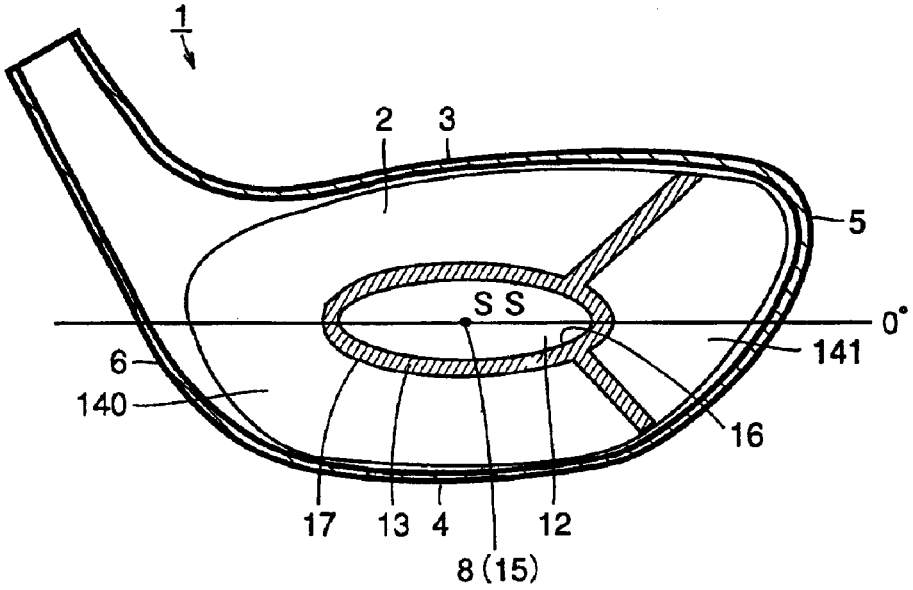
Figure 20:
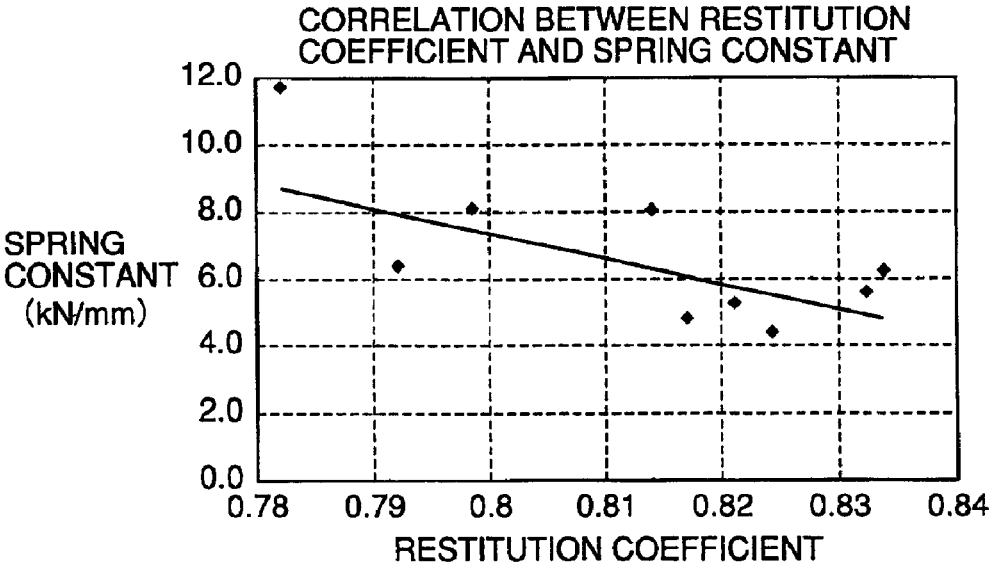
FIG. 20 illustrates the relation between spring constants and restitution coefficients.

FIG. 19 shows a wood driver having a sweet spot 15 located on the central portion of a face 2, which has the maximum height from a sole 4 on the side of a toe 5.

In this case, two peripheral regions 140 and 141 are provided around a center part 12, which has a thickness tc larger than the thicknesses t1 and t2 of the peripheral regions 140 and 141 as shown in FIG. 19.

The thicknesses tc, t1 and t2 are in the relation t1<t2<tc. More specifically, the thicknesses tc, t1 and t2 can be 3.0 mm, 2.6 mm an 2.8 mm, for example.

Figure 21:
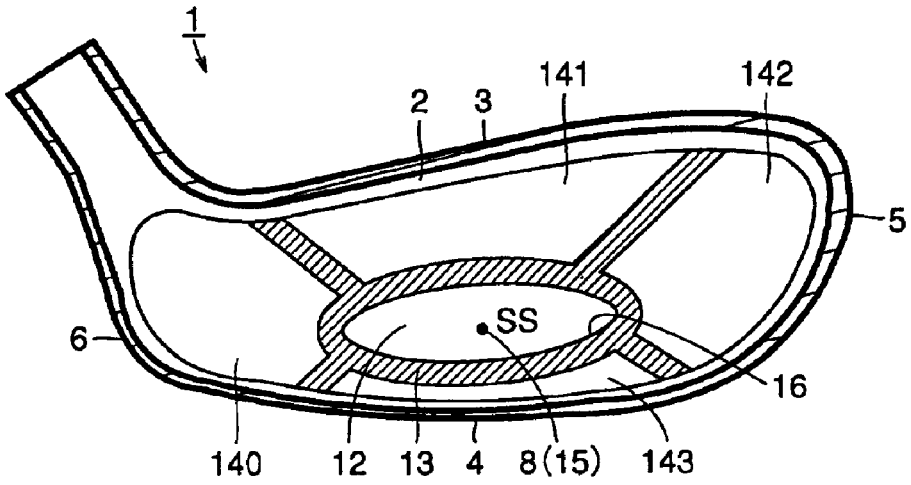

FIG. 21 shows a fairway wood having a sweet spot 15 located under the central portion of a face 2, which has the maximum height from a sole 4 on the side of a toe 5.

In this case, four peripheral regions 140, 141, 142 and 143 are provided around a center part 12, which has a thickness tc larger than the thicknesses t1, t2, t3 and t4 of the peripheral regions 140, 141, 142 and 143 as shown in FIG. 21.

The thicknesses tc, t1, t2, t3 and t4 are in the relation t1<t3<tc and t4<t2<tc. More specifically, the thicknesses tc, t1, t2, t3 and t4 can be 2.8 mm, 2.5 mm, 2.6 mm, 2.7 mm and 2.4 mm respectively, for example.

Figure 22:
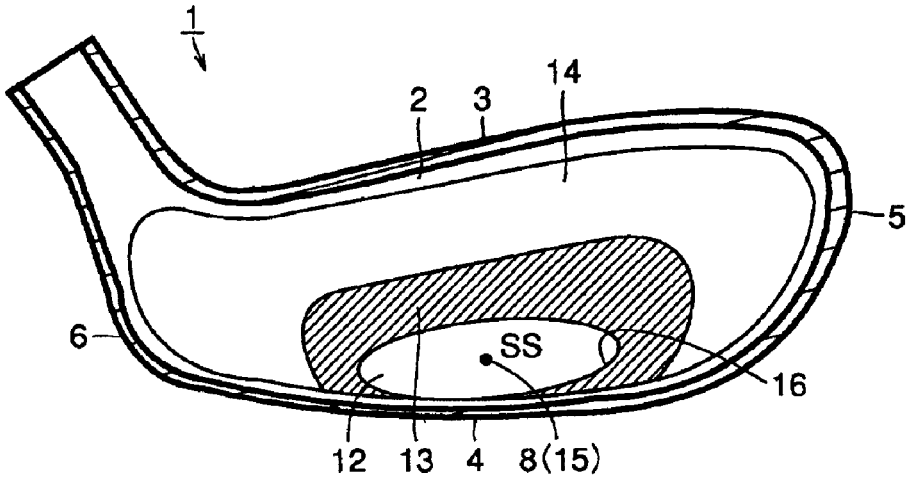

FIG. 22 shows a fairway wood having a sweet spot 15 located considerably under the central portion of a face 2, which has the maximum height from a sole 4 on the side of a toe 5.

In this case, a center part 12 reaches a portion close to the sole 4 while a peripheral region 14 is provided around the center part 12, as shown in FIG. 22. The thickness tc of the center part 12 is larger than the thickness tp of the peripheral region 14.

The ratio of reduction of the thickness of a tapered part 13 varies with the distance between the sweet spot 15 and the outer periphery of the face 2, similarly to the case shown in FIG. 13. More specifically, the thicknesses tc and tp can be 2.6 mm and 2.2 mm respectively, for example. The thickness of the tapered part 13 is reduced by a method similar to that in the case shown in FIG. 13.

Figure 23:
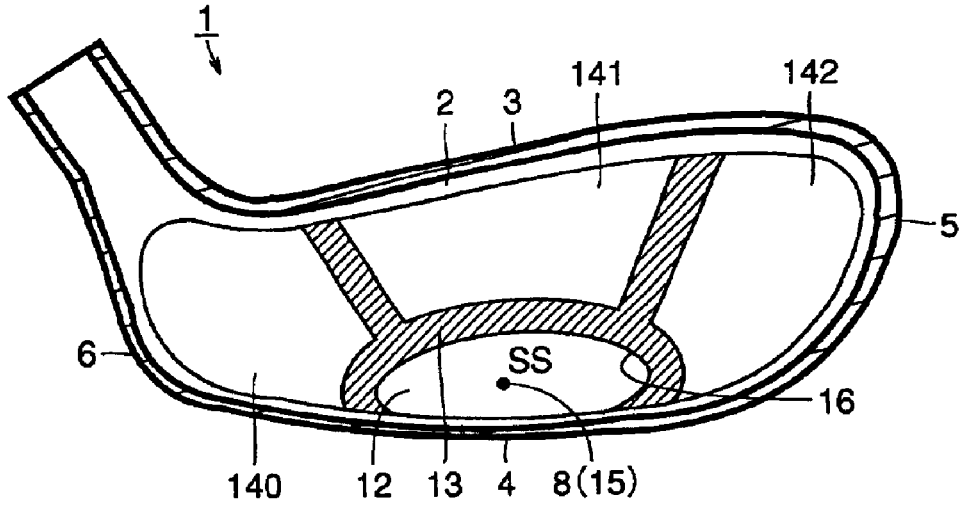

FIG. 23 shows a fairway wood having a sweet spot 15 located considerably under the central portion of a face 2, which has the maximum height from a sole 4 on the side of a toe 5.

In this case, three peripheral regions 140, 141 and 142 are provided around a center part 12, which may have a thickness tc larger than the thicknesses t1, t2 and t3 of the peripheral regions 140, 141 and 142 as shown in FIG. 23.

The thicknesses tc, t1 and t3 are in the relation t1<t3<tc. More specifically, the thicknesses tc, t1, t2 and t3 can be 2.8 mm, 2.4 mm, 2.5 mm and 2.6 mm respectively, for example.

Figure 24:
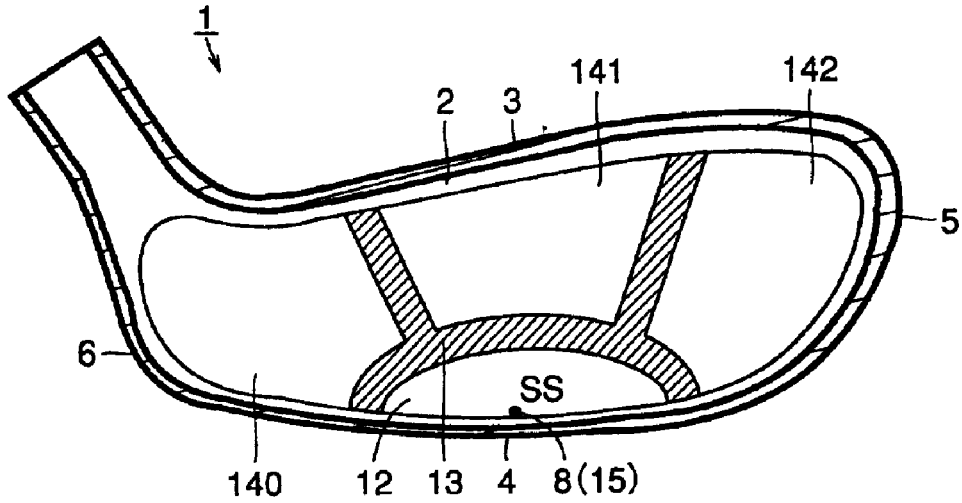

FIG. 24 shows a fairway wood having a sweet spot 15 located in the vicinity of a sole 4 and a face 2 having the maximum height from the sole 4 on the side of a toe 5.

Also in this case, three peripheral regions 140, 141 and 142 are provided around a center part 12, which has a thickness tc larger than the thicknesses t1, t2 and t3 of the peripheral regions 140, 141 and 142 as shown in FIG. 24.

The thicknesses tc, t1 and t3 are in the relation t1<t3<tc. More specifically, the thicknesses tc, t1, t2 and t3 can be 2.5 mm, 2.1 mm, 2.3 mm and 2.4 mm respectively, for example.

FIGS. 25 to 34 show modifications of the wood drivers and the fairway woods provided with the faces 2 having the maximum heights from the soles 4 on the side of the toes 5. Sweet spots 15 are located on relatively low positions in the modifications shown in FIGS. 29 and 31 and at the central portions of faces 2 in the remaining modifications.

Figure 25:
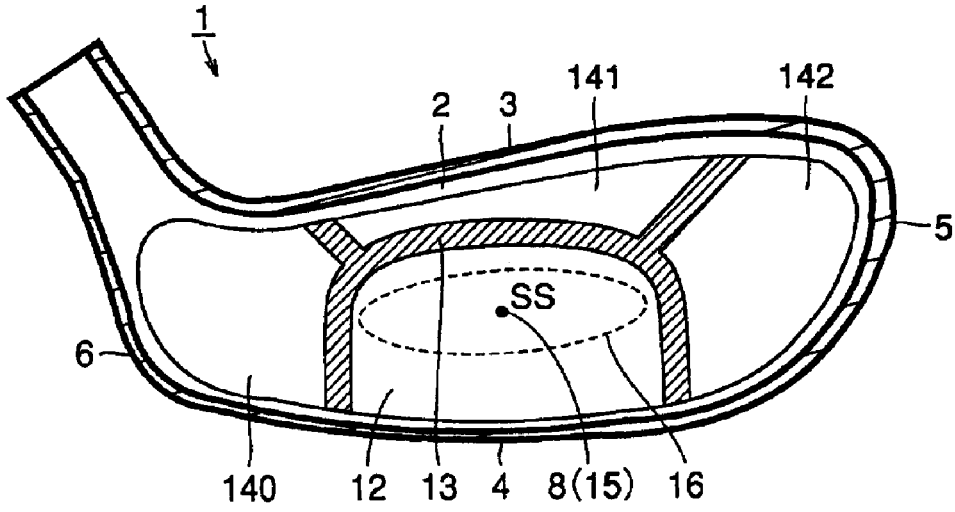

As shown in FIG. 25, three peripheral regions 140, 141 and 142 may be provided around a center part 12, which may have a thickness tc larger than the thicknesses t1, t2 and t3 of the peripheral regions 140, 141 and 142.

The center part 12 includes an ellipse 16 and has an elliptic upper portion and an arbitrarily shaped lower portion.

The thicknesses tc, t1 and t3 are in the relation t3<t1<tc. More specifically, the thicknesses tc, t1, t2 and t3 can be 2.8 mm, 2.4 mm. 2.5 mm and 2.7 mm respectively, for example.

Figure 26:
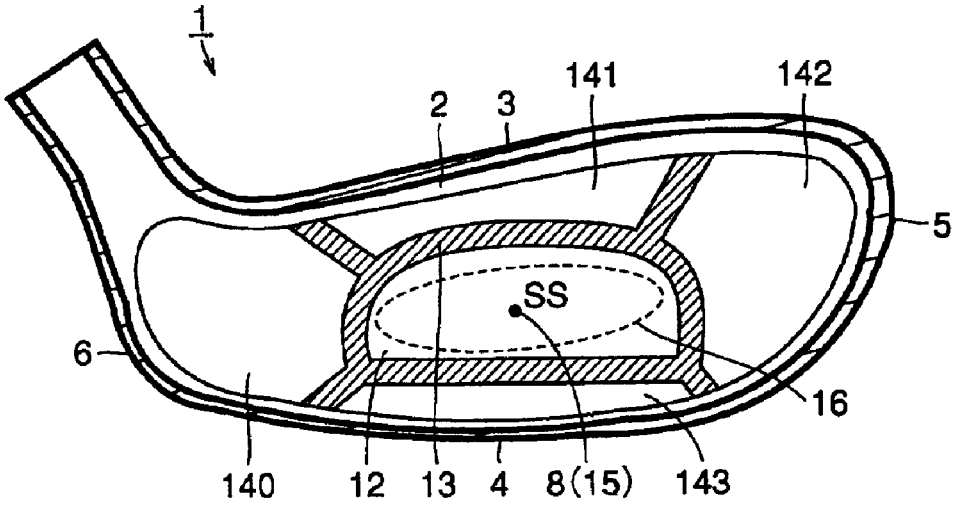

As shown in FIG. 26, four peripheral regions 140, 141, 142 and 143 may be provided around a center part 12, which may have a thickness tc larger than the thicknesses t1, t2, t3 and t4 of the peripheral regions 140, 141, 142 and 143.

The center part 12 includes an ellipse 16 and has an elliptic upper portion and an arbitrarily shaped lower portion, similarly to the above.

The thicknesses tc, t1, t2, t3 and t4 are in the relation t3<t1<tc and t4<t2<tc. More specifically, the thicknesses tc, t1, t2, t3 and t4 can be 2.7 mm, 2.2 mm, 2.4 mm, 2.6 mm and 2.5 mm respectively, for example.

Figure 27:
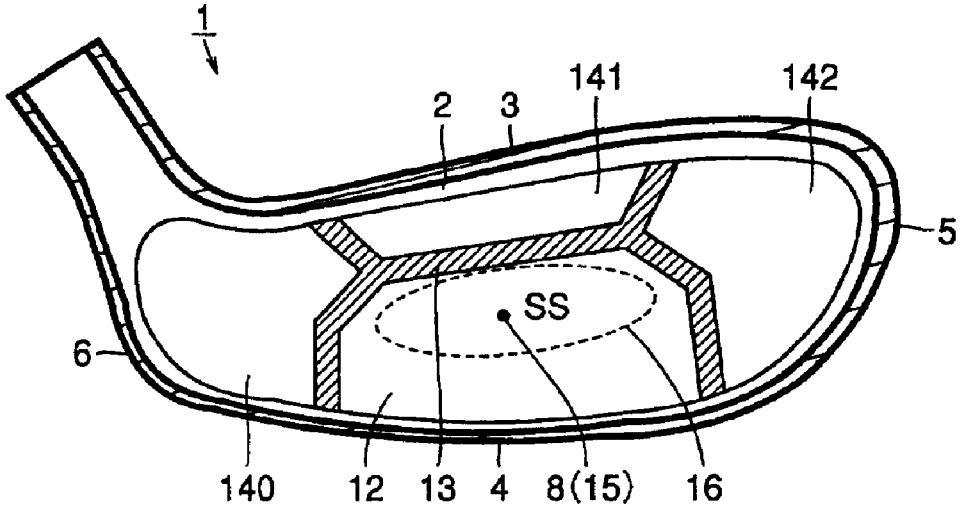

As shown in FIG. 27, three peripheral regions 140, 141 and 142 may be provided around a center part 12, which may have a thickness tc larger than the thicknesses t1, t2 and t3 of the peripheral regions 140, 141 and 142.

The center part 12 includes an ellipse 16 similarly to the above, and has a polygonal shape.

The thicknesses tc, t1 and t3 are in the relation t1<t3<tc. More specifically, the thicknesses tc, t1, t2 and t3 can be 3.0 mm, 2.5 mm, 2.8 mm and 2.9 mm respectively, for example.

Figure 28:
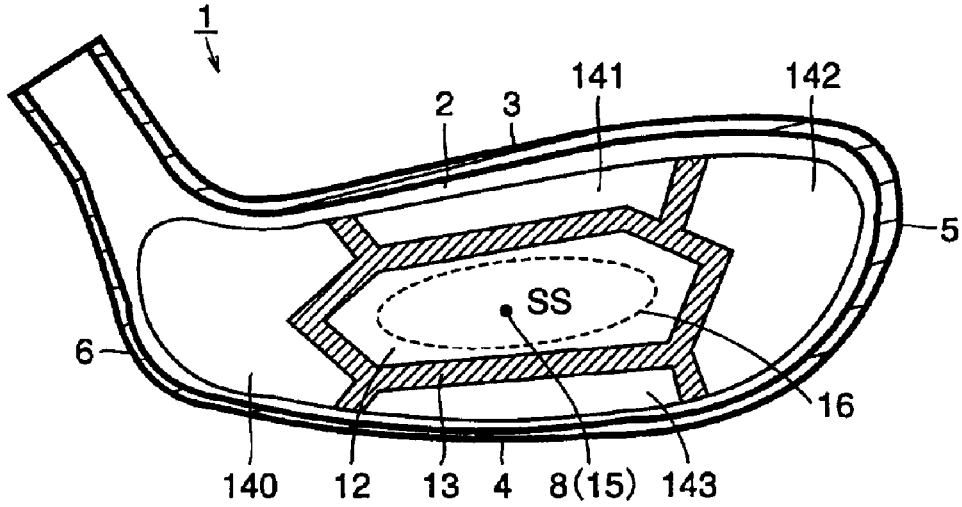

As shown in FIG. 28, four peripheral regions 140, 141, 142 and 143 may be provided around a center part 12, which may have a thickness tc larger than the thicknesses t1, t2, t3 and t4 of the peripheral regions 140, 141, 142 and 143.

The center part 12 includes an ellipse 16 and has a polygonal shape, similarly to the above.

The thicknesses tc, t1, t2, t3 and t4 are in the relation t1<t3<tc and t4=t2<tc. More specifically, the thicknesses tc, t1, t2, t3 and t4 can be 2.9 mm, 2.4 mm, 2.5 mm, 2.6 mm and 2.5 mm respectively, for example.

Figure 29:
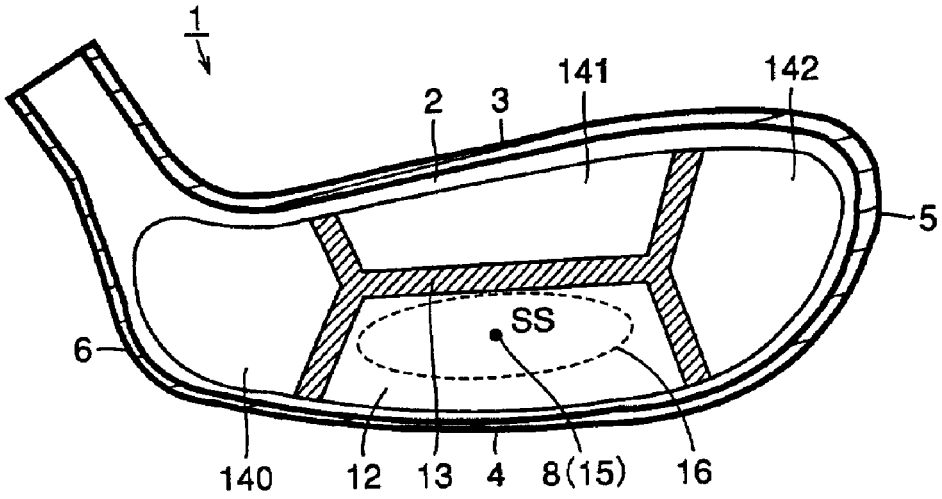

As shown in FIG. 29, three peripheral regions 140, 141 and 142 may be provided around a center part 12, which may have a thickness tc larger than the thicknesses t1, t2 and t3 of the peripheral regions 140, 141 and 142.

The center part 12 includes an ellipse 16 similarly to the above, and has a trapezoidal shape.

The thicknesses tc, t1 and t3 are in the relation t1<t3<tc. More specifically, the thicknesses tc, t1, t2 and t3 can be 2.9 mm, 2.4 mm, 2.7 mm and 2.6 mm respectively, for example.

Figure 30:
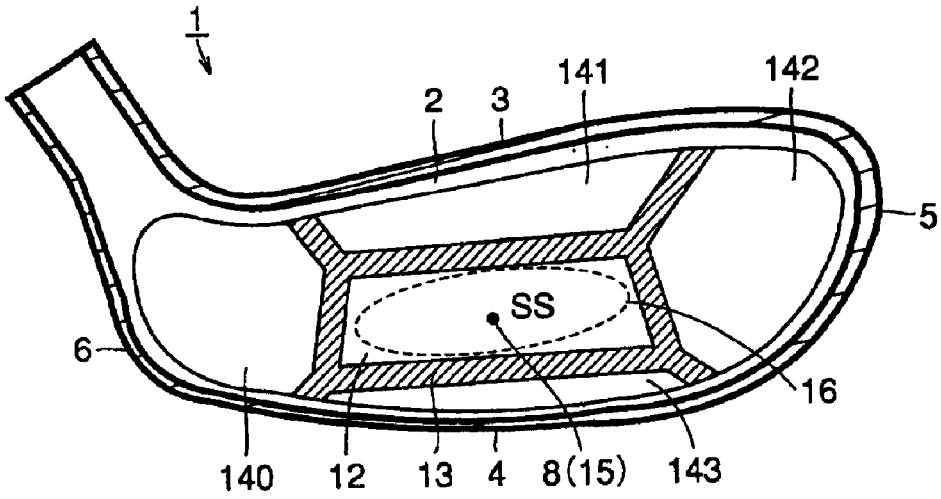

As shown in FIG. 30, four peripheral regions 140, 141, 142 and 143 may be provided around a center part 12, which may have a thickness tc larger than the thicknesses t1, t2, t3 and t4 of the peripheral regions 140, 141, 142 and 143.

The center part 12 includes an ellipse 16 and has a trapezoidal shape, similarly to the above.

The thicknesses tc, t1, t2, t3 and t4 are in the relation t1<t3<tc and t4=t2<tc. More specifically, the thicknesses tc, t1, t2, t3 and t4 can be 2.9 mm, 2.5 mm, 2.7 mm, 2.8 mm and 2.7 mm respectively, for example.

Figure 31:
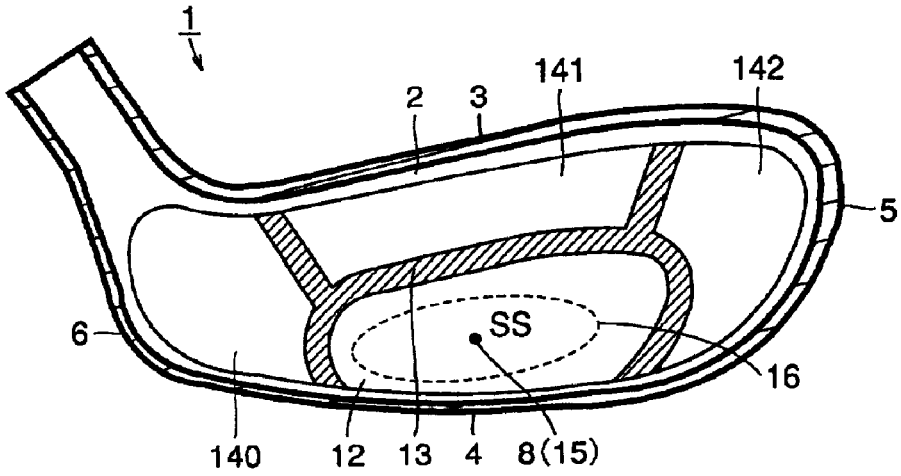

As shown in FIG. 31, three peripheral regions 140, 141 and 142 may be provided around a center part 12, which may have a thickness tc larger than the thicknesses t1, t2 and t3 of the peripheral regions 140, 141 and 142.

The center part 12 includes an ellipse 16 similarly to the above, and has a shape similar to the outer shape of the face 2.

The thicknesses tc, t1 and t3 are in the relation t1<t3 <tc. More specifically, the thicknesses tc, t1, t2 and t3 can be 2.8 mm, 2.2 mm, 2.6 mm and 2.4 mm respectively, for example.

Figure 32:
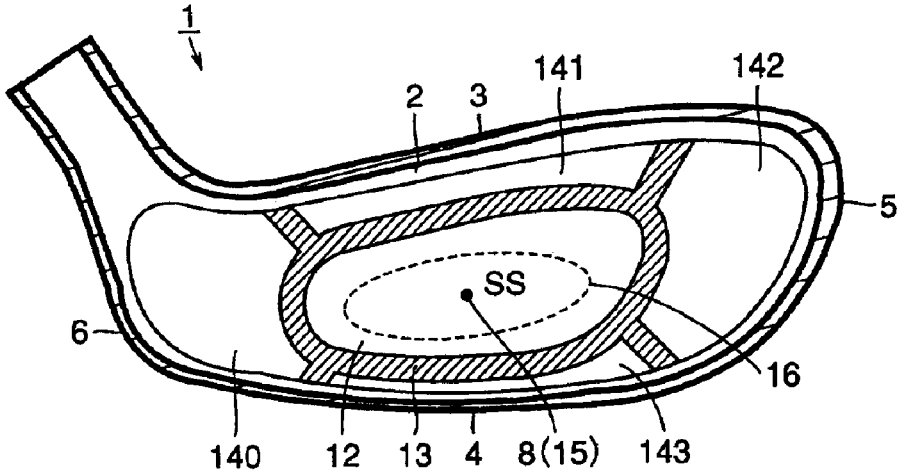

As shown in FIG. 32, four peripheral regions 140, 141, 142 and 143 may be provided around a center part 12, which may have a thickness tc larger than the thicknesses t1, t2, t3 and t4 of the peripheral regions 140, 141, 142 and 143.

The center part 12 includes an ellipse 16 and has a shape similar to the outer shape of the face 2, similarly to the above.

The thicknesses tc, t1, t2, t3 and t4 are in the relation t1<t3<tc and t4=t2<tc. More specifically, the thicknesses tc, t1, t2, t3 and t4 can be 2.9 mm, 2.5 mm, 2.8 mm, 2.7 mm and 2.8 mm respectively, for example.

Figure 33:
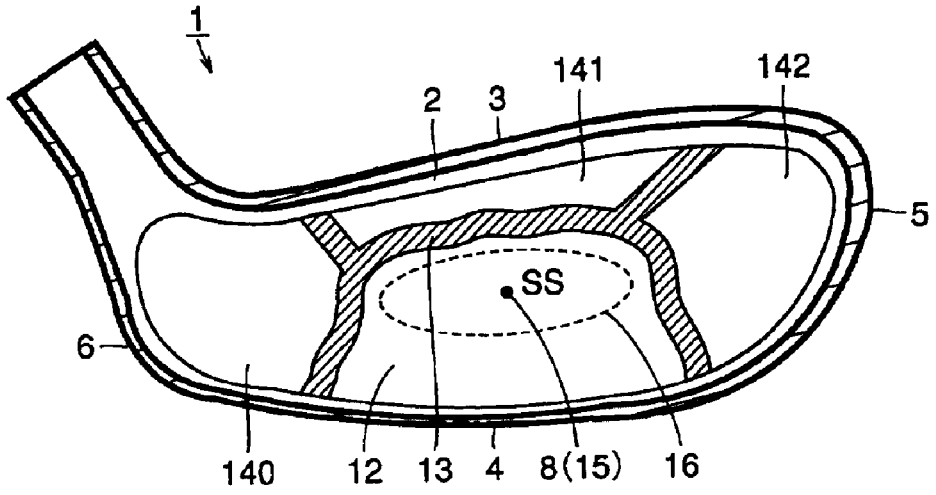

As shown in FIG. 33, three peripheral regions 140, 141 and 142 may be provided around a center part 12, which may have a thickness tc larger than the thicknesses t1, t2 and t3 of the peripheral regions 140, 141 and 142.

The center part 12 includes an ellipse 16 similarly to the above, and has an arbitrary shape.

The thicknesses tc, t1 and t3 are in the relation t1<t3 <tc. More specifically, the thicknesses tc, t1, t2 and t3 can be 2.9 mm, 2.5 mm, 2.8 mm and 2.6 mm respectively, for example.

Figure 34:
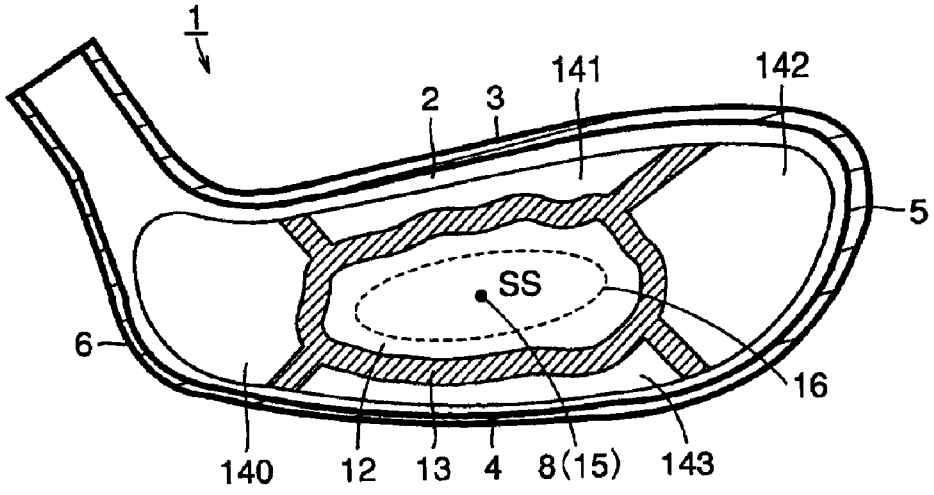

As shown in FIG. 34, four peripheral regions 140, 141, 142 and 143 may be provided around a center part 12, which may have a thickness tc larger than the thicknesses t1, t2, t3 and t4 of the peripheral regions 140, 141, 142 and 143.

The center part 12 includes an ellipse 16 and has an arbitrary shape, similarly to the above.

The thicknesses tc, t1, t2, t3 and t4 are in the relation t1<t3<tc and t4=t2<tc. More specifically, the thicknesses tc, t1, t2, t3 and t4 can be 2.8 mm, 2.2 mm, 2.5 mm, 2.3 mm and 2.5 mm respectively, for example.

FIGS. 35 to 50 show exemplary golf club heads provided with peripheral regions including portions located on the side of soles 4 having larger thicknesses than those located on the side of crowns 3. Faces 2 have the maximum heights from the soles 4 on the side of toes 5, while sweet spots 15 are located on positions higher than the central portions of the faces 2 in FIGS. 35 to 42 and on low positions of the faces 2 in FIGS. 43 to 50.

Figure 35:
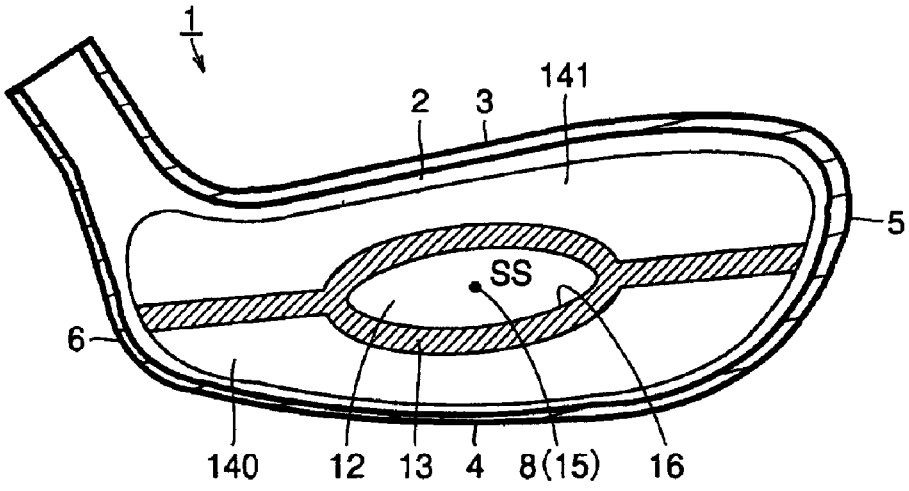

As shown in FIG. 35, two peripheral regions 140 and 141 are provided under and above an elliptic center part 12, which has a thickness tc larger than the thicknesses t1 and t2 of the peripheral regions 140 and 141.

The thicknesses tc, t1 and t2 are in the relation t2<t1<tc. Thus, the thickness t1 of the peripheral region 140 closer to the sole 4 is larger than the thickness t2 of the peripheral region 141 closer to the crown 3.

More specifically, the thicknesses tc, t1 and t2 can be 2.5 mm, 2.3 mm and 2.1 mm respectively, for example.

Figure 36:
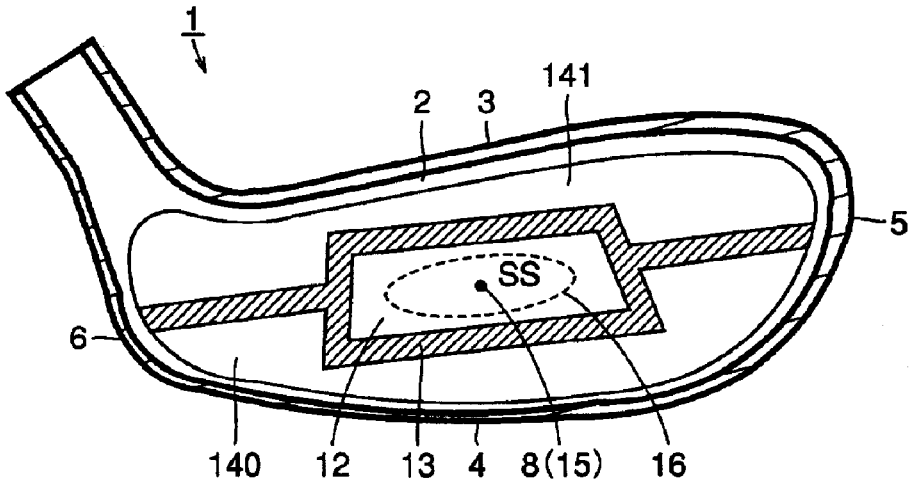
Figure 37:
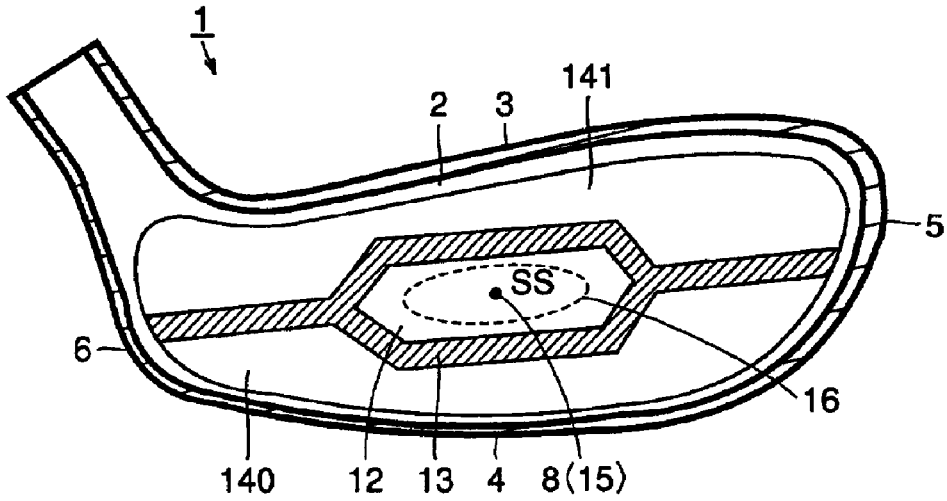
Figure 38:
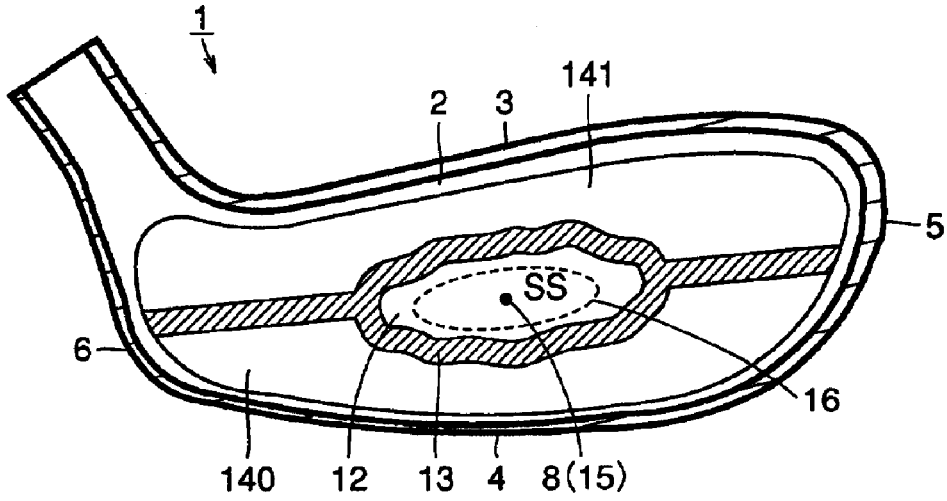

FIGS. 36 to 38 show modifications of the example shown in FIG. 35. The center part 12 of the face 2 may have a quadrilateral, polygonal or any other arbitrary shape, as shown in FIG. 36, 37 or 38.

Figure 39:
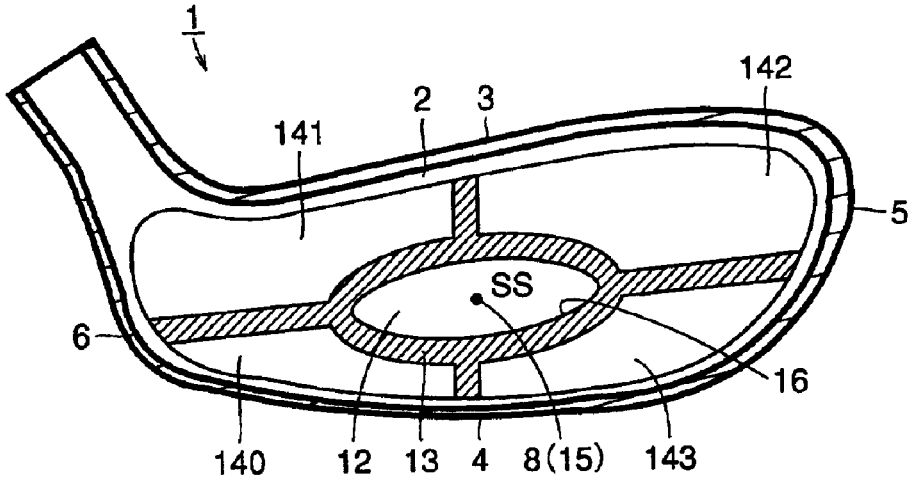

As shown in FIG. 39, four peripheral regions 140, 141, 142 and 143 may be provided around an elliptic center part 12, which may have a thickness tc larger than the thicknesses t1, t2, t3 and t4 of the peripheral regions 140, 141, 142 and 143.

The thicknesses tc, t1, t2, t3 and t4 are in the relation t2≦t3<t1 ≦t4<tc. More specifically, the thicknesses tc, t1, t2, t3 and t4 can be 3.0 mm, 2.6 mm, 2.2 mm, 2.4 mm and 2.8 mm respectively, for example.

When a portion of the face 2 located closer to the heel 6 has a larger height than a portion of the face 2 located closer to the toe 5, the thicknesses tc, t1, t2, t3 and t4 may be in the relation t3≦t2<t4≦t1<tc.

Figure 40:
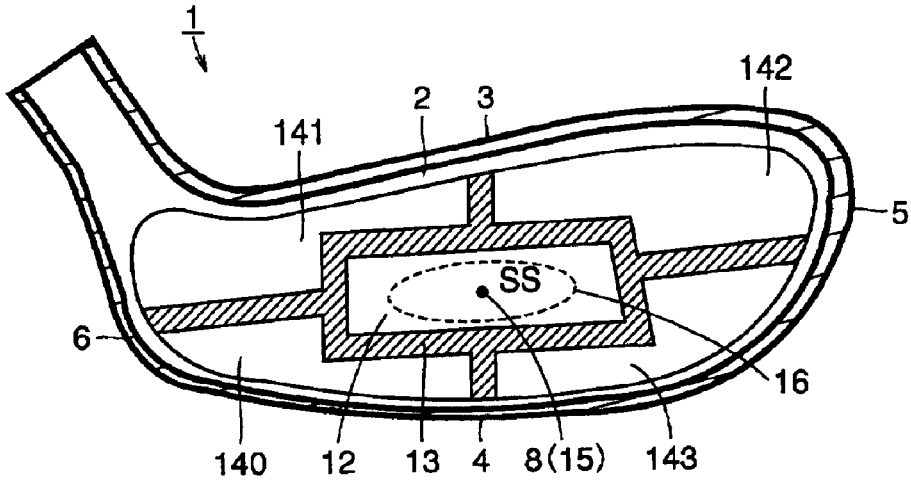
Figure 41:
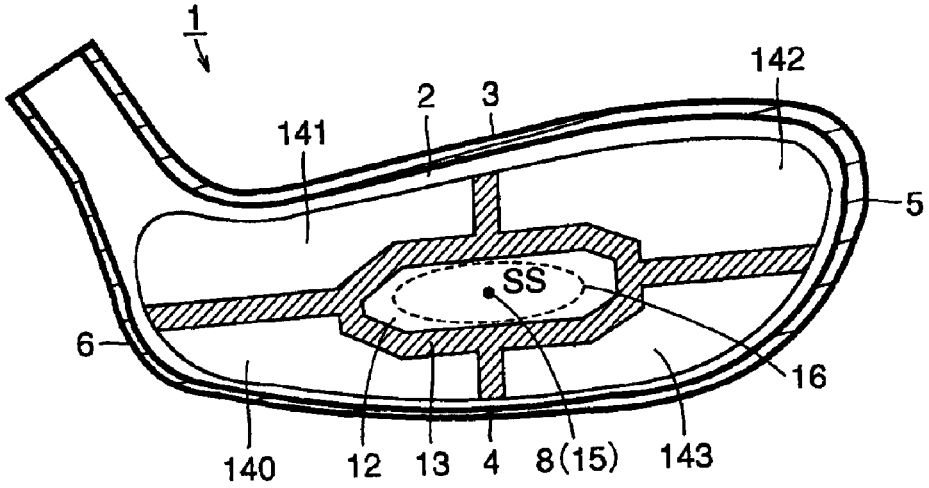
Figure 42:
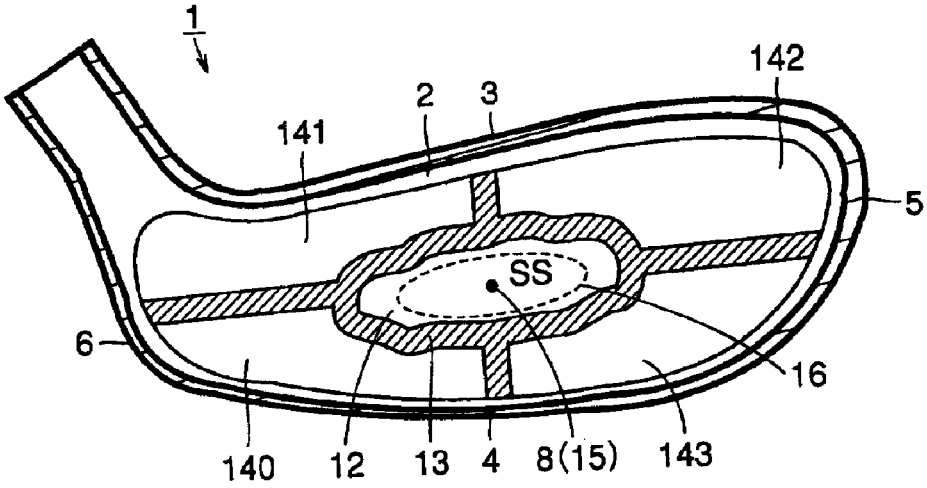

FIGS. 40 to 42 show modifications of the example shown in FIG. 39. The center part 12 of the face 2 may have a quadrilateral, polygonal or any other arbitrary shape, as shown in FIG. 40, 41 or 42.

Figure 43:
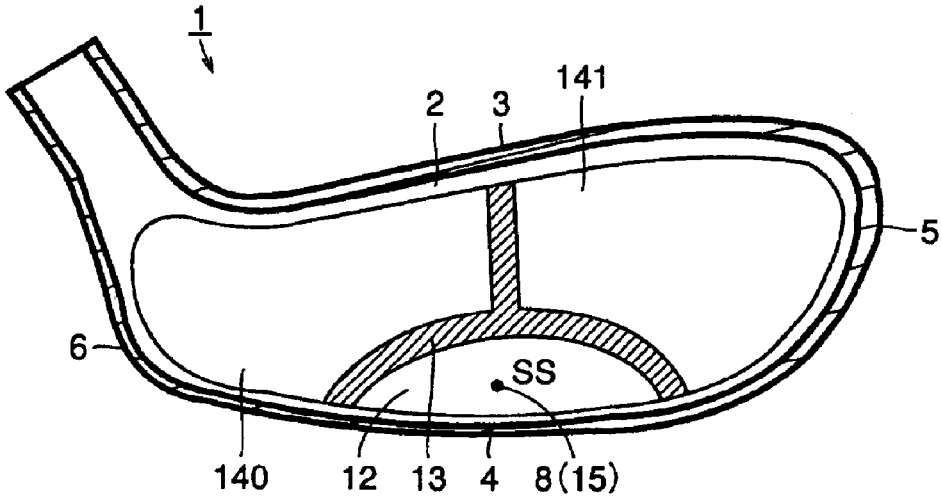

As shown in FIG. 43, a center part 12 may reach a portion close to the sole 4, and two peripheral regions 140 and 141 may be provided around the center part 12. In this case, the center part 12 has a thickness tc larger than the thicknesses t1 and t2 of the peripheral regions 140 and 141. A portion closer to the toe 5 has a larger thickness, and hence the thickness t2 is larger than the thickness t1. More specifically, the thicknesses tc, t1 and t2 can be 2.7 mm, 2.3 mm and 2.5 mm respectively, for example.

Figure 44:
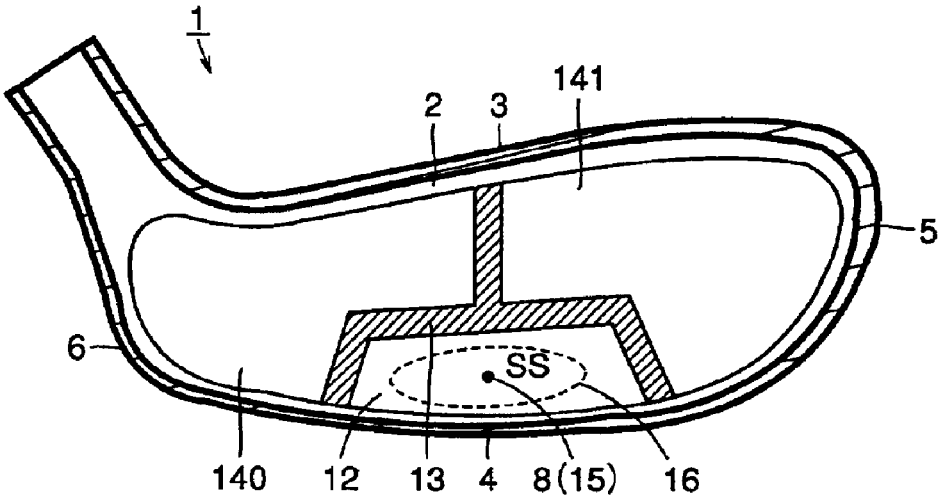
Figure 45:
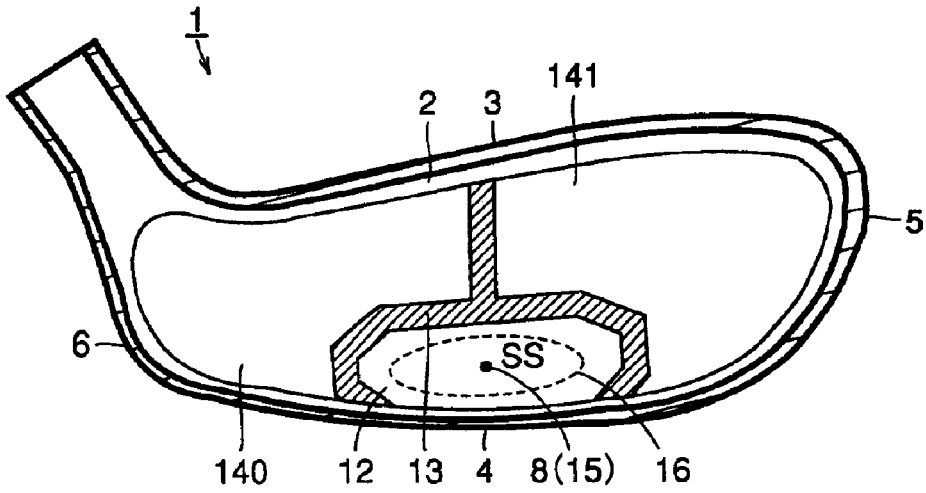
Figure 46:
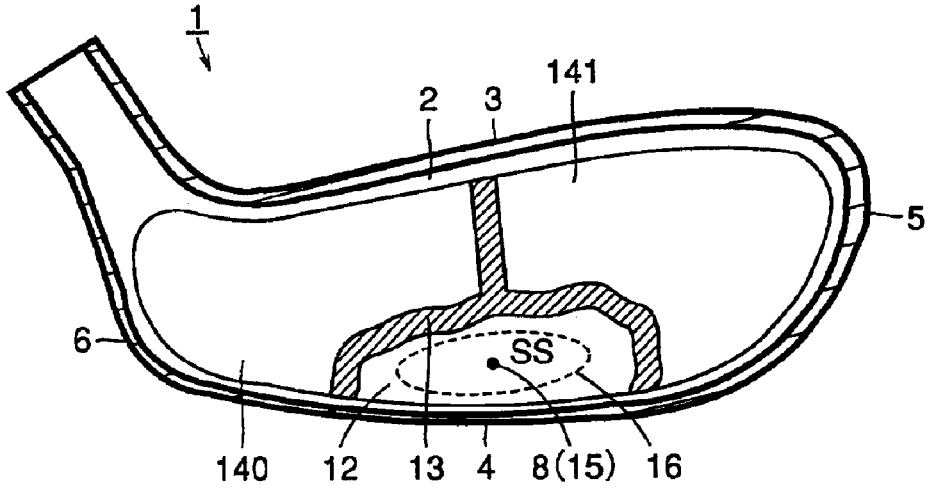

FIGS. 44 to 46 show modifications of the example shown in FIG. 43. The center part 12 of the face 2 may have a quadrilateral, polygonal or any other arbitrary shape, as shown in FIG. 44, 45 or 46.

Figure 47:
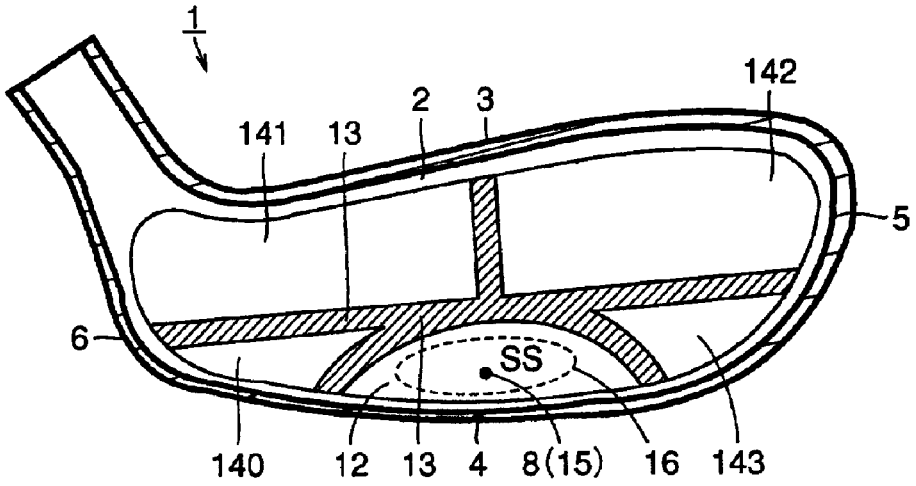

As shown in FIG. 47, a center part 12 may reach a portion close to the sole 4, and four peripheral regions 140, 141, 142 and 143 may be provided around the center part 12. The center part 12 has a thickness tc larger than the thicknesses t1, t2, t3 and t4 of the peripheral regions 140, 141, 142 and 143.

The thicknesses tc, t1, t2, t3 and t4 are in the relation t2≦t3<t1 ≦t4<tc. More specifically, the thicknesses tc, t1, t2, t3 and t4 can be 2.7 mm, 2.4 mm, 2.1 mm, 2.3 mm and 2.5 mm respectively, for example.

When a portion of a face 2 located closer to the heel 6 has a larger height than a portion of the face 2 located closer to the toe 5, the thicknesses tc, t1, t2, t3 and t4 may be in the relation t3≦t2<t4≦t1<tc.

Figure 48:
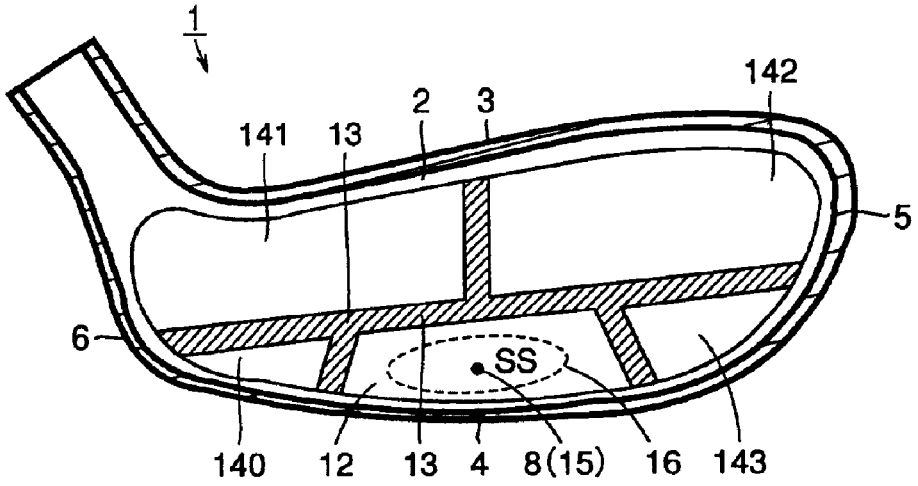
Figure 49:
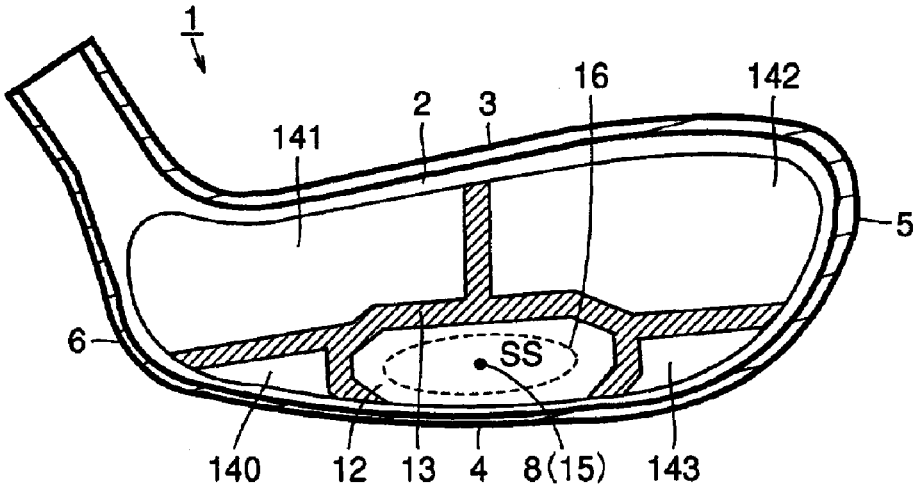
Figure 50:
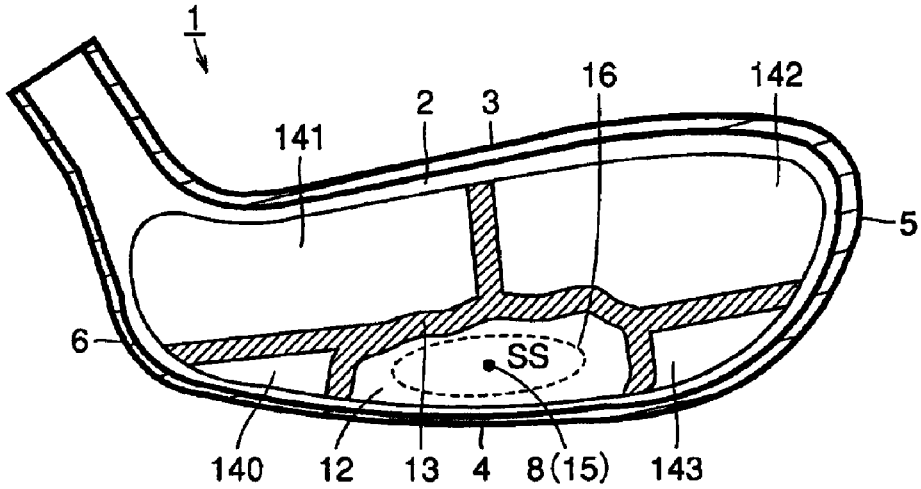

FIGS. 48 to 50 show modifications of the example shown in FIG. 47. The center part 12 of the face 2 may have a quadrilateral, polygonal or any other arbitrary shape, as shown in FIG. 48, 49 or 50.

FIGS. 51 to 80 show iron golf club heads to which the present invention is applied.

Figure 51:
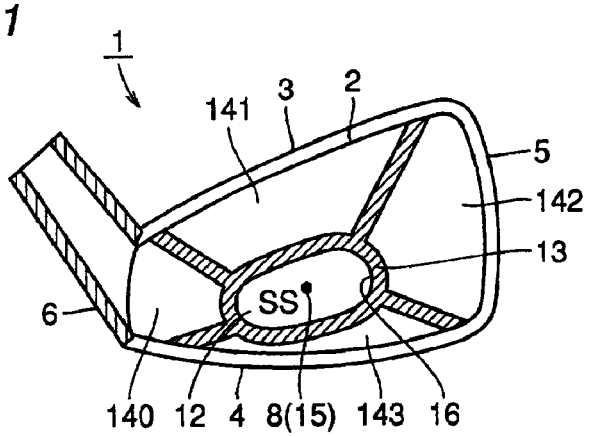
FIG. 51 is a sectional view showing the rear surface of a face of an exemplary iron golf club head according to the present invention.

FIG. 51 shows a golf club head having a sweet spot 15 located under the central portion of a face 2.

In this case, four peripheral regions 140, 141, 142 and 143 are provided around a center part 12, which has a thickness tc larger than the thicknesses t1, t2, t3 and t4 of the peripheral regions 140, 141, 142 and 143 as shown in FIG. 51.

The thicknesses tc, t1, t2, t3 and t4 are in the relation t1<t3<tc and t4<t2<tc. More specifically, the thicknesses tc, t1, t2, t3 and t4 can be 3.5 mm, 3.0 mm, 3.4 mm, 3.3 mm and 3.1 mm respectively, for example.

Figure 52:
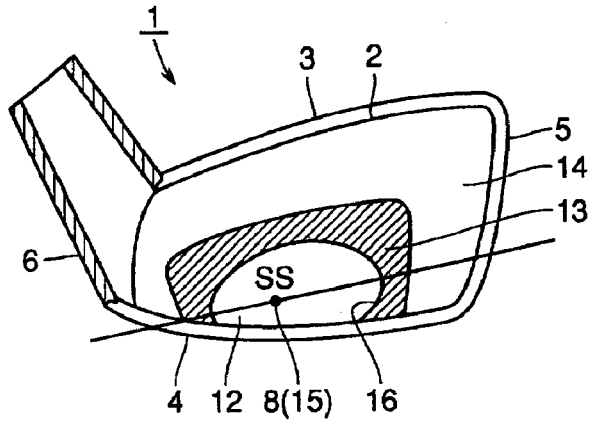
FIG. 52 is a sectional view showing the rear surface of a face of another exemplary iron golf club head according to the present invention.

FIG. 52 shows a golf club head having a sweet spot 15 located considerably under the central portion of a face 2.

In this case, a center part 12 reaches a portion close to a sole 4 and a peripheral region 14 is provided around the center part 12, as shown in FIG. 52. The center part 12 has a thickness tc larger than the thickness tp of the peripheral region 14.

The ratio of reduction of the thickness of a tapered part 13 varies with the distance between the sweet spot 15 and the outer periphery of the face 2, similarly to the case shown in FIG. 13. More specifically, the thicknesses tc and tp can be 3.4 mm and 3.0 mm respectively, for example. The thickness of the tapered part 13 is reduced by a method similar to that in the case shown in FIG. 13.

Figure 53:
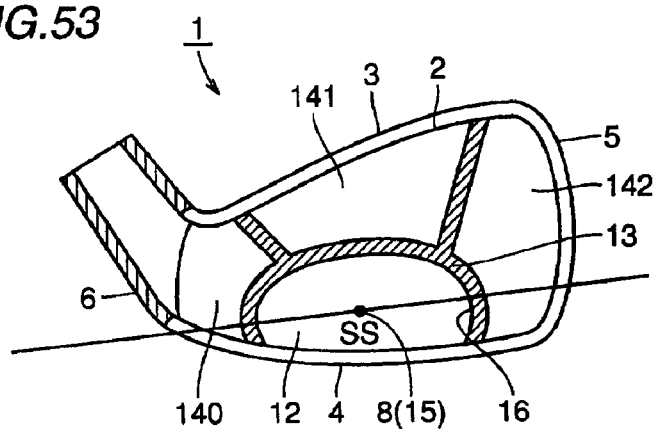
FIGS. 53 to 80 are sectional views showing the rear surfaces of faces of further exemplary iron golf club heads according to the present invention.

FIG. 53 shows a golf club head having a sweet spot 15 located considerably under the central portion of a face 2.

In this case, three peripheral regions 140, 141 and 142 are provided around a center part 12, which has a thickness tc larger than the thicknesses t1, t2 and t3 of the peripheral regions 140, 141 and 142 as shown in FIG. 53.

The thicknesses tc, t1 and t3 are in the relation t1<t3<tc. More specifically, the thicknesses tc, t1, t2 and t3 can be 3.4 mm, 3.0 mm, 3.2 mm and 3.3 mm respectively, for example.

Figure 54:
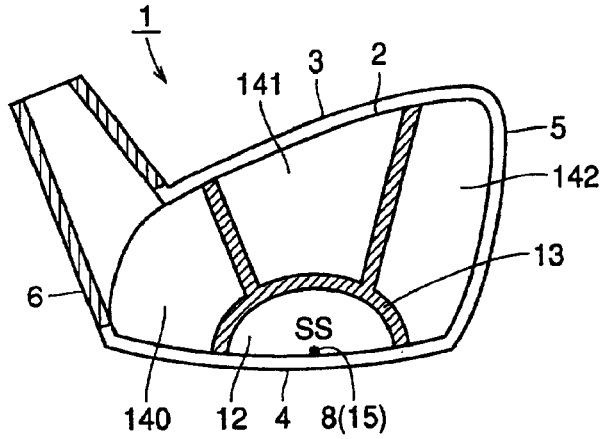

FIG. 54 shows a golf club head having a sweet spot 15 located in the vicinity of a sole 4.

Also in this case, three peripheral regions 140, 141 and 142 are provided around a center part 12, which has a thickness tc larger than the thicknesses t1, t2 and t3 of the peripheral regions 140, 141 and 142 as shown in FIG. 54.

The thicknesses tc, t1 and t3 are in the relation t1<t3<tc. More specifically, the thicknesses tc, t1, t2 and t3 can be 3.7 mm, 2.9 mm, 2.4 mm and 3.6 mm respectively, for example.

FIGS. 55 to 64 show other exemplary structures of the face 2. Sweet spots 15 are located above the central portions of faces 2 in FIGS. 55 to 58, 60 and 62 to 64, and located on low positions of faces 2 in FIGS. 59 and 61.

Figure 55:
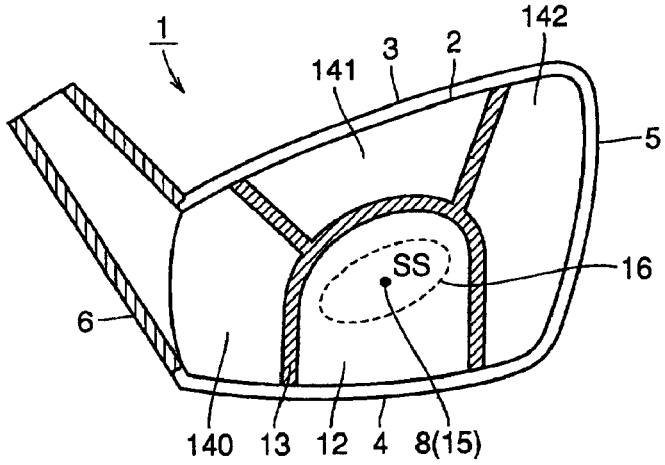

As shown in FIG. 55, three peripheral regions 140, 141 and 142 may be provided around a center part 12, which may have a thickness tc larger than the thicknesses t1, t2 and t3 of the peripheral regions 140, 141 and 142.

The center part 12 includes an ellipse 16, and has an elliptic upper portion and an arbitrarily shaped lower portion.

The thicknesses tc, t1 and t3 are in the relation t1<t3<tc. More specifically, the thicknesses tc, t1, t2 and t3 can be 3.6 mm, 2.8 mm, 3.2 mm and 3.3 mm respectively, for example.

Figure 56:
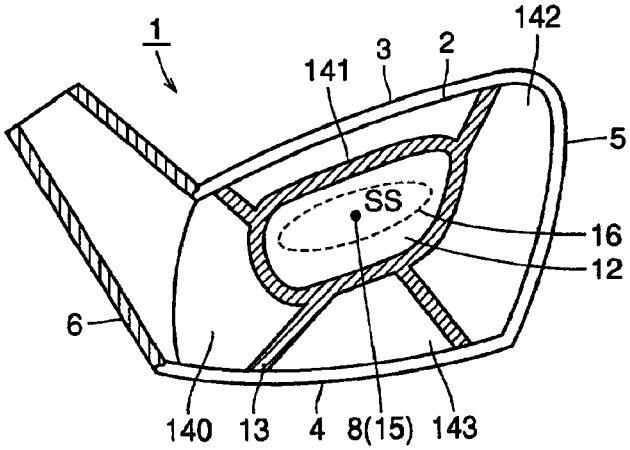

As shown in FIG. 56, four peripheral regions 140, 141, 142 and 143 maybe provided around a center part 12, which may have a thickness tc larger than the thicknesses t1, t2, t3 and t4 of the peripheral regions 140, 141, 142 and 143.

The center part 12 includes an ellipse 16, and has an elliptic upper portion and an arbitrarily shaped lower portion, similarly to the above.

The thicknesses tc, t1, t2, t3 and t4 are in the relation t1<t3<tc and t2<t4<tc. More specifically, the thicknesses tc, t1, t2, t3 and t4 can be 3.8 mm, 3.2 mm, 3.3 mm, 3.6 mm and 3.7 mm respectively, for example.

Figure 57:
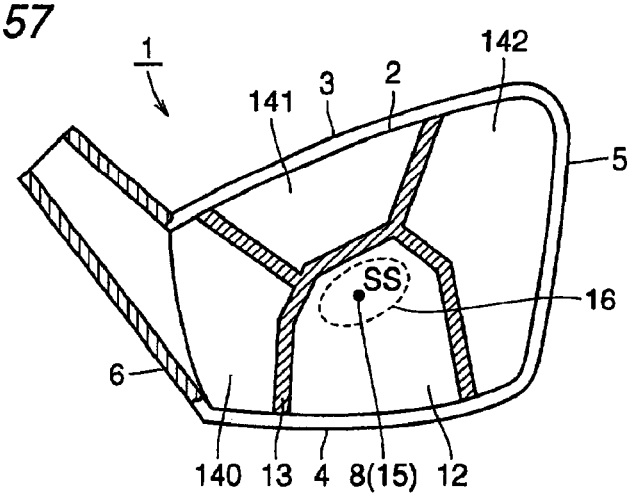

As shown in FIG. 57, three peripheral regions 140, 141 and 142 may be provided around a center part 12, which may have a thickness tc larger than the thicknesses t1, t2 and t3 of the peripheral regions 140, 141 and 142.

The center part 12 includes an ellipse 16 similarly to the above, and has a polygonal shape.

The thicknesses tc, t1 and t3 are in the relation t1<t3 <tc. More specifically, the thicknesses tc, t1, t2 and t3 can be 3.6 mm, 3.0 mm, 3.2 mm and 3.4 mm respectively, for example.

Figure 58:
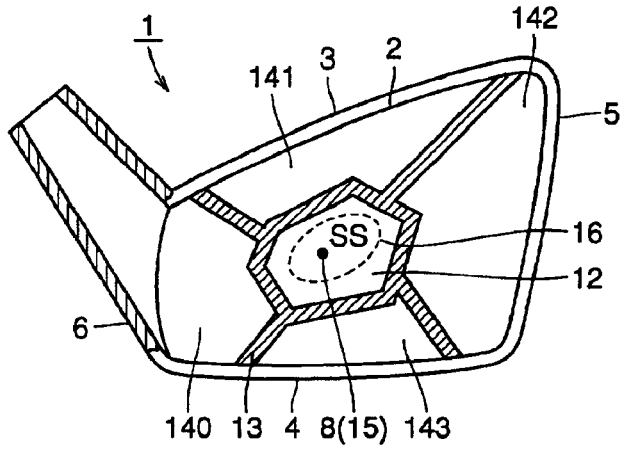

As shown in FIG. 58, four peripheral regions 140, 141, 142 and 143 maybe provided around a center part 12, which may have a thickness tc larger than the thicknesses t1, t2, t3 and t4 of the peripheral regions 140, 141, 142 and 143.

The center part 12 includes an ellipse 16 and has a polygonal shape, similarly to the above.

The thicknesses tc, t1, t2, t3 and t4 are in the relation t1<t3<tc and t2<t4<tc. More specifically, the thicknesses tc, t1, t2, t3 and t4 can be 3.8 mm, 3.1 mm, 3.2 mm, 3.4 mm and 3.5 mm respectively, for example.

Figure 59:
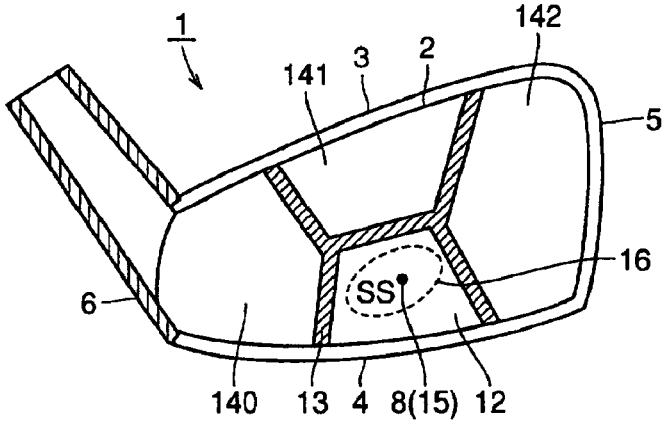

As shown in FIG. 59, three peripheral regions 140, 141 and 142 may be provided around a center part 12, which may have a thickness tc larger than the thicknesses t1, t2 and t3 of the peripheral regions 140, 141 and 142.

The center part 12 includes an ellipse 16 similarly to the above, and has a trapezoidal shape.

The thicknesses tc, t1 and t3 are in the relation t1<t3<tc. More specifically, the thicknesses tc, t1, t2 and t3 can be 3.6 mm, 3.0 mm, 3.2 mm and 3.4 mm respectively, for example.

Figure 60:
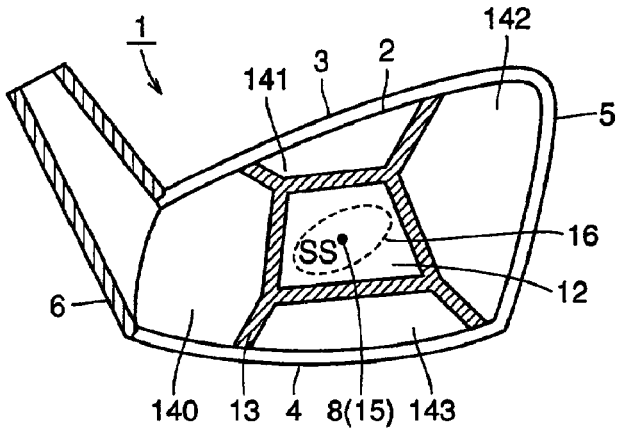

As shown in FIG. 60, four peripheral regions 140, 141, 142 and 143 maybe provided around a center part 12, which may have a thickness tc larger than the thicknesses t1, t2, t3 and t4 of the peripheral regions 140, 141, 142 and 143.

The center part 12 includes an ellipse 16 and has a trapezoidal shape, similarly to the above.

The thicknesses tc, t1, t2, t3 and t4 are in the relation t1<t3<tc and t2<t4<tc. More specifically, the thicknesses tc, t1, t2, t3 and t4 can be 3.8 mm, 3.0 mm, 3.1 mm, 3.3 mm and 3.6 mm respectively, for example.

Figure 61:
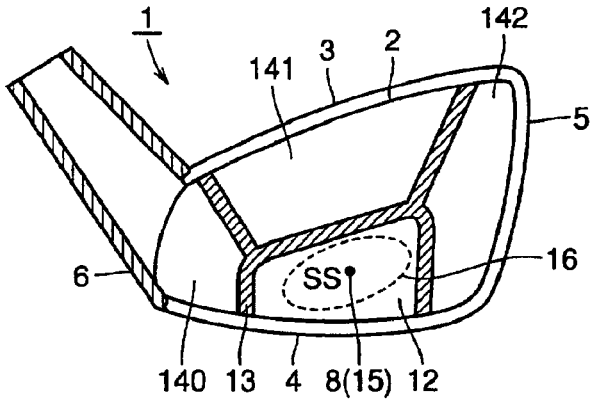

As shown in FIG. 61, three peripheral regions 140, 141 and 142 may be provided around a center part 12, which may have a thickness tc larger than the thicknesses t1, t2 and t3 of the peripheral regions 140, 141 and 142.

The center part 12 includes an ellipse 16 similarly to the above, and has a shape similar to the outer shape of the face 2.

The thicknesses tc, t1 and t3 are in the relation t1<t3<tc. More specifically, the thicknesses tc, t1, t2 and t3 can be 3.5 mm, 2.9 mm, 3.4 mm and 3.3 mm respectively, for example.

Figure 62:
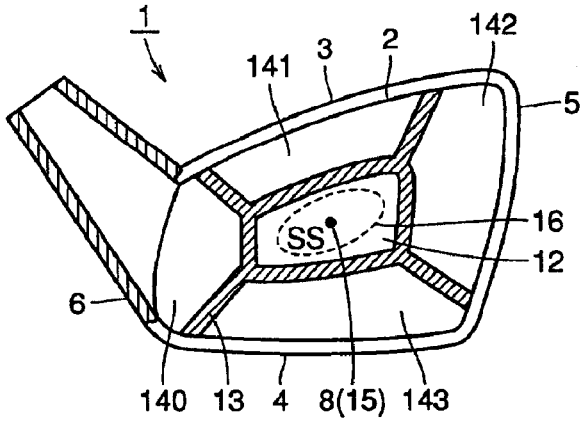

As shown in FIG. 62, four peripheral regions 140, 141, 142 and 143 may be provided around a center part 12, which may have a thickness tc larger than the thicknesses t1, t2, t3 and t4 of the peripheral regions 140, 141, 142 and 143.

The center part 12 includes an ellipse 16 and has a shape similar to the outer shape of the face 2, similarly to the above.

The thicknesses tc, t1, t2, t3 and t4 are in the relation t1<t3<tc and t2<t4<tc. More specifically, the thicknesses tc, t1, t2, t3 and t4 can be 3.8 mm, 3.0 mm, 3.2 mm, 3.4 mm and 3.6 mm respectively, for example.

Figure 63:
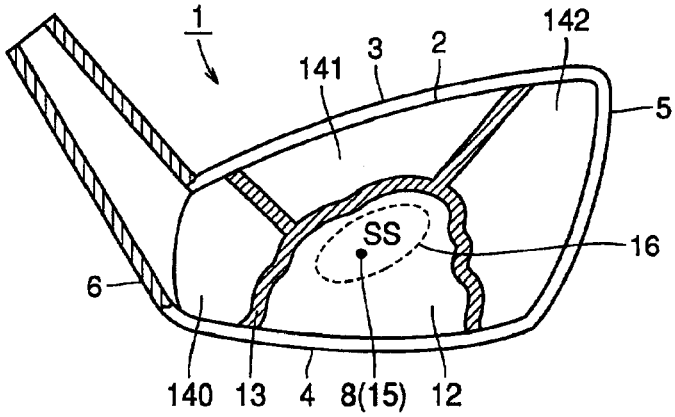

As shown in FIG. 63, three peripheral regions 140, 141 and 142 may be provided around a center part 12, which may have a thickness tc larger than the thicknesses t1, t2 and t3 of the peripheral regions 140, 141 and 142.

The center part 12 includes an ellipse 16 similarly to the above, and may have an arbitrary shape.

The thicknesses tc, t1 and t3 are in the relation t1<t3<tc. More specifically, the thicknesses tc, t1, t2 and t3 can be 3.9 mm, 3.1 mm, 3.6 mm and 3.5 mm respectively, for example.

Figure 64:
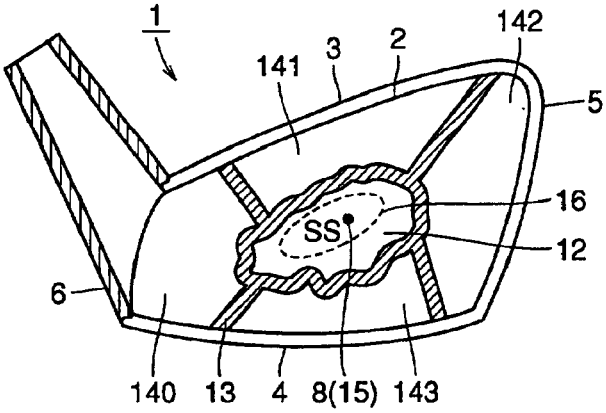

As shown in FIG. 64, four peripheral regions 140, 141, 142 and 143 maybe provided around a center part 12, which may have a thickness tc larger than the thicknesses t1, t2, t3 and t4 of the peripheral regions 140, 141, 142 and 143.

The center part 12 includes an ellipse 16 and may have an arbitrary shape, similarly to the above.

The thicknesses tc, t1, t2, t3 and t4 are in the relation t1<t3<tc and t2<t4<tc. More specifically, the thicknesses tc, t1, t2, t3 and t4 can be 3.8 mm, 3.1 mm, 3.3 mm, 3.5 mm and 3.7 mm respectively, for example.

FIGS. 65 to 80 show golf club heads provided with peripheral regions having larger thicknesses on the side of soles 4 than those on the side of crowns 3. Sweet spots 15 are located above the central portions of faces 2 in FIGS. 65 to 72, and on low positions of faces 2 in FIGS. 73 to 80.

Figure 65:
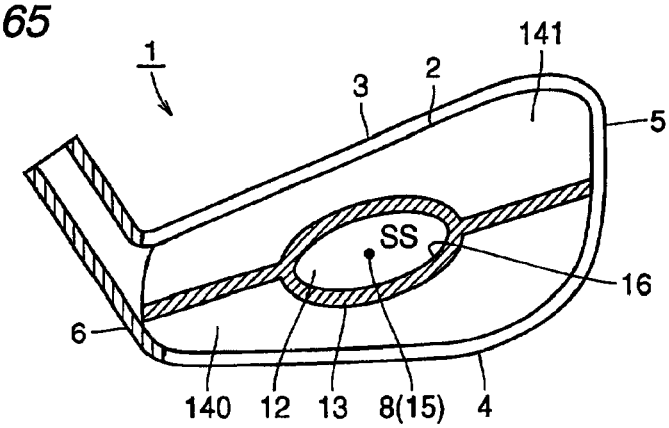

As shown in FIG. 65, two peripheral regions 140 and 141 may be provided under and above an elliptic center part 12, which may have a thickness tc larger than the thicknesses t1 and t2 of the peripheral regions 140 and 141.

The thicknesses tc, t1 and t2 are in the relation t2<t1<tc. Thus, when the thickness t1 of the peripheral region 140 closer to a sole 4 is larger than the thickness t2 of the peripheral region 141 closer to a crown 3, strength can be increased in a portion of the face 2 closer to the sole 4.

More specifically, the thicknesses tc, t1 and t2 can be 3.6 mm, 3.0 mm and 2.8 mm respectively, for example.

Figure 66:
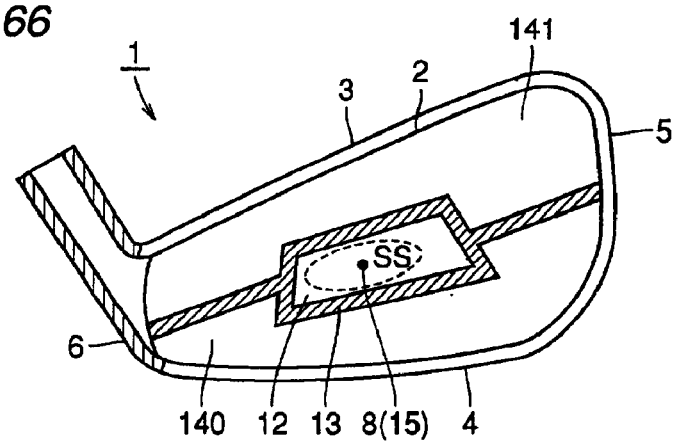
Figure 67:
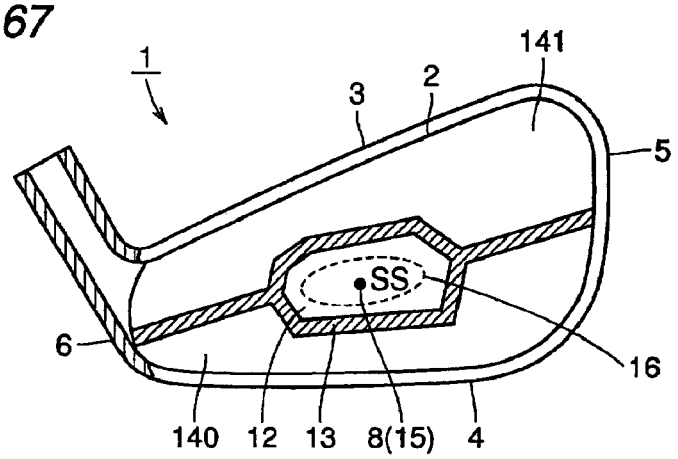
Figure 68:
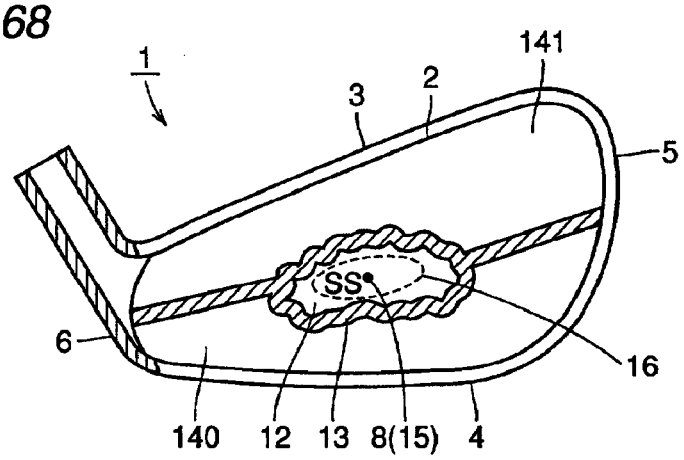

FIGS. 66 to 68 show modifications of the example shown in FIG. 65. The center part 12 of the face 2 may have a quadrilateral, polygonal or any other arbitrary shape, as shown in FIG. 66, 67 or 68.

Figure 69:
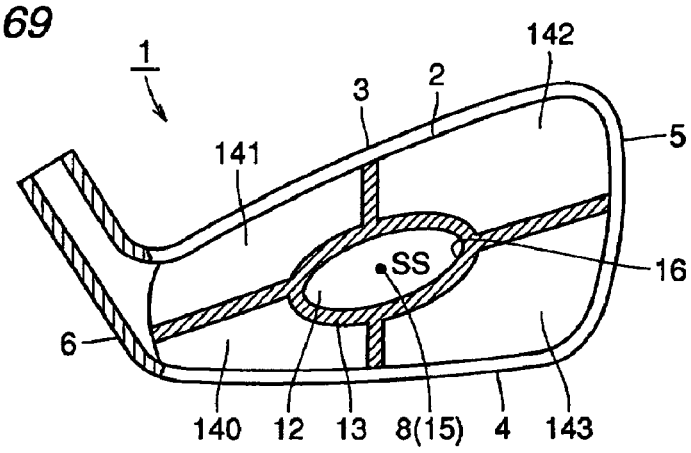

As shown in FIG. 69, four peripheral regions 140, 141, 142 and 143 may be provided around an elliptic center part 12, which may have a thickness tc larger than the thicknesses t1, t2, t3 and t4 of the peripheral regions 140, 141, 142 and 143.

The thicknesses tc, t1, t2, t3 and t4 are in the relation t2≦t3<t1 ≦t4<tc. More specifically, the thicknesses tc, t1, t2, t3 and t4 can be 3.8 mm, 3.4 mm, 3.0 mm, 3.2 mm and 3.6 mm respectively, for example.

Figure 70:
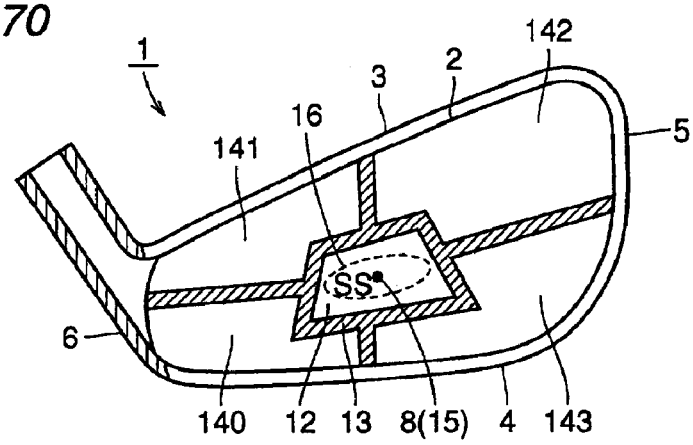
Figure 71:
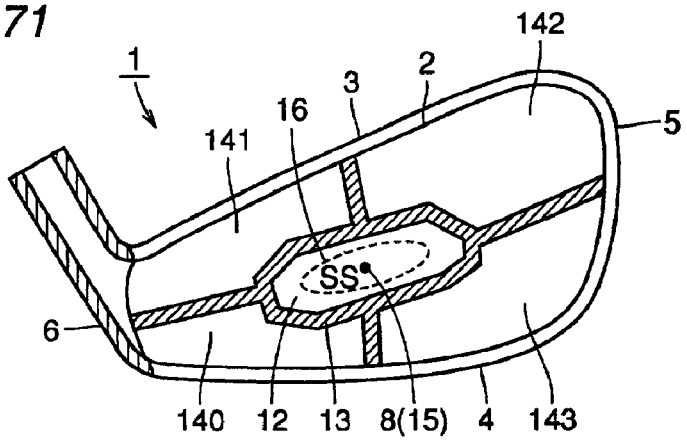
Figure 72:
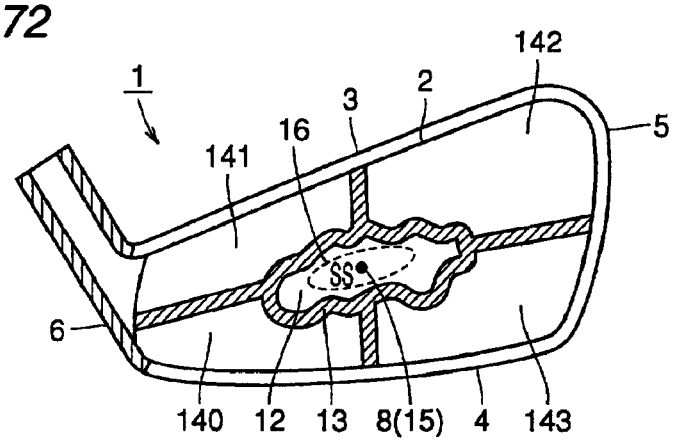

FIGS. 70 to 72 show modifications of the example shown in FIG. 69. The center part 12 of the face 2 may have a quadrilateral, polygonal or any other arbitrary shape, as shown in FIG. 70, 71 or 72.

Figure 73:
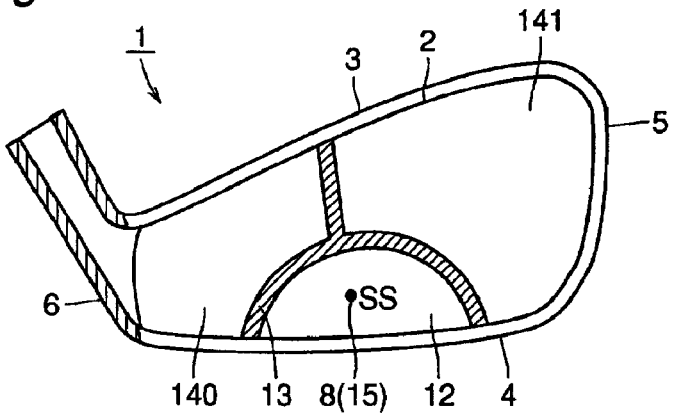

As shown in FIG. 73, a center part 12 reaches a portion close to a sole 4, and two peripheral regions 140 and 141 are provided around the center part 12. The center part 12 has a thickness tc larger than the thicknesses t1 and t2 of the peripheral regions 140 and 141.

A face 2 has a large height on the side of a toe 5, and hence the thickness t2 is larger than the thickness t1. More specifically, the thicknesses tc, t1 and t2 can be 3.5 mm, 3.1 mm and 3.3 mm respectively, for example.

Figure 74:
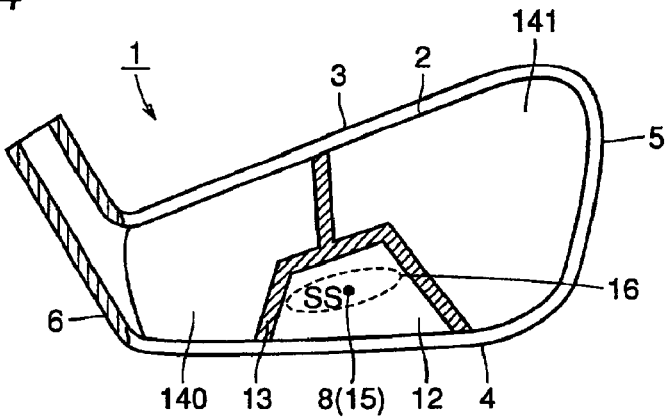
Figure 75:
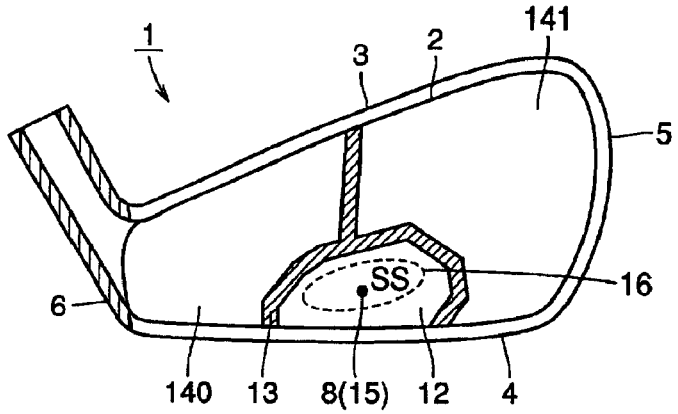
Figure 76:
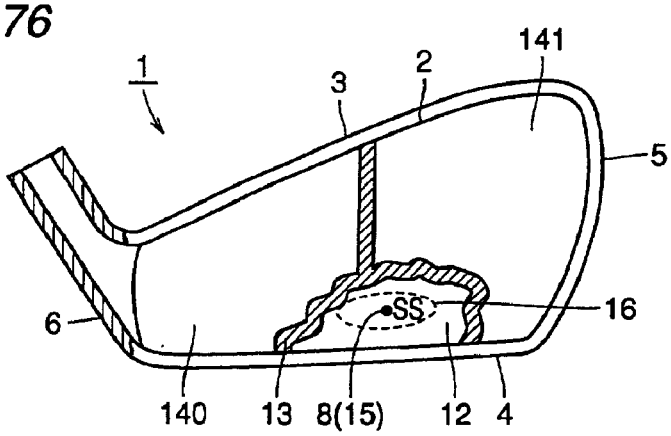

FIGS. 74 to 76 show modifications of the example shown in FIG. 73. The center part 12 of the face 2 may have a quadrilateral, polygonal or any other arbitrary shape, as shown in FIG. 74, 75 or 76.

Figure 77:
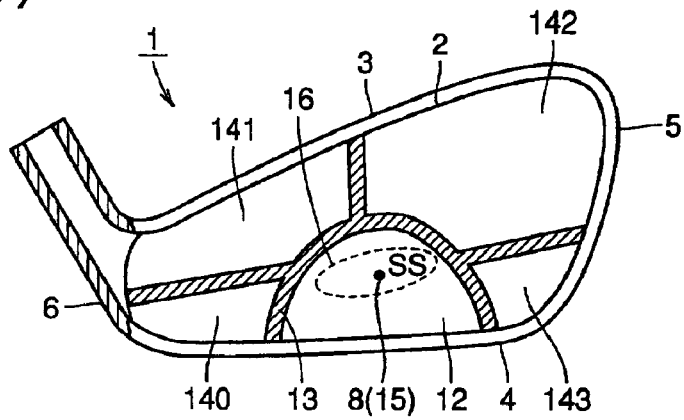

As shown in FIG. 77, four peripheral regions 140, 141, 142 and 143 may be provided around a center part 12. In this case, the center part 12 has a thickness tc larger than the thicknesses t1, t2, t3 and t4 of the peripheral regions 140, 141, 142 and 143.

The thicknesses tc, t1, t2, t3 and t4 are in the relation t2≦t3<t1 ≦t4 21 tc. More specifically, the thicknesses tc, t1, t2, t3 and t4 can be 3.9 mm, 3.5 mm, 3.0 mm, 3.2 mm and 3.7 mm respectively, for example.

Figure 78:
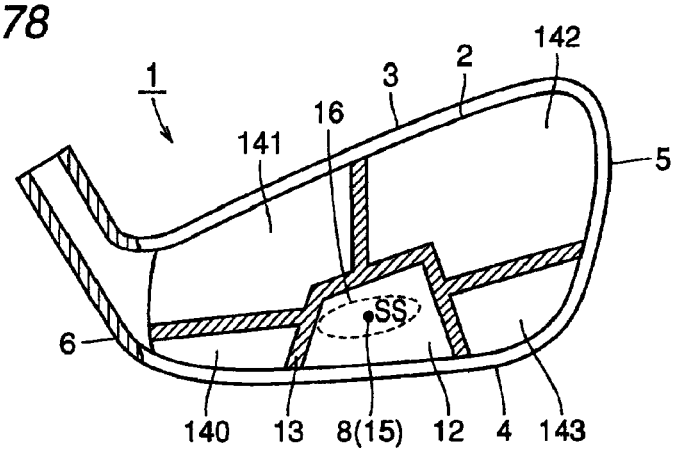
Figure 79:
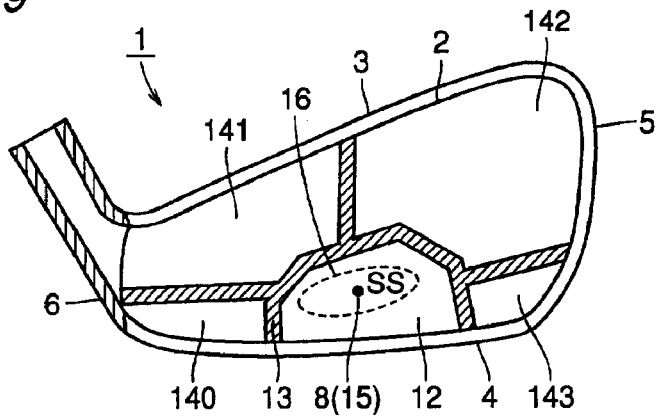
Figure 80:
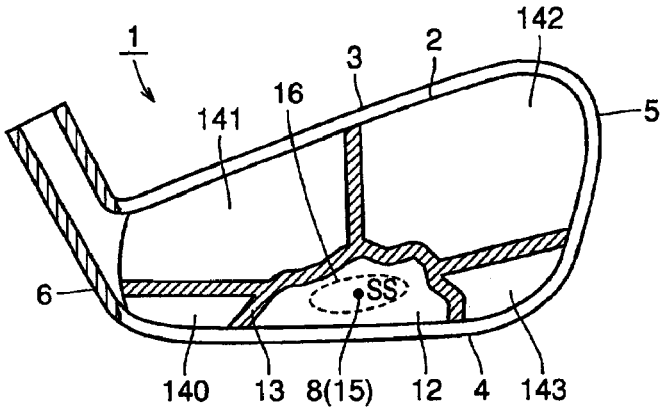

FIGS. 78 to 80 show modifications of the example shown in FIG. 77. The center part 12 of the face 2 may have a quadrilateral, polygonal or any other arbitrary shape, as shown in FIG. 78, 79 or 80.

Figure 84:
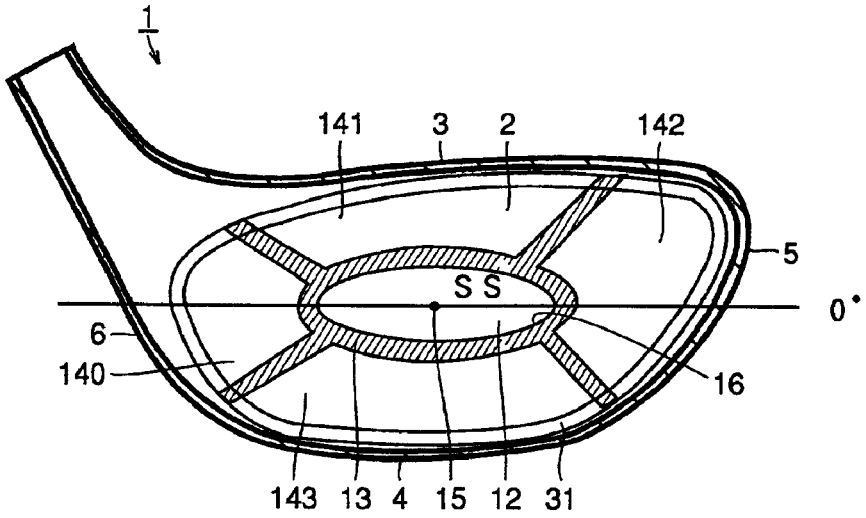
FIG. 84 is a sectional view showing the rear surface of a face of a further exemplary wood golf club head of a metal according to the present invention.

FIGS. 84 to 91 show further examples of the present invention. As shown in FIG. 84, a tapered part 31 of about 2 mm to 10 mm is provided on the peripheral portion of a face 2 in this example. More preferably, a tapered part 31 of 2 mm to 5 mm is provided on the peripheral portion of face 2. The remaining structure of this example is similar to that of the example shown in FIG. 9.

Figure 86:
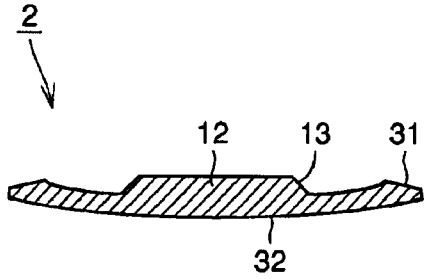
FIG. 86 is a sectional view showing a face of a wood golf club head of a metal according to the present invention.

FIG. 86 shows an exemplary sectional shape of the aforementioned face 2. As shown in FIG. 86, a tapered part 13 is provided on the boundary between a center part 12 and peripheral regions, and the tapered part 31 is provided around the peripheral regions. Both of the thicknesses of the tapered parts 13 and 31 are reduced toward the outer periphery of the face 2, as shown in FIG. 86. Referring to FIG. 86, numeral 32 denotes a hitting surface.

When the tapered part 31 is provided around the peripheral regions as described above, the following effects are attained as hereafter described with reference to FIGS. 87 to 90.

Figure 87:
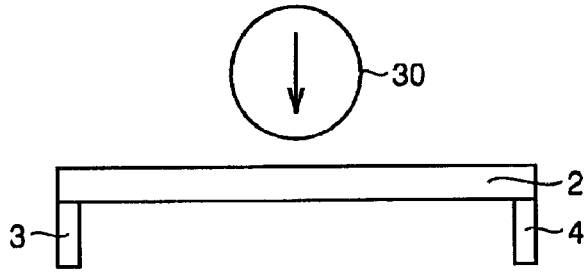
FIG. 87 is a schematic diagram for illustrating deformation of a face of a golf club head colliding with a golf ball.

Bending deformation of the face 2 of the golf club head caused by a golf ball 30 colliding therewith can be regarded as equivalent to bending deformation of a plate having a fixed periphery. FIG. 87 schematically shows the face 2, a crown 3 and a sole 4.

Figure 88:
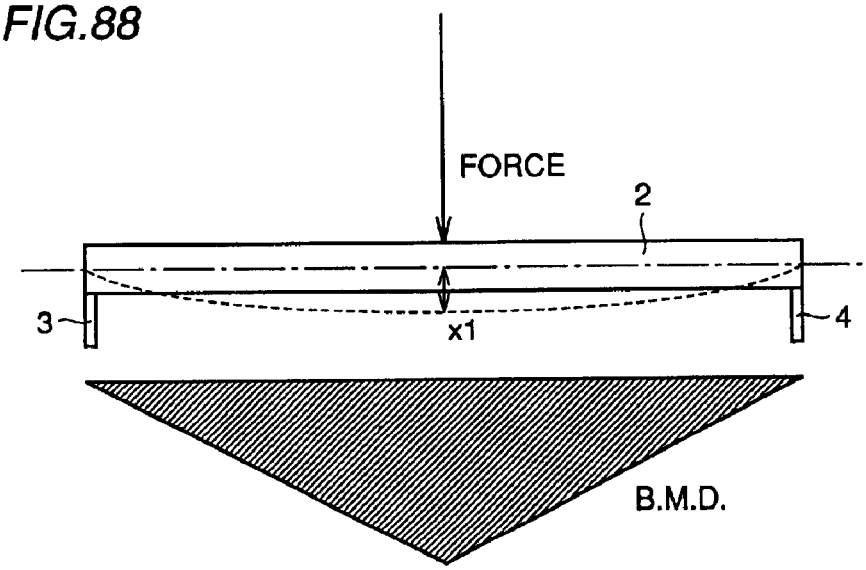
FIG. 88 is a schematic diagram showing deformation and a bending moment of the face of the golf club head colliding with a golf ball.

When the golf ball 30 collides with the central portion of the face 2, force is applied to the center part of the face 2 as shown by arrow in FIG. 88. FIG. 88 shows the current bending moment of the face 2 (see B.M.D. (bending moment diagram)).

When the golf ball 30 collides with the central portion of the face 2, the maximum bending moment is applied to the central portion of the face 2 while the bending moment is reduced toward the outer periphery of the face 2 as shown in FIG. 88. Therefore, the face 2 is deformed as shown by a dotted line in FIG. 88. The maximum quantity of flexure of the face 2 corresponds to the distance ×1 between a neutral axis shown by a one-chain dot line in FIG. 88 and the most flexed position.

Figure 89:
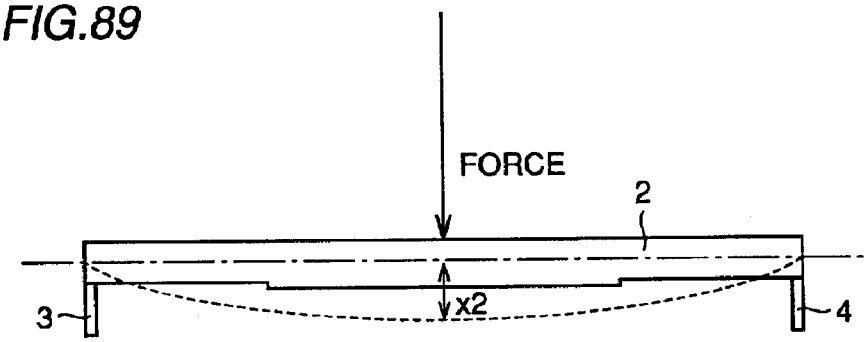
FIG. 89 is a schematic diagram for illustrating deformation of a face of a golf club head, having a peripheral portion reduced in thickness, colliding with a golf ball.

FIG. 89 shows a face 2 having a central portion similar to that shown in FIG. 88 and a peripheral portion having a thickness smaller than that shown in FIG. 88. The bending moment, depending on only the magnitude of force and the distance from the peripheral portion of the face 2, is distributed similarly to the case shown in FIG. 88.

In the example shown in FIG. 89, the peripheral portion of the face 2 has small flexural rigidity and hence the central portion of the face 2 exhibits a larger quantity ×2 of flexure than that in the case shown in FIG. 88 when force is applied to the central portion of the face 2 along arrow in FIG. 89. Therefore, bounce of this face 2 is improved as compared with the face 2 shown in FIG. 88.

The peripheral portion of the face 2 has a small bending moment, and hence the face 2 can be prevented from breakage also when the flexural rigidity of the peripheral portion of the face 2 is small as described above.

Figure 90:
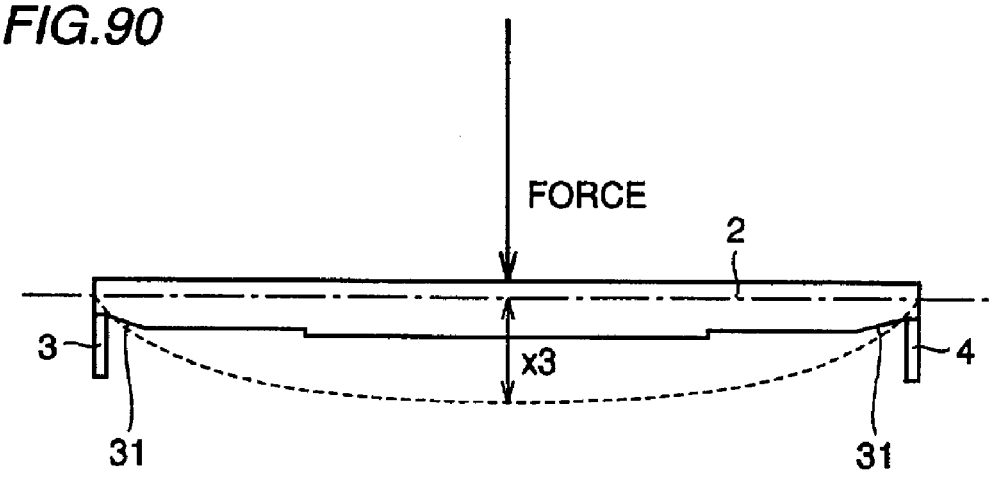
FIG. 90 is a schematic diagram for illustrating deformation of a face, formed by providing a tapered part on the peripheral portion of the face shown in FIG. 89, colliding with a golf ball.

FIG. 90 shows a face 2 formed by providing a tapered part 31 on the peripheral portion of the example shown in FIG. 89. When the tapered part 31 is provided, flexural rigidity of the peripheral portion of the face 2 is further reduced as compared with the example shown in FIG. 89.

As shown in FIG. 90, therefore, the central portion of the face 2 exhibits a larger quantity ×3 of flexure than the aforementioned quantity ×2 of flexure. Thus, bounce of the face 2 can be further improved as compared with the example shown in FIG. 89.

Also in this example, the peripheral portion of the face 2 has a small bending moment, and hence the face 2 can be prevented from breakage.

Figure 91:
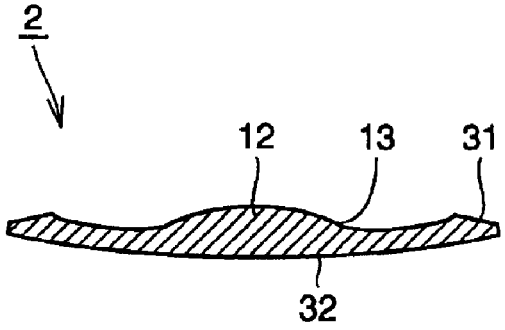
FIG. 91 is a sectional view showing a modification of the face shown in FIG. 86.

FIG. 91 shows a modification of the example shown in FIG. 86. As shown in FIG. 91, the thickness of a center part 12 of a face 2 may be reduced from the central portion of the center part 12 toward the peripheral portion of the center part 12. In other words, the central portion of the center part 12 exhibiting the maximum bending moment has the maximum thickness, and the thickness of the center part 12 is gradually reduced from the central portion toward the periphery.

Thus, the quantity of flexure of the face 2 can be increased while suppressing breakage of the face 2, thereby improving bounce of the face 2.

Figure 85:
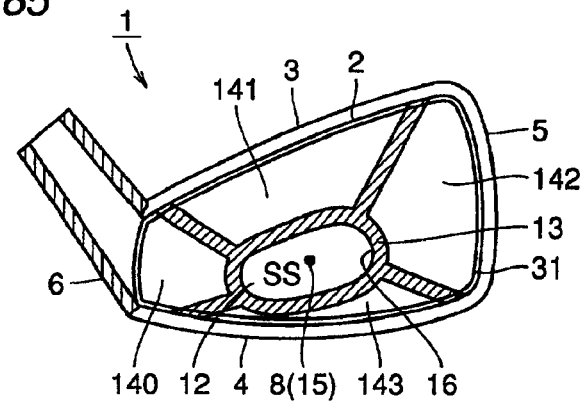
FIG. 85 is a sectional view showing the rear surface of a face of a further exemplary iron golf club head according to the present invention.

As shown in FIG. 85, a tapered part 31 similar to the above may be provided on the face 2 of the iron golf club head. Thus, a similar effect can be expected. The remaining structure of the example shown in FIG. 85 excluding the tapered part 31 is similar to that of the example shown in FIG. 51.

The aforementioned tapered part 31 may be provided on any of the examples other than those shown in FIGS. 84 and 85.

FIGS. 92 to 101 show further examples of the present invention.

In each of the following examples, at least either a crown 3 or a sole 4 has a small thickness on the side of a face 2, and not only the face 2 but also the crown 3 and the sole 4 are deformed when colliding with a golf ball. Thus, the restitution coefficient can be further increased.

Figure 92:
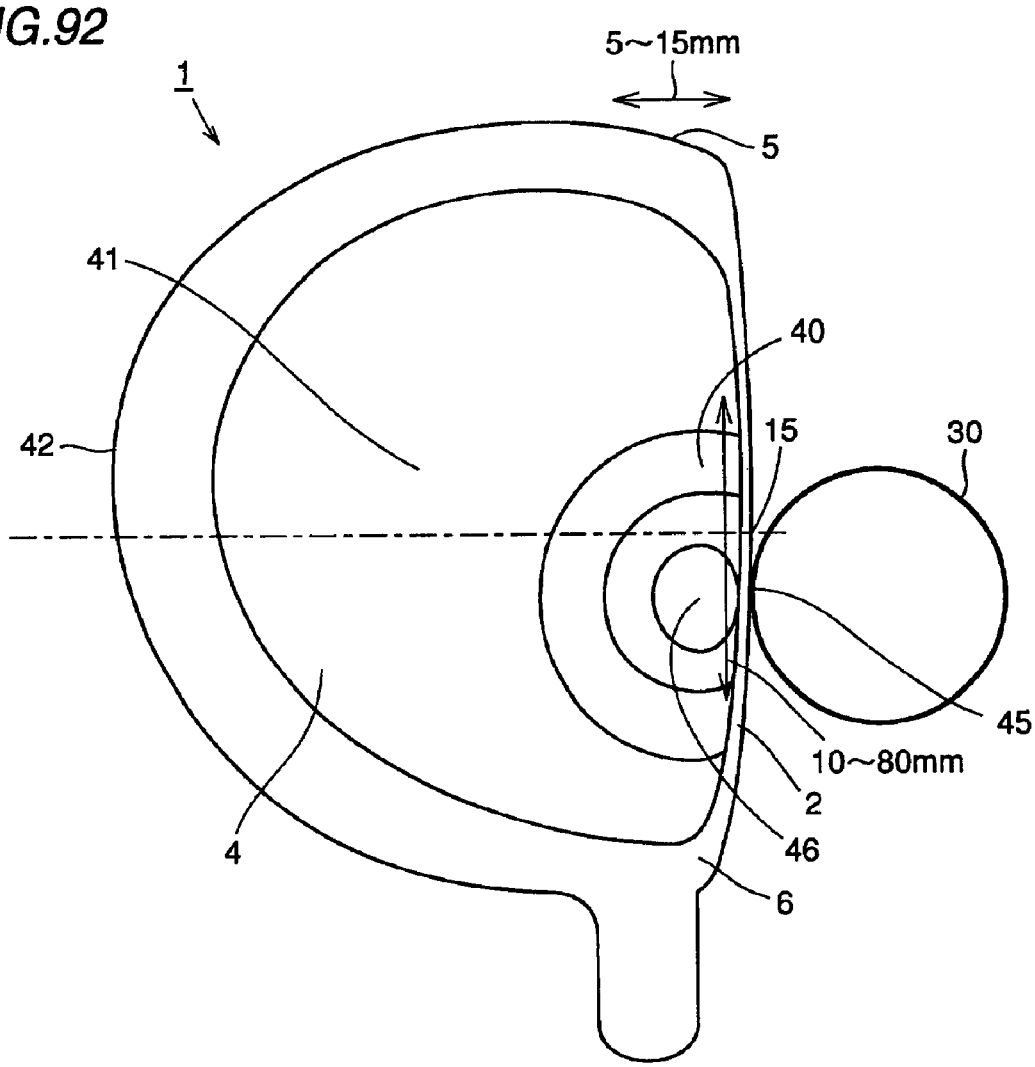
FIG. 92 is a bottom plan view of another wood golf club head of a metal according to the present invention.

FIG. 92 is a bottom plan view of a head 1 of a wood golf club according to the present invention. As shown in FIG. 92, the sole 4 has a first portion 40 located closer to the face 2 and the second portion 41 located closer to a back part 42 than the first portion 40. The first portion 40 has a smaller average thickness than the second portion 41.

Alternatively, a first portion 40 of the crown 3 may have a smaller average thickness than a second portion 41. Preferably, the first portions 40 have smaller average thicknesses than the second portions 41 in both of the sole 4 and the crown 3.

When the player hits a golf ball 30 with the face 2, the maximum flexural position 46 is present in the vicinity of a hitting point 45, as shown in FIG. 92. At this time, the first portion 40 having a small thickness as described above can be readily deformed for improving the restitution coefficient.

A result of an experiment for measuring strain of a sole 4 in a shot is described with reference to FIGS. 93 and 94.

Figure 93:
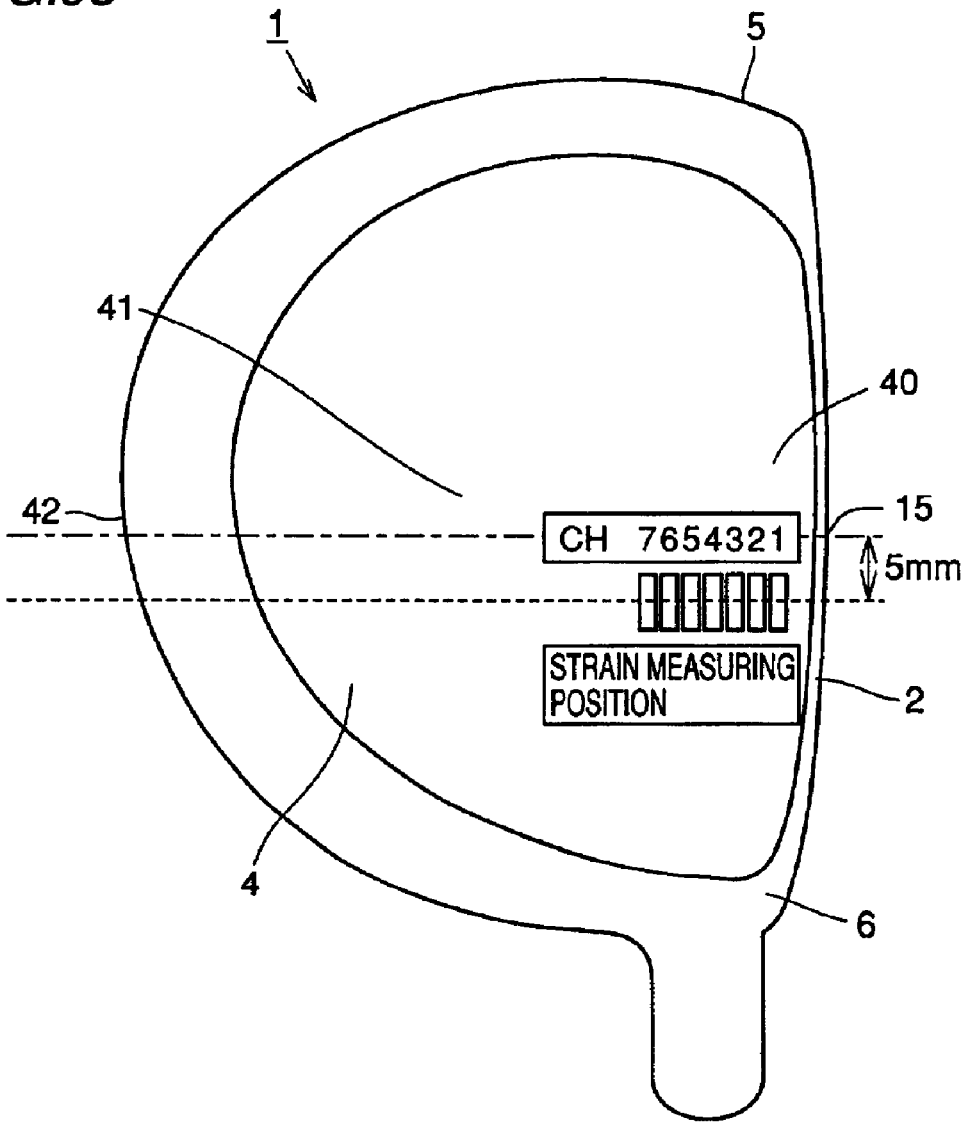
FIG. 93 illustrates a strain measuring position of the head shown in FIG. 92.

In this experiment, a fairway wood golf club (loft angle: 13.5°) of titanium was employed and seven strain gauges CH1 to CH7 were bonded to a sole 4 thereof on positions separated from the center line of a face 2 toward a heel by 5 mm at distances of 6 mm, 8 mm, 10.5 mm, 13 mm, 15.5 mm, 17.5 mm and 19.5 mm between a leading edge and a back side, as shown in FIG. 93. A golf ball was collided with the face 2 at a prescribed speed for measuring quantities of strain of the respective portions. The thicknesses of a first portion 40 and a second portion 41 of the sole 4 were set to 1.1 mm and 3 mm respectively.

Figure 94:
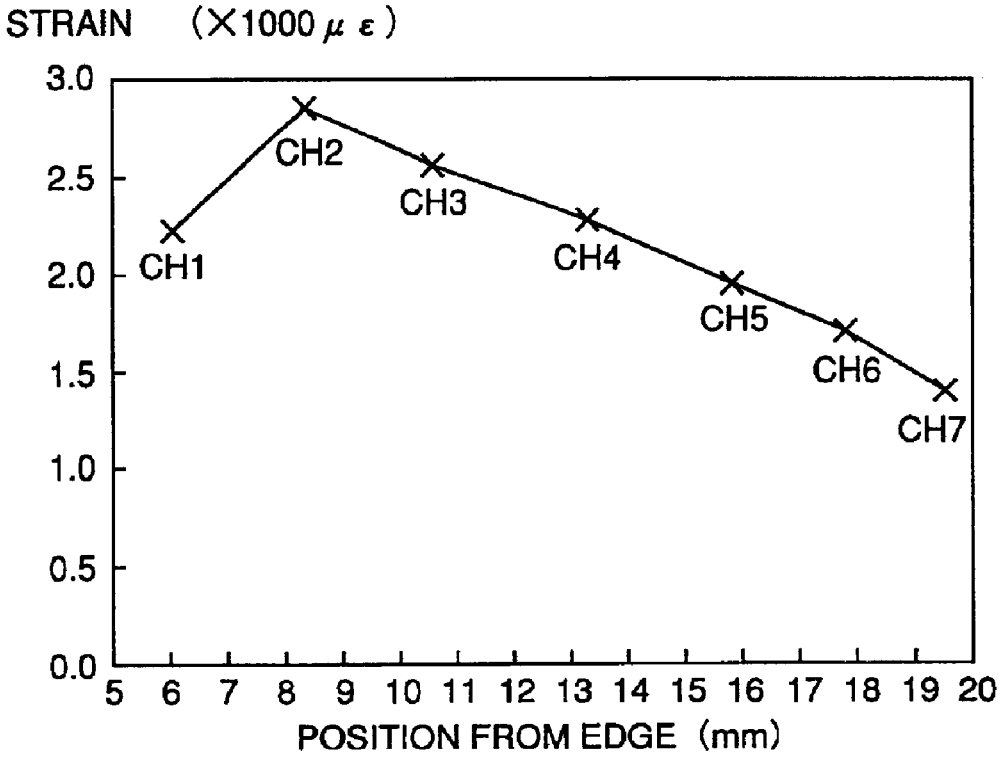
FIG. 94 illustrates the relation between values of strain of the head shown in FIG. 92 caused by shots and distances from a face edge.

FIG. 94 shows the result of the aforementioned experiment. It is understood from FIG. 94 that the sole 4 was most strained on a portion separated from the face 2 by about 8 mm. In other words, it is understood that the portion of about 8 mm in a direction from the face 2 toward a back part 42 is most deformed in a shot.

Thus, it can be said preferable to provide the first portion 40 on a position of at least 5 mm and not more than 15 mm (preferably at least 9 mm and not more than 15 mm) in the direction from the face 2 toward the back part 42.

Thus, the thickness of a portion around the most deformed portion can be reduced and the quantity of deformation of the sole 4 can be increased in a shot. Also when a first portion 40 similar to the above is provided on a crown 3, an effect similar to the above can be expected.

The thickness of the thinnest portion in the first portion 40 of the crown 3 and/or the sole 4 is preferably at least 0.3 mm and not more than 1.5 mm.

The length of the first portion 40 in the direction from a toe 5 of a head 1 toward a heel 6 is preferably at least 10 mm and not more than 80 mm (hitting point distribution range). More preferably, the length of the first portion 40 is at least 30 mm and not more than 60 mm.

The first portion 40 is preferably provided on a position (back side of the central portion of the face 2) corresponding to the central portion of the face 2 including a sweet spot 15. Thus, the crown 3 and/or the sole 4 can be reliably deformed in a shot, for improving the restitution coefficient.

The restitution coefficient of the inventive sample shown in FIG. 93 was improved from 0.761 to 0.771 as compared with a sample having a first portion 40 not reduced in thickness (provided with a sole 4 having a uniform thickness of 3 mm).

While the aforementioned restitution coefficient was measured in the head 1 having a face 2 of a uniform thickness, it is inferred that the restitution coefficient is further improved when the thickness of the face 2 is changed according to the present invention.

FIGS. 95 to 101 show specific structures of the present invention.

Figure 95:
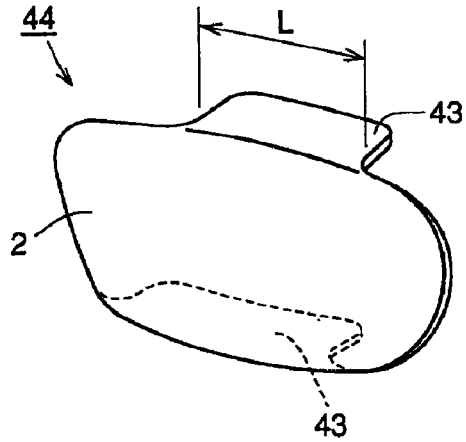
FIG. 95 is a perspective view showing an exemplary shape of a face member according to the present invention.
Figure 96:
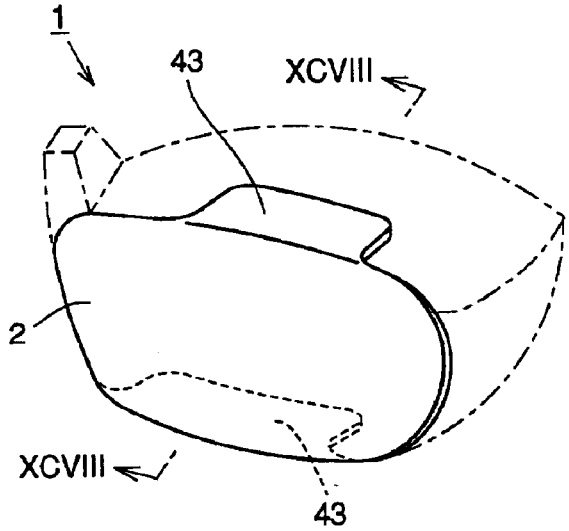
FIG. 96 is a perspective view of a head assembled with the face member shown in FIG. 95.
Figure 97:
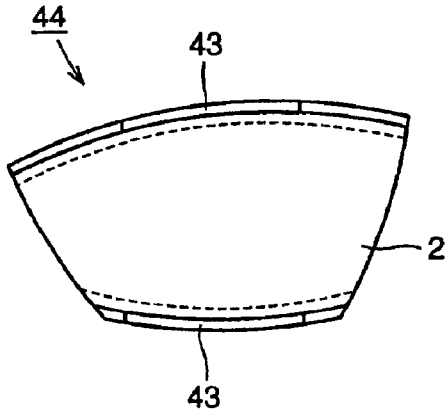
FIG. 97 illustrates the face member shown in FIG. 95 as viewed from the rear side of a face.

FIG. 95 is a perspective view showing an exemplary shape of a face member 44 according to the present invention, FIG. 96 is a perspective view of a head 1 assembled with the face member 44 shown in FIG. 95, and FIG. 97 illustrates the face member 44 as viewed from the rear side of a face 2.

As shown in FIG. 95, the face member 44 has the face 2 and a pair of extension parts 43. The extension parts 43 continuously extend toward a back part (rear side) from peripheral edges of the central portion of the face 2, to partially define a crown 3 and a sole 4 as shown in FIG. 96.

Figure 98:
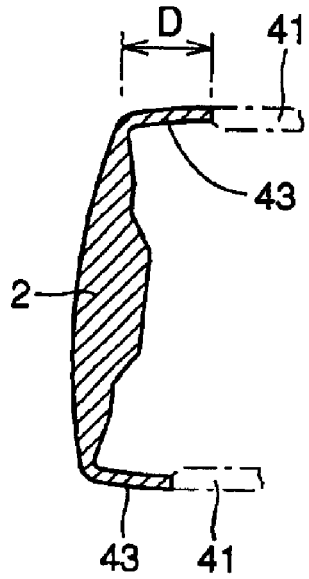
FIG. 98 is a partial sectional view of the head taken along the line 100—100 in FIG. 96.

FIG. 98 is a partial sectional view of the head 1 taken along the line XCVIII—XCVIII in FIG. 96. As shown in FIG. 98, the extension parts 43 extend backward from the upper and lower ends of the face 2 respectively, and second portions 41 are provided to be closer to a back part 42 than the extension parts 43. The extension parts 43 are smaller in thickness than the second portions 41. More specifically, the extension parts 43 are about at least 0.3 mm and not more than 1.5 mm in thickness, and the second portions 41 are about 3 mm in thickness.

The length L of the extension parts 43 shown in FIG. 95 in a direction from a toe 5 of the head 1 toward a heel 6 is set to a value (10 mm to 80 mm, at least 30 mm to 60 mm) equivalent to the length of a hitting point distribution part of the face 2.

The crown 3 and the sole 4 can be reliably deformed in a shot for improving the restitution coefficient of the face 2 due to the aforementioned extension parts 43.

Further, the head 1 can be prevented from cracking in a shot due to the aforementioned extension parts 43.

When the outer periphery of the face 2, the crown 3 and the sole 4 are connected with each other by welding, the outer periphery of the face 2 may be cracked due to defective welding or insufficient welding strength. In particular, large impact force is applied to a portion around a hitting portion of the face 2 in a shot, and hence the outer periphery of the face 2 is readily broken.

As shown in FIGS. 95 and 96, however, the extension part 43 partially defining the crown 3 is integrated with the face 2 while the extension part 43 partially defining the sole 4 is also integrated with the face 2, whereby the welded portions can be separated from the hitting portion of the face 2. Thus, the outer periphery of the face 2 is hardly broken.

Further, the face member 44 can be readily engaged with the crown 3 and the sole 4 due to the aforementioned extension parts 43.

When the extension parts 43 are provided, notches responsive to the extension parts 43 are provided on a back member including the crown 3 and the sole 4. Thus, the face member 44 and the back member can be assembled with each other by simply engaging the extension parts 43 in the notches. Consequently, workability for connecting or joining the face member 44 and the back member with each other is improved.

Further, reduction of bounce caused by a bead can be suppressed due to the aforementioned extension parts 43.

When a face 2 having no extension parts 43 is welded to a back member, a root running bead results on the outer periphery of the face 2 to reduce the effect of the tapered part 31 shown in FIG. 86 etc. and a thin portion around the same.

The aforementioned bead can be separated from the peripheral portion of the face 2 due to the aforementioned extension parts 43, for maintaining the effect of the tapered part 31 and the thin portion around the same. Thus, no reduction of bounce results from welding.

Further, structural or constitutional change caused by a thermal hysterisis or a heat history in welding around the periphery of the hitting portion (central portion) of the face 2 can be suppressed by providing the aforementioned extension parts 43.

When the outer periphery of the face 2 is welded, the metallographic structure may be changed by high heat applied to the periphery. In this case, the crystal structure is consequently enlarged to reduce strength. Therefore, the welded outer periphery of the face 2 may be cracked.

When the aforementioned extension parts 43 are provided, connected portions between the hitting portion of the face 2 and the crown 3 and the sole 4 are located inside the crown 3 and the sole 4 separated from the face 2. Even if the crystal structure is enlarged by welding, therefore, the connected portions are not remarkably strained (not subjected to remarkable stress) by a shot. Consequently, the possibility of cracking of the head 1 is reduced.

Figure 99:
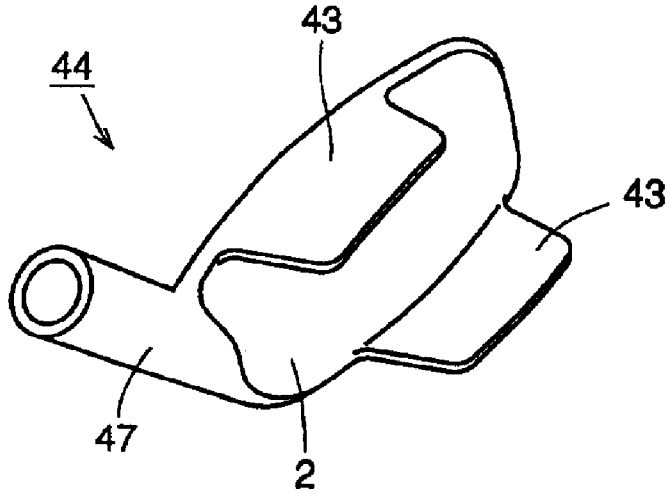
FIG. 99 is a perspective view of a modification of the face member shown in FIG. 95.
Figure 100:
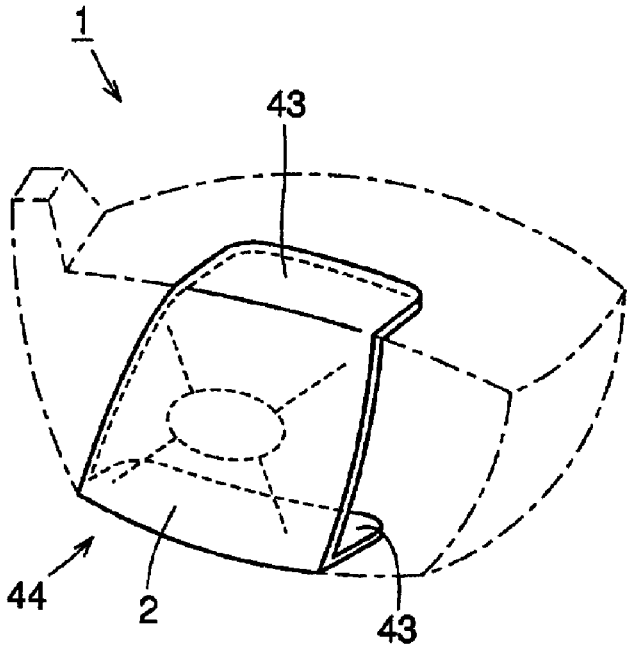
FIG. 100 is a perspective view of a head assembled with another modification of the face member shown in FIG. 95.
Figure 101:
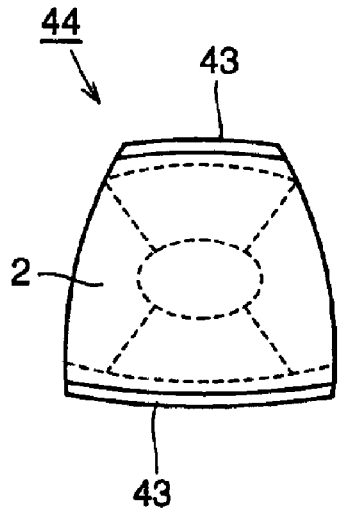
FIG. 101 illustrates the face member shown in FIG. 100 as viewed from the rear side of a face.

The aforementioned extension parts 43 may be provided on a face member 44 integrally provided with a neck 47, as shown in FIG. 99.

Both sides of the face member 44 (the sides of the face 2 closer to the toe 5 and the heel 6) may be so cut that the peripheral portion of the face 2 is formed by a member (back member) other than the face member 44. In other words, the hitting portion (central portion) and the peripheral portion of the face 2 may be formed by different members. An effect similar to the above can be expected also in this case.

Further examples of the face member 44 according to the present invention are now described with reference to FIGS. 102 to 106.

Figure 102:
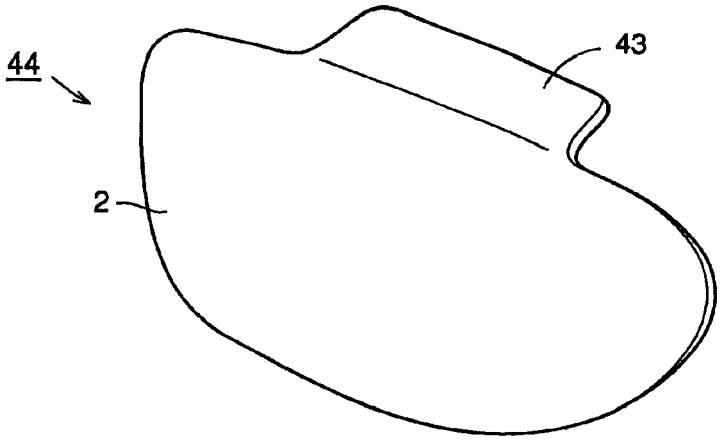
FIGS. 102 to 106 are perspective views showing further examples of the face member according to the present invention.

As shown in FIG. 102, an extension part 43 may be provided only on the top edge of the face member 44. In this case, a cavity is formed on the crown 3 of the body of the head 1 to be engaged with the extension part 43. Thus, the face member 44 can be readily engaged with the body of the head 1 to be welded thereto, and the workability as well as the bounce are improved.

Figure 103:
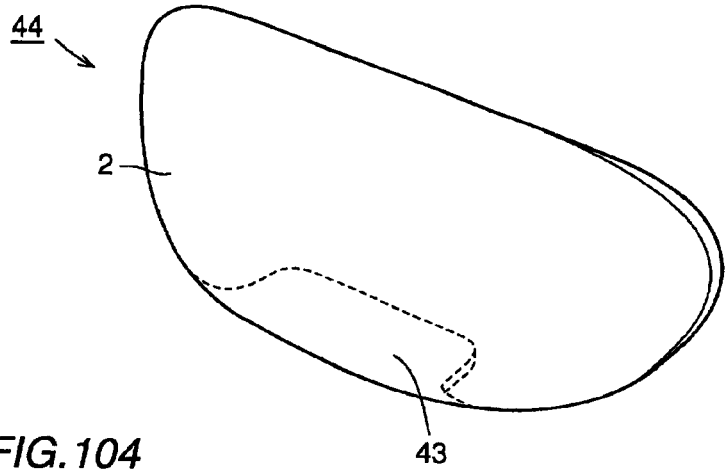

As shown in FIG. 103, an extension part 43 may be provided only on the sole 4 of the face member 44. In this case, a cavity is formed on the sole 4 of the body of the head 1 to be engaged with the extension part 43. Thus, the face member 44 can be readily engaged with the body of the head 1 to be welded thereto, and the workability as well as the bounce are improved.

Figure 104:
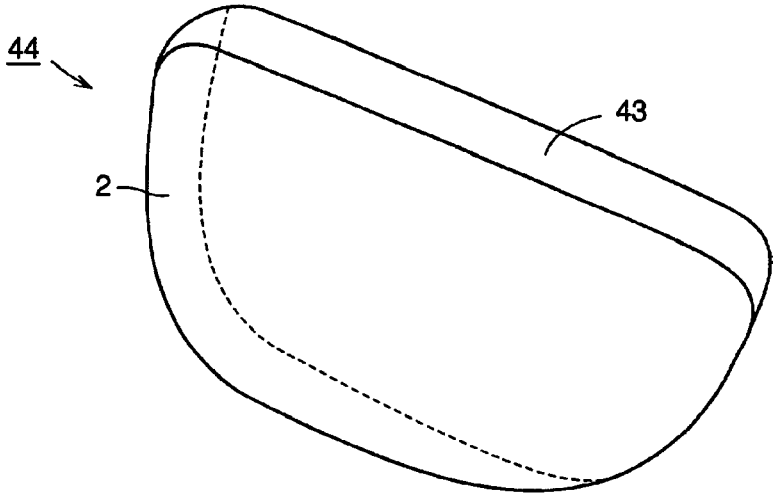

As shown in FIG. 104, an extension part 43 may be provided over the top edge, the toe 5 and the sole 4 of the face member 44 except the heel 6. Thus, the face member 44 is welded to the body of the head 1 on a portion behind the face 2, whereby a toe-side portion can be prevented from weld cracking and the forward end of the toe 5 can be readily shaped. Further, the workability as well as the bounce are improved.

Figure 105:
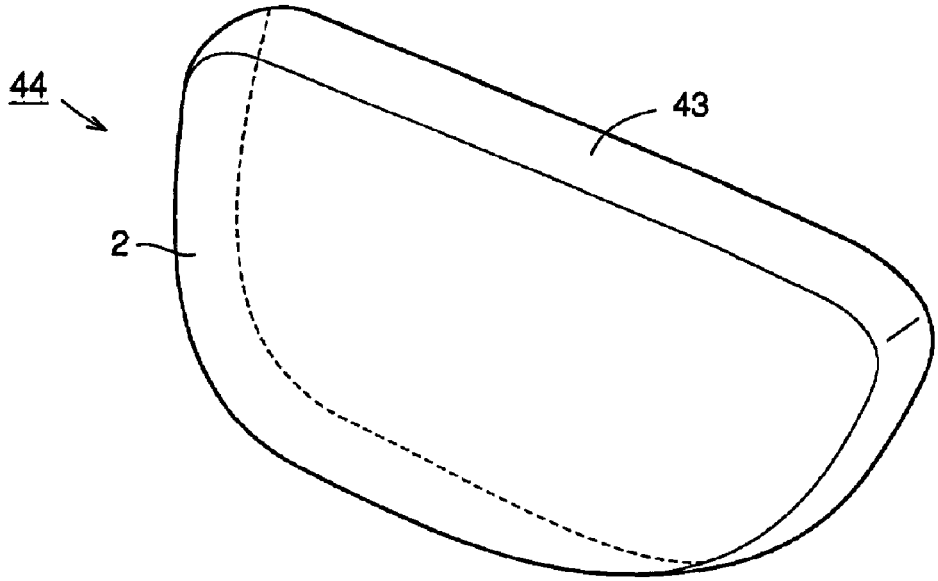

As shown in FIG. 105, an extension part 43 may be provided over the heel 6 and the sole 4 of the face member 44 through the top edge and the toe 5. In other words, the extension part 43 may be provided along the overall periphery of the face member 44. Thus, the face member 44 is welded to the body of the head 1 on a portion behind the face 2, whereby a toe-side portion can be prevented from weld cracking and the forward end of the toe 5 can be readily shaped. Further, the workability as well as the bounce are improved.

Figure 106:
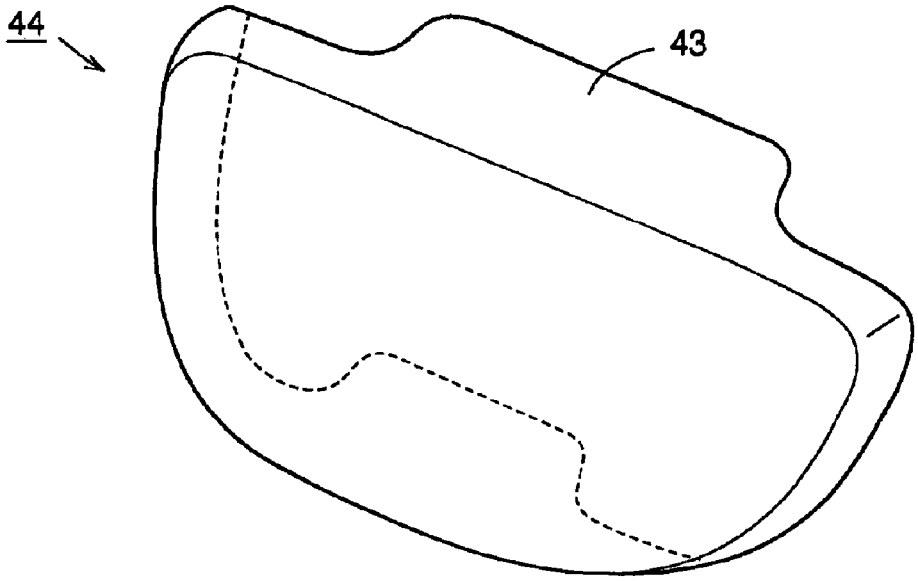

As shown in FIG. 106, an extension part 43 may be provided along the overall periphery of the face member 44, i.e., over the heel 6 and the sole 4 through the top edge and the toe 5 while partially increasing the length of the extension part 43 on portions located on the crown 3 and the sole 4. In this case, cavities are formed on the crown 3 and the sole 4 of the body of the head 1 to be engaged with the portions of the extension part 43 located on the crown 3 and the sole 4.

Thus, the face member 44 can be readily engaged with the body of the head 1 to be welded thereto, and the workability as well as the bounce are improved. Further, the face member 44 is welded to the body of the head 1 on a portion behind the face 2, whereby a toe-side portion can be prevented from weld cracking and the forward end of the toe 5 can be readily shaped.

Alternatively, the length of the extension part 43 provided along the overall periphery of the face member 44 as described above may be partially increased only on a portion located on one of the crown 3 and the sole 4, although this example is not shown. In this case, a cavity is formed on either the crown 3 or the sole 4 of the body of the head 1 to be engaged with the portion of the extension part 43 located thereon.

Thus, the face member 44 can be readily engaged with the body of the head 1 to be welded thereto, and the workability as well as the bounce are improved. Further, the face member 44 is welded to the body of the head 1 on a portion behind the face 2, whereby a toe-side portion can be prevented from weld cracking and the forward end of the toe 5 can be readily shaped.

As hereinabove described, the flexural range is arranged in coincidence with the hitting point distribution range of the player in the face according to the first aspect of the present invention, whereby reduction of the carry of a golf ball can be effectively suppressed in an offset shot.

The flexural range having a small spring constant (at least 2 kN/mm and not more than 4 kN/mm) is provided in the vicinity of the sweet spot according to the second aspect of the present invention, whereby reduction of the carry of a golf ball can be effectively suppressed in an offset shot.

According to either one of the aforementioned aspects, the face can be inhibited from breakage by smoothly changing the thickness of the face for providing the flexural range, for example.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. The golf club comprising:

a head of metal having a face;

a flexural range, defined in said face, where the quantity of flexure in a direction perpendicular to said face is at least 45% and not more than 95% of the maximum quantity of vertical flexure of said face; and a tapered part, wherein said flexural range is arranged according to a hitting point distribution range of a player in said face, wherein the region between the outer periphery of said flexural range and the outer periphery of said face is divided into a plurality of non-concentric peripheral regions, wherein said tapered part is provided between said flexural range and said peripheral regions, the thickness of said flexural range is larger than the thicknesses of said peripheral regions, the thickness of said tapered part is gradually reduced toward said peripheral regions, the ratio of reduction of the thickness of said tapered part varies with the distance between a center of said flexural range and the outer periphery of said face, and the thickness of said peripheral region having a relatively long distance between the outer periphery of said flexural range and the outer periphery of said face is larger than the thickness of said peripheral region having a relatively short distance between the outer periphery of said flexural range and the outer periphery of said face.

2. The golf club according to claim 1, wherein the quantity of flexure in said flexural range in the direction perpendicular to said face is at least 70% and not more than 95% of said maximum quantity of vertical flexure.

3. The golf club according to claim 1, wherein the quantity of flexure in said flexural range in the direction perpendicular to said face is at least 90% and not more than 95% of said maximum quantity of vertical flexure.

4. The golf club according to claim 1, wherein a sweet spot is located within said hitting point distribution range, and said flexural range is a partial region within said hitting point distribution range located around said sweet spot.

5. The golf club according to claim 1, wherein said flexural range is matched with said hitting point distribution range.

6. The golf club according to claim 1, wherein said flexural range has an elliptic shape, and inclination of a major axis of said flexural range is in the range of 0° to 40° with respect to the ground.

7. The golf club according to claim 6, wherein said major axis extends toward an upper portion of a toe of said head.

8. The golf club according to claim 6, wherein the aspect ratio of said flexural range is 1 to 4.

9. The golf club according to claim 6, wherein the center of said flexural range is present within 0 to 5 mm from a sweet spot.

10. The golf club according to claim 1, wherein said flexural range has a quadrilateral shape.

11. The golf club according to claim 1, wherein said flexural range has a polygonal shape.

12. The golf club according to claim 1, wherein the area of said flexural range is 150 to 1500 $mm^2$.

13. The golf club according to claim 1, wherein said flexural range has a substantially uniform thickness, and the thickness of said face is gradually reduced from the outer periphery of said flexural range toward the periphery of said face.

14. The golf club according to claim 1, wherein the thickness of said flexural range is largest at the central portion and gradually reduced from the central portion toward the periphery of said flexural range while the ratio of reduction of the thickness of said face is increased from the outer periphery of said flexural range toward the periphery of said face beyond the periphery of said flexural range.

15. The golf club according to claim 1, wherein the ratio of reduction of the thickness of said face is reduced as the distance between the center of said flexural range and the outer periphery of said face is increased.

16. The golf club according to claim 1, wherein the ratio of reduction of the thickness of said face is reduced as the distance between the center of said flexural range and the outer periphery of said face through the outer periphery of said flexural range is increased.

17. The golf club according to claim 1, wherein the ratio of reduction of the thickness of said flexural range is reduced as the distance between the center of said flexural range and the outer periphery of said flexural range is increased and the ratio of reduction of the thickness of said face is reduced as the distance between the outer periphery of said flexural range and the outer periphery of said face is increased.

18. The golf club according to claim 1, wherein a portion of said face having the maximum height from a sole is located on the side of a toe, and the thickness of said peripheral region located on the side of said toe is larger than the thickness of said peripheral region located on the side of a heel.

19. The golf club according to claim 1, wherein a portion of said face having the maximum height from a sole is located on the side of a heel, and the thickness of said peripheral region located on the side of said heel is larger than the thickness of said peripheral region located on the side of a toe.

20. The golf club according to claim 1, wherein said peripheral regions include first and second peripheral regions, and said first and second peripheral regions are arranged on and under said flexural range respectively.

21. The golf club according to claim 1, wherein said peripheral regions include first and second peripheral regions, said flexural range is arranged in the vicinity of a sole, and said first and second peripheral regions are arranged on the side of a toe and on the side of a heel respectively.

22. The golf club according to claim 1, wherein said peripheral regions include first, second and third peripheral regions, said flexural range extends up to a portion close to a sole, and said first, second and third peripheral regions are arranged side by side on a toe from the side of a heel.

23. The golf club according to claim 1, wherein said peripheral regions include first, second, third and fourth peripheral regions, and said first, second, third and fourth peripheral regions are arranged to surround said flexural range.

24. The golf club according to claim 1, wherein the region between the outer periphery of said flexural range and the outer periphery of said face is divided into a plurality of only non-concentric peripheral regions, the thickness of said flexural range is larger than the thicknesses of said peripheral regions, and the thickness of said peripheral region located on the side of a sole is larger than the thickness of said peripheral region located on the side of a crown.

25. The golf club according to claim 24, wherein a portion of said face having the maximum height from said sole is located on the side of a toe, and the thickness of said peripheral region located on the side of said toe is larger than the thickness of said peripheral region located on the side of a heel.

26. The golf club according to claim 24, wherein a portion of said face having the maximum height from said sole is located on the side of a heel, and the thickness of said peripheral region located on the side of said heel is larger than the thickness of said peripheral region located on the side of a toe.

27. The golf club according to claim 24, wherein said peripheral regions include first, second, third and fourth regions, said first and fourth peripheral regions are located on the side of said sole, said second and third peripheral regions are located on the side of said crown, the length of said first peripheral region between the outer periphery of said flexural range and the outer periphery of said face is larger than the length of said fourth peripheral region between the outer periphery of said flexural range and the outer periphery of said face, the thickness of said first peripheral region is larger than the thickness of said fourth peripheral region, the length of said third peripheral region between the outer periphery of said flexural range and the outer periphery of said face is larger than the length of said second peripheral region between the outer periphery of said flexural range and the outer periphery of said face, and the thickness of said third peripheral region is larger than the thickness of said second peripheral region.

28. The golf club according to claim 1, wherein tapered parts are formed on the boundary between said flexural range and said peripheral regions and the boundary between said peripheral regions in a width of at least 3 mm and not more than 5 mm.

29. The golf club according to claim 1, including a first tapered part having a thickness reduced toward the outer periphery of said face on the boundary between said flexural range and said peripheral regions, and including a second tapered part having a thickness reduced toward the outer periphery of said face around said peripheral regions.

30. The golf club according to claim 29, wherein the thickness of said flexural range is reduced from the central portion of said flexural range toward the outer periphery of said flexural range.

31. The golf club according to claim 1, wherein the average thickness of a first portion located closer to said face in at least either a crown or a sole of said head is smaller than the average thickness of a second portion located closer to a back part of said head.

32. The golf club according to claim 31, wherein the thickness of the thinnest portion of said first portion is at least 0.3 mm and not more than 1.5 mm.

33. The golf club according to claim 31, wherein said first portion is located in the range of at least 9 mm and not more than 15 mm in a direction from the peripheral portion of said face toward said back part.

34. The golf club according to claim 31, wherein the length of said first portion in a direction from a toe toward a heel of said head is at least 10 mm and not more than 80 mm.

35. The golf club according to claim 31, wherein said first portion includes an extension part continuously extending from at least a part of the peripheral portion of said face toward said back part of said head.

36. The golf club according to claim 35, wherein the length of said extension part in a direction from a toe toward a heel of said head is at least 10 mm and not more than 80 mm.

37. The golf club according to claim 36, wherein the central portion of said face and the peripheral portion of said face are formed by different members.

38. A golf club comprising a head of a metal having a face, wherein a flexural range having a spring constant of at least 2 kN/mm and not more than 4 kN/mm is present in the vicinity of a sweet spot of said face, and a tapered part, wherein the region between the outer periphery of said flexural range and the outer periphery of said face is divided into a plurality of non-concentric peripheral regions, wherein said tapered part is provided between said flexural range and said peripheral regions, the thickness of said flexural range is larger than the thicknesses of said peripheral regions, the thickness of said tapered part is gradually reduced toward said peripheral regions, the ratio of reduction of the thickness of said tapered part varies with the distance between a center of said flexural range and the outer periphery of said face, and the thickness of said peripheral region having a relatively long distance between the outer periphery of said flexural range and the outer periphery of said face is larger than the thickness of said peripheral region having a relatively short distance between the outer periphery of said flexural range and the outer periphery of said face.

39. The golf club according to claim 38, wherein the area of said flexural range is at least 75 $mm^2$ and not more than 1260 $mm^2$.

40. The golf club according to claim 38, wherein the area of said flexural range is at least 75 $mm^2$ and not more than 707 $mm^2$.

41. The golf club according to claim 38, wherein the area of said flexural range is at least 75 $mm^2$ and not more than 314 $mm^2$.

42. The golf club according to claim 38, wherein the area of said flexural range is at least 3% and not more than 50% of the area of said face.

43. The golf club according to claim 38, wherein the area of said flexural range is at least 5% and not more than 30% of the area of said face.

44. The golf club according to claim 38, wherein said spring constant is at least 2 kN/mm and not more than 3.5 kN/mm.

45. The golf club according to claim 38, wherein said spring constant is at least 2 kN/mm and not more than 3.0 kN/mm.

46. The golf club according to claim 38, wherein said flexural range has an elliptic shape, and inclination of a major axis of said flexural range is in the range of 0° to 40° with respect to the ground.

47. The golf club according to claim 46, wherein said major axis extends toward an upper portion of a toe of said head.

48. The golf club according to claim 46, wherein the aspect ratio of said flexural range is 1 to 4.

49. The golf club according to claim 46, wherein the center of said flexural range is present within 0 to 5 mm from a sweet spot.

50. The golf club according to claim 38, wherein said flexural range has a quadrilateral shape.

51. The golf club according to claim 38, wherein said flexural range has a polygonal shape.

52. The golf club according to claim 38, wherein said flexural range has a substantially uniform thickness, and the thickness of said face is gradually reduced from the outer periphery of flexural range toward the periphery of said face.

53. The golf club according to claim 38, wherein the thickness of said flexural range is largest at the central portion and gradually reduced from the central portion toward the periphery of said flexural range while the ratio of reduction of the thickness of said face is increased from the outer periphery of said flexural range toward the periphery of said face beyond the periphery of said flexural range.

54. The golf club according to claim 38, wherein the ratio of reduction of the thickness of said face is reduced as the distance between the center of said flexural range and the outer periphery of said face is increased.

55. The golf club according to claim 38, wherein the ratio of reduction of the thickness of said face is reduced as the distance between the outer periphery of said flexural range and the outer periphery of said face is increased.

56. The golf club according to claim 38, wherein the ratio of reduction of the thickness of said flexural range is reduced as the distance between the center of said flexural range and the outer periphery of said flexural range is increased and the ratio of reduction of the thickness of said face is reduced us the distance between the outer periphery of said flexural range and the outer periphery of said face is increased.

57. The golf club according to claim 38, wherein a portion of said face having the maximum height from a sole is located on the side of a toe, and the thickness of said peripheral region located on the side of said toe is larger than the thickness of said peripheral region located on the side of a heel.

58. The golf club according to claim 38, wherein a portion of said face having the maximum height from a sole is located on the side of a heel, and the thickness of said peripheral region located on the side of said heel is larger than the thickness of said peripheral region located on the side of a toe.

59. The golf club according to claim 38, wherein said peripheral regions include first and second peripheral regions, and said first and second peripheral regions are arranged on and under said flexural range respectively.

60. The golf club according to claim 38, wherein said peripheral regions include first and second peripheral regions, said flexural range is arranged in the vicinity of a sole, and said first and second peripheral regions are arranged on the side of a toe and on the side of a heel respectively.

61. The golf club according to claim 38, wherein said peripheral regions include first, second and third peripheral regions, said flexural range extends up to a portion close to a sole, and said first, second and third peripheral regions are arranged side by side on a toe from the side of a heel.

62. The golf club according to claim 38, wherein said peripheral regions include first, second, third and fourth peripheral regions, and said first, second, third and fourth peripheral regions are arranged to surround said flexural range.

63. The golf club according to claim 38, wherein the region between the outer periphery of said flexural range and the outer periphery of said face is divided into a plurality of only non-concentric peripheral regions, the thickness of said flexural range is larger than the thicknesses of said peripheral regions, and the thickness of said peripheral region located on the side of a sole is larger than the thickness of said peripheral region located on the side of a crown.

64. The golf club according to claim 63, wherein a portion of said face having the maximum height from said sole is located on the side of a toe, and the thickness of said peripheral region located on the side of said toe is larger than the thickness of said peripheral region located on the side of a heel.

65. The golf club according to claim 63, wherein a portion of said face having the maximum height from said sole is located on the side of a heel, and the thickness of said peripheral region located on the side of said heel is larger than the thickness of said peripheral region located on the side of a toe.

66. The golf club according to claim 63, wherein said peripheral regions include first, second, third and fourth regions, said first and fourth peripheral regions are located on the side of said sole, said second and third peripheral regions are located on the side of said crown, the length of said first peripheral region between the outer periphery of said flexural range and the outer periphery of said face is larger than the length of said fourth peripheral region between the outer periphery of said flexural range and the outer periphery of said face, the thickness of said first peripheral region is larger than the thickness of said fourth peripheral region, the length of said third peripheral region between the outer periphery of said flexural range and the outer periphery of said face is larger than the length of said second peripheral region between the outer periphery of said flexural range and the outer periphery of said face, and the thickness of said third peripheral region is larger than the thickness of said second peripheral region.

67. The golf club according to claim 38, including a first tapered part having a thickness reduced toward the outer periphery of said face on the boundary between said flexural range and said peripheral regions, and including a second tapered part having a thickness reduced toward the outer periphery of said face around said peripheral regions.

68. The golf club according to claim 67, wherein the thickness of said flexural range is reduced from the central portion of said flexural range toward the outer periphery of said flexural range.

69. The golf club according to claim 38, wherein the average thickness of a first portion located closer to said face in at least either a crown or a sole of said head is smaller than the average thickness of a second portion located closer to a back part of said head.

70. The golf club according to claim 69, wherein the thickness of the thinnest portion of said first portion is at least 0.3 mm and not more than 1.5 mm.

71. The golf club according to claim 69, wherein said first portion is located in the range of at least 9 mm and not more than 15 mm in a direction from the peripheral portion of said face toward said back part.

72. The golf club according to claim 69, wherein the length of said first portion in a direction from a toe toward a heel of said head is at least 10 mm and not more than 80 mm.

73. The golf club according to claim 69, wherein said first portion includes an extension part continuously extending from at least a part of the peripheral portion of said face toward said back part of said head.

74. The golf club according to claim 73, wherein the length of said extension part in a direction from a toe toward a heel of said head is at least 10 mm and not more than 80 mm.

75. The golf club according to claim 74, wherein the central portion of said face and the peripheral portion of said face are formed by different members.

* * * * *